US009528769B2

(12) United States Patent
Sakashita et al.

(10) Patent No.: US 9,528,769 B2
(45) Date of Patent: Dec. 27, 2016

(54) CEILING-MOUNTED AIR CONDITIONING UNIT

(75) Inventors: Akihiko Sakashita, Kusatsu (JP); Shun Yoshioka, Sakai (JP); Yoshiharu Michitsuji, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 964 days.

(21) Appl. No.: 13/376,537

(22) PCT Filed: Jun. 16, 2010

(86) PCT No.: PCT/JP2010/004005

§ 371 (c)(1),
(2), (4) Date: Dec. 6, 2011

(87) PCT Pub. No.: WO2010/146852

PCT Pub. Date: Dec. 23, 2010

(65) Prior Publication Data

US 2012/0073786 A1 Mar. 29, 2012

(30) Foreign Application Priority Data

Jun. 19, 2009 (JP) ..... 2009-146787

(51) Int. Cl.

| | |
|---|---|
| ***F24H 9/06*** | (2006.01) |
| ***F24H 3/02*** | (2006.01) |
| ***F24D 19/02*** | (2006.01) |
| ***F28D 1/04*** | (2006.01) |

(Continued)

(52) U.S. Cl.

CPC ..... *F28D 1/0417* (2013.01); *F24F 1/0007* (2013.01); *F24F 1/0059* (2013.01); *F28D 1/0477* (2013.01);

(Continued)

(58) Field of Classification Search

CPC ..... F28D 1/0417; F28D 1/0477; F24F 1/0059; F24F 1/0007; F24F 2001/0037

(Continued)

(56) References Cited

U.S. PATENT DOCUMENTS 4,483,156 A * 11/1984 Oudenhoven ..... F25B 39/00 62/324.1
4,995,453 A * 2/1991 Bartlett ..... 165/150

(Continued)

FOREIGN PATENT DOCUMENTS

JP 4-78423 U 7/1992
JP 4-359798 A 12/1992

(Continued)

OTHER PUBLICATIONS

International Preliminary Report of corresponding PCT Application No. PCT/JP2010/004005.

(Continued)

*Primary Examiner* — Len Tran
*Assistant Examiner* — Claire Rojohn, III
(74) *Attorney, Agent, or Firm* — Global IP Counselors

(57) ABSTRACT

A ceiling-mounted air conditioning unit includes an indoor heat exchanger disposed on an outer peripheral side of a centrifugal blower. The indoor heat exchanger includes plural heat transfer tubes arranged in multiple stages in a vertical direction and in three rows in a flow direction of air blown out from the blower and are connected to a refrigerant inlet of the indoor heat exchanger in a case where the indoor heat exchanger functions as an evaporator of the refrigerant during cooling, plural liquid refrigerant tubes connected to the heat transfer tubes in a first row on a most upwind side, second row-side gas refrigerant tubes connected to a refrigerant outlet of the indoor heat exchanger during cooling and connected to the heat transfer tubes in a second row, and third row-side gas refrigerant tubes connected to the heat transfer tubes in a third row on a most downwind side.

15 Claims, 37 Drawing Sheets

(51) Int. Cl.
*F24F 1/00* (2011.01)
*F28D 1/047* (2006.01)
*F28D 21/00* (2006.01)

(52) U.S. Cl.
CPC ..... *F24F 2001/0037* (2013.01); *F28D 2021/0071* (2013.01)

(58) Field of Classification Search
USPC ..... 165/53, 54, 175, 104.14; 62/115, 525, 62/DIG. 16, 498
See application file for complete search history.

(56) References Cited

U.S. PATENT DOCUMENTS

| | | | | | |
|---|---|---|---|---|---|
| 5,076,353 | A | * | 12/1991 | Haussmann | F25B 39/04 165/110 |
| 2016/0123645 | A1 | * | 5/2016 | Kim | F25B 13/00 62/115 |

FOREIGN PATENT DOCUMENTS

| | | | | | |
|---|---|---|---|---|---|
| JP | 11-51412 | A | | 2/1999 | |
| JP | 11-257800 | A | | 9/1999 | |
| JP | 2000-111206 | A | | 4/2000 | |
| JP | 2000111206 | A | * | 4/2000 | F25B 41/00 |
| JP | 2000-154991 | A | | 6/2000 | |
| JP | 2000-227230 | A | | 8/2000 | |
| JP | 2001-174047 | A | | 6/2001 | |
| JP | 2005-133976 | A | | 5/2005 | |
| JP | 2009-30827 | A | | 2/2009 | |

OTHER PUBLICATIONS

International Search Report of corresponding PCT Application No. PCT/JP2010/004005.

* cited by examiner

CEILING-MOUNTED AIR CONDITIONING UNIT

CROSS-REFERENCE TO RELATED APPLICATIONS

This U.S. National stage application claims priority under 35 U.S.C. §119(a) to Japanese Patent Application No. 2009-146787, filed in Japan on Jun. 19, 2009, the entire contents of which are hereby incorporated herein by reference.

TECHNICAL FIELD

The present invention relates to a ceiling-mounted air conditioning unit and particularly to a ceiling-mounted air conditioning unit having a structure where an indoor heat exchanger comprising a fin-and-tube heat exchanger is placed on an outer peripheral side of a centrifugal blower as seen in a plan view.

BACKGROUND ART

Conventionally, there has been a ceiling-mounted air conditioning unit such as described in Japanese Patent Publication No. 2009-30827. This ceiling-mounted air conditioning unit has a structure where an indoor heat exchanger comprising a fin-and-tube heat exchanger is placed on an outer peripheral side of a centrifugal blower as seen in a plan view. In the indoor heat exchanger, plural heat transfer tubes inside of which flows refrigerant are arranged in multiple stages in a vertical direction and in two rows in a flow direction of air blown out from a centrifugal blower.

SUMMARY

In the above-described conventional ceiling-mounted air conditioning unit, even higher performance is demanded. Additionally, with respect to this demand for higher performance, in a ceiling-mounted air conditioning unit, changing the number of rows of the heat transfer tubes configuring the indoor heat exchanger from two rows to three rows in consideration of restrictions on the height dimension and the planar dimension is conceivable. In this case, configuring the indoor heat exchanger in such a way that, during cooling, the refrigerant flows in the order of heat transfer tubes in a first row that is the row on the most upwind side in the flow direction of the air, heat transfer tubes in a second row, and heat transfer tubes in a third row that is the row on the most downwind side and in such a way that, during heating, the refrigerant flows in the opposite direction of the direction during cooling is conceivable.

However, in an indoor heat exchanger such as this where the number of rows of the heat transfer tubes has been changed to three rows, during cooling, the temperature of the air passing through the third row tends to become lower because the air and the refrigerant become parallel flows. For this reason, in this indoor heat exchanger, there is the worry that it will become difficult for the degree of superheat of the refrigerant in the refrigerant outlet in a case where the indoor heat exchanger functions as an evaporator of the refrigerant during cooling to become larger and that the heat exchange efficiency during cooling will not improve.

It is a problem of the present invention to improve, in a ceiling-mounted air conditioning unit having a structure where an indoor heat exchanger comprising a fin-and-tube heat exchanger is placed on an outer peripheral side of a centrifugal blower as seen in a plan view, the heat exchange efficiency during cooling by making it easier for the degree of superheat of refrigerant in a refrigerant outlet in a case where the indoor heat exchanger functions as an evaporator of the refrigerant during cooling to become larger.

A ceiling-mounted air conditioning unit pertaining to a first aspect of the invention is a ceiling-mounted air conditioning unit having a structure where an indoor heat exchanger comprising a fin-and-tube heat exchanger is placed on an outer peripheral side of a centrifugal blower as seen in a plan view. The indoor heat exchanger has a structure where plural heat transfer tubes inside of which flows refrigerant are arranged in multiple stages in a vertical direction and in three rows in a flow direction of air blown out from the centrifugal blower. Additionally, the indoor heat exchanger has a structure where plural liquid refrigerant tubes connected to a refrigerant inlet of the indoor heat exchanger in a case where the indoor heat exchanger functions as an evaporator of the refrigerant during cooling are connected to heat transfer tubes in a first row that is the row on the most upwind side in the flow direction of the air. Further, the indoor heat exchanger has a structure where second row-side gas refrigerant tubes that are some of plural gas refrigerant tubes connected to a refrigerant outlet of the indoor heat exchanger during cooling are connected to heat transfer tubes in a second row in the flow direction of the air. Moreover, the indoor heat exchanger has a structure where third row-side gas refrigerant tubes that are the rest of the plural gas refrigerant tubes are connected to heat transfer tubes in a third row that is the row on the most downwind side in the flow direction of the air.

In this ceiling-mounted air conditioning unit, during cooling, some of the refrigerant inflowing from the refrigerant inlet during cooling of the indoor heat exchanger is sent to the second row-side gas refrigerant tubes immediately after performing heat exchange with the air crossing the heat transfer tubes in the second row whose temperature is higher than that of the air crossing the heat transfer tubes in the third row. Further, in this ceiling-mounted air conditioning unit, during cooling, the rest of the refrigerant inflowing from the refrigerant inlet during cooling of the indoor heat exchanger is sent to the third row-side gas refrigerant tubes immediately after performing heat exchange with the air crossing the heat transfer tubes in the third row. Additionally, the refrigerant that has passed through the second row-side gas refrigerant tubes and the refrigerant that has passed through the third row-side gas refrigerant tubes merge together and exit from the refrigerant outlet during cooling of the indoor heat exchanger. Here, the degree of superheat of the refrigerant immediately after performing heat exchange with the air crossing the heat transfer tubes in the second row easily becomes larger than the degree of superheat of the refrigerant immediately after performing heat exchange with the air crossing the heat transfer tubes in the third row because it is affected by the temperature of the air crossing the heat transfer tubes in the second row.

Because of this, in this ceiling-mounted air conditioning unit, it becomes easier for the degree of superheat of the refrigerant exiting from the refrigerant outlet during cooling of the indoor heat exchanger to become larger compared to the case of employing a structure where all of the gas refrigerant tubes are connected to the heat transfer tubes in the third row, and the heat exchange efficiency during cooling can be improved.

Further, in this ceiling-mounted air conditioning unit, during heating, all the refrigerant inflowing from the refrigerant inlet during heating of the indoor heat exchanger is sent to the liquid refrigerant tubes immediately after performing heat exchange with the air crossing the heat transfer tubes in the first row whose temperature is the lowest.

Because of this, in this ceiling-mounted air conditioning unit, it becomes difficult for the degree of subcooling in the refrigerant outlet during heating of the indoor heat exchanger to become smaller, and a drop in the heat exchange efficiency during heating can be suppressed.

As described above, in this ceiling-mounted air conditioning unit, it can be made more difficult for the degree of subcooling in the refrigerant outlet during heating of the indoor heat exchanger to become smaller and it can also be made easier for the degree of superheat of the refrigerant exiting from the refrigerant outlet during cooling of the indoor heat exchanger to become larger, and the heat exchange efficiency of the indoor heat exchanger during cooling can be improved while suppressing a drop in the heat exchange efficiency of the indoor heat exchanger during heating.

A ceiling-mounted air conditioning unit pertaining to a second aspect of the invention is the ceiling-mounted air conditioning unit pertaining to the first aspect of the invention, wherein the liquid refrigerant tubes, the second row-side gas refrigerant tubes, and the third row-side gas refrigerant tubes are connected to lengthwise direction single ends of the corresponding heat transfer tubes.

In this ceiling-mounted air conditioning unit, the work of connecting the liquid refrigerant tubes, the second row-side gas refrigerant tubes, and the third row-side gas refrigerant tubes to the heat transfer tubes can be consolidated and performed on one lengthwise direction end side of the indoor heat exchanger, so the assemblability of the indoor heat exchanger improves.

A ceiling-mounted air conditioning unit pertaining to a third aspect of the invention is the ceiling-mounted air conditioning unit pertaining to the first or second aspect of the invention, wherein the indoor heat exchanger has inter-row branching portions that cause the refrigerant that has been sent to the outlets of the heat transfer tubes in the first row during cooling to branch into the heat transfer tubes in the second row and the heat transfer tubes in the third row. Additionally, the outlets of the heat transfer tubes in the second row in a case where the indoor heat exchanger functions as an evaporator of the refrigerant during cooling are connected to the second row-side gas refrigerant tubes. Further, the outlets of the heat transfer tubes in the third row in a case where the indoor heat exchanger functions as an evaporator of the refrigerant during cooling are connected to the third row-side gas refrigerant tubes.

In this ceiling-mounted air conditioning unit, during cooling, the refrigerant that has become gas-rich because of heat exchange with the air in the heat transfer tubes in the first row is caused to branch into and is sent through the heat transfer tubes in the second row and the heat transfer tubes in the third row, so an increase in the flow speed of the refrigerant that has become gas-rich can be suppressed. Further, in this ceiling-mounted air conditioning unit, during heating, the refrigerant that has become liquid-rich because of heat exchange with the air in the heat transfer tubes in the second row and the refrigerant that has become liquid-rich because of heat exchange with the air in the heat transfer tubes in the third row are caused to merge together and become sent to the heat transfer tubes in the first row, so the flow speed of the refrigerant that has become liquid-rich can be increased to thereby increase the heat transfer coefficient in the heat transfer tubes in the first row.

Because of this, in this ceiling-mounted air conditioning unit, an increase in pressure drop can be suppressed as a result of the inter-row branching portions causing the flow of the refrigerant to branch, so the heat exchange efficiency of the indoor heat exchanger during cooling can be further improved. In particular, in this ceiling-mounted air conditioning unit, an increase in the flow speed of the refrigerant in the heat transfer tubes in the second row and the heat transfer tubes in the third row through which flows the gas-rich refrigerant whose effect with respect to pressure drop is large is suppressed, so the heat exchange efficiency of the indoor heat exchanger during cooling can be effectively improved. Further, in this ceiling-mounted air conditioning unit, the heat transfer coefficient is increased by increasing the flow speed of the refrigerant in the heat transfer tubes in the first row through which flows the liquid-rich refrigerant whose effect with respect to pressure drop is small, so it becomes easier for the degree of subcooling in the refrigerant outlet during heating of the indoor heat exchanger to become larger, and a drop in the heat exchange efficiency during heating can be further suppressed.

A ceiling-mounted air conditioning unit pertaining to a fourth aspect of the invention is the ceiling-mounted air conditioning unit pertaining to the third aspect of the invention, wherein the refrigerant that has passed through the liquid refrigerant tubes during cooling is sent to first upstream-side heat transfer tubes that are one of the heat transfer tubes in the first row. The refrigerant that has been sent to the first upstream-side heat transfer tubes passes through the first upstream-side heat transfer tubes, thereafter further passes through first downstream-side heat transfer tubes that are the heat transfer tubes in the first row apart from the first upstream-side heat transfer tubes. At the outlets of the first downstream-side heat transfer tubes, the refrigerant that has passed through the first downstream-side heat transfer tubes is caused by the inter-row branching portions to branch into second upstream-side heat transfer tubes that are one of the heat transfer tubes in the second row and third upstream-side heat transfer tubes that are one of the heat transfer tubes in the third row. Additionally, the refrigerant that has been sent to the second upstream-side heat transfer tubes passes through the second upstream-side heat transfer tubes, thereafter further passes through second downstream-side heat transfer tubes that are the heat transfer tubes in the second row apart from the second upstream-side heat transfer tubes, and is sent from the outlets of the second downstream-side heat transfer tubes to the second row-side gas refrigerant tubes. Further, the refrigerant that has been sent to the third upstream-side heat transfer tubes passes through the third upstream-side heat transfer tubes, thereafter further passes through third downstream-side heat transfer tubes that are the heat transfer tubes in the third row apart from the third upstream-side heat transfer tubes, and is sent from the outlets of the third downstream-side heat transfer tubes to the third row-side gas refrigerant tubes.

In this ceiling-mounted air conditioning unit, the refrigerant flowing through the heat transfer tubes in each row flows in such a way that, after heading from the one lengthwise direction end of the indoor heat exchanger to the other end, it turns back from the other lengthwise direction end to the one end. For this reason, not only are the liquid refrigerant tubes, the second row-side gas refrigerant tubes, and the third row-side gas refrigerant tubes consolidated on the one lengthwise direction end side of the indoor heat exchanger, but the inter-row branching portions also become placed on the one lengthwise direction end side of the indoor heat exchanger.

Because of this, in this ceiling-mounted air conditioning unit, in the case of employing a structure that requires the work of connecting the inter-row branching portions to the heat transfer tubes when assembling the indoor heat exchanger, the work of connecting the liquid refrigerant tubes, the second row-side gas refrigerant tubes, the third row-side gas refrigerant tubes, and the inter-row branching portions to the heat transfer tubes can be consolidated and performed on the one lengthwise direction end side of the indoor heat exchanger, so the assemblability of the indoor heat exchanger improves.

A ceiling-mounted air conditioning unit pertaining to a fifth aspect of the invention is the ceiling-mounted air conditioning unit pertaining to the fourth aspect of the invention, wherein the second upstream-side heat transfer tubes are placed on lower sides of the third upstream-side heat transfer tubes.

In this ceiling-mounted air conditioning unit, during cooling, it becomes easier for more of the refrigerant to flow into the second upstream-side heat transfer tubes than the third upstream-side heat transfer tubes because of the action of gravity.

Because of this, in this ceiling-mounted air conditioning unit, it becomes easier for the degree of superheat of the refrigerant exiting from the refrigerant outlet during cooling of the indoor heat exchanger to become larger, and the heat exchange efficiency of the indoor heat exchanger during cooling can be further improved.

A ceiling-mounted air conditioning unit pertaining to a sixth aspect of the invention is the ceiling-mounted air conditioning unit pertaining to the fourth or fifth aspect of the invention, wherein the inter-row branching portions are formed in such a way that the flow path length from the outlets of the first downstream-side heat transfer tubes to the inlets of the third upstream-side heat transfer tubes becomes longer than the flow path length from the outlets of the first downstream-side heat transfer tubes to the inlets of the second upstream-side heat transfer tubes in a case where the indoor heat exchanger functions as an evaporator of the refrigerant during cooling.

In this ceiling-mounted air conditioning unit, during cooling, it becomes easier for more of the refrigerant to flow into the second upstream-side heat transfer tubes where the flow path resistance from the outlets of the first downstream-side heat transfer tubes through the inter-row branching portions to the inlets of the second upstream-side heat transfer tubes is small.

Because of this, in this ceiling-mounted air conditioning unit, it becomes easier for the degree of superheat of the refrigerant exiting from the refrigerant outlet during cooling of the indoor heat exchanger to become larger, and the heat exchange efficiency of the indoor heat exchanger during cooling can be further improved.

A ceiling-mounted air conditioning unit pertaining to a seventh aspect of the invention is the ceiling-mounted air conditioning unit pertaining to any of the fourth to sixth aspects of the invention, wherein the third downstream-side heat transfer tubes are placed on upper sides of the third upstream-side heat transfer tubes.

In this ceiling-mounted air conditioning unit, during cooling, the refrigerant passing through the third upstream-side heat transfer tubes and the third downstream-side heat transfer tubes flows in such a way as to smoothly ascend toward the third row-side gas refrigerant tubes.

Because of this, in this ceiling-mounted air conditioning unit, an increase in pressure drop when the refrigerant passes through the third upstream-side heat transfer tubes and the third downstream-side heat transfer tubes can be suppressed, so the heat exchange efficiency of the indoor heat exchanger during cooling can be further improved.

A ceiling-mounted air conditioning unit pertaining to an eighth aspect of the invention is the ceiling-mounted air conditioning unit pertaining to any of the fourth to seventh aspects of the invention, wherein the second downstream-side heat transfer tubes are placed on upper sides of the second upstream-side heat transfer tubes.

In this ceiling-mounted air conditioning unit, during cooling, the refrigerant passing through the second upstream-side heat transfer tubes and the second downstream-side heat transfer tubes flows in such a way as to smoothly ascend toward the second row-side gas refrigerant tubes.

Because of this, in this ceiling-mounted air conditioning unit, an increase in pressure drop when the refrigerant passes through the second upstream-side heat transfer tubes and the second downstream-side heat transfer tubes can be suppressed, so the heat exchange efficiency of the indoor heat exchanger during cooling can be further improved.

A ceiling-mounted air conditioning unit pertaining to a ninth aspect of the invention is the ceiling-mounted air conditioning unit pertaining to any of the fourth to eighth aspects of the invention, wherein the first downstream-side heat transfer tubes are placed on upper sides of the first upstream-side heat transfer tubes.

In this ceiling-mounted air conditioning unit, during heating, the refrigerant passing through the first downstream-side heat transfer tubes and the first upstream-side heat transfer tubes flows in such a way as to descend toward the liquid refrigerant tubes.

Because of this, in this ceiling-mounted air conditioning unit, it becomes easier for the degree of subcooling in the refrigerant outlet during heating of the indoor heat exchanger to become larger, and a drop in the heat exchange efficiency during heating can be further suppressed.

A ceiling-mounted air conditioning unit pertaining to a tenth aspect of the invention is the ceiling-mounted air conditioning unit pertaining to the fourth aspect of the invention, wherein the outlets of the second downstream-side heat transfer tubes and the outlets of the third downstream-side heat transfer tubes in a case where the indoor heat exchanger functions as an evaporator of the refrigerant during cooling are placed in such a way as to be adjacent to the outlets of other of the second downstream-side heat transfer tubes and the outlets of other of the third downstream-side heat transfer tubes placed on upper sides or lower sides. Additionally, the inlets of the first upstream-side heat transfer tubes in a case where the indoor heat exchanger functions as an evaporator of the refrigerant during cooling are placed in such a way as to be adjacent to the inlets of other of the first upstream-side heat transfer tubes placed on upper sides or lower sides.

In this ceiling-mounted air conditioning unit, the second downstream-side heat transfer tubes and the third downstream-side heat transfer tubes whose temperature becomes higher become placed together on the fins, and the first upstream-side heat transfer tubes whose temperature becomes lower become placed together on the fins. For this reason, in this ceiling-mounted air conditioning unit, during cooling, it becomes more difficult for the hot thermal energy of the second downstream-side heat transfer tubes and the third downstream-side heat transfer tubes to travel via the fins to other portions of the fins, and during heating, it becomes more difficult for the cold thermal energy of the first upstream-side heat transfer tubes to travel via the fins to other portions of the fins.

Because of this, in this ceiling-mounted air conditioning unit, a situation where a drop in the heat exchange efficiency of the indoor heat exchanger during cooling or during heating arises because of heat conduction via the fins can be suppressed as much as possible.

A ceiling-mounted air conditioning unit pertaining to an eleventh aspect of the invention is the ceiling-mounted air conditioning unit pertaining to the third aspect of the invention, wherein the refrigerant that has passed through the liquid refrigerant tubes during cooling is sent to first heat transfer tubes that are one of the heat transfer tubes in the first row. The refrigerant that has been sent to the first heat transfer tubes passes through the first heat transfer tubes, and, in the outlets of the first heat transfer tubes, is thereafter caused by the inter-row branching portions to branch into second heat transfer tubes that are one of the heat transfer tubes in the second row and third heat transfer tubes that are one of the heat transfer tubes in the third row. Additionally, the refrigerant that has been sent to the second heat transfer tubes passes through the second heat transfer tubes and is thereafter sent from the outlets of the second heat transfer tubes to the second row-side gas refrigerant tubes. Further, the refrigerant that has been sent to the third heat transfer tubes passes through the third heat transfer tubes and is thereafter sent from the outlets of the third heat transfer tubes to the third row-side gas refrigerant tubes.

In this ceiling-mounted air conditioning unit, the refrigerant flows in such a way that, after heading from the one lengthwise direction end of the indoor heat exchanger to the other end, it is caused to branch or merges together in the inter-row branching portions at the other lengthwise direction end of the indoor heat exchanger and turns back from the other lengthwise direction end of the indoor heat exchanger to the one end. For this reason, the paths on which the refrigerant flows become short paths where the refrigerant makes one round trip in the lengthwise direction through the indoor heat exchanger.

Because of this, in this ceiling-mounted air conditioning unit, an increase in pressure drop can be suppressed, so the heat exchange efficiency of the indoor heat exchanger during cooling can be further improved, and a drop in the heat exchange efficiency of the indoor heat exchanger during heating can be further suppressed.

A ceiling-mounted air conditioning unit pertaining to a twelfth aspect of the invention is the ceiling-mounted air conditioning unit pertaining to the eleventh aspect of the invention, wherein the second heat transfer tubes are placed on lower sides of the third heat transfer tubes.

In this ceiling-mounted air conditioning unit, during cooling, it becomes easier for more of the refrigerant to flow into the second heat transfer tubes than the third heat transfer tubes because of the action of gravity.

Because of this, in this ceiling-mounted air conditioning unit, it becomes easier for the degree of superheat of the refrigerant exiting from the refrigerant outlet during cooling of the indoor heat exchanger to become larger, and the heat exchange efficiency of the indoor heat exchanger during cooling can be further improved.

A ceiling-mounted air conditioning unit pertaining to a thirteenth aspect of the invention is the ceiling-mounted air conditioning unit pertaining to the eleventh or twelfth aspect of the invention, wherein the inter-row branching portions are formed in such a way that the flow path length from the outlets of the first heat transfer tubes to the inlets of the third heat transfer tubes becomes longer than the flow path length from the outlets of the first heat transfer tubes to the inlets of the second heat transfer tubes in a case where the indoor heat exchanger functions as an evaporator of the refrigerant during cooling.

In this ceiling-mounted air conditioning unit, during cooling, it becomes easier for more of the refrigerant to flow into the second heat transfer tubes where the flow path resistance from the outlets of the first heat transfer tubes through the inter-row branching portions to the inlets of the second heat transfer tubes is small.

Because of this, in this ceiling-mounted air conditioning unit, it becomes easier for the degree of superheat of the refrigerant exiting from the refrigerant outlet during cooling of the indoor heat exchanger to become larger, and the heat exchange efficiency of the indoor heat exchanger during cooling can be further improved.

A ceiling-mounted air conditioning unit pertaining to a fourteenth aspect of the invention is the ceiling-mounted air conditioning unit pertaining to the first or second aspect of the invention, wherein the refrigerant that has passed through second row-side liquid refrigerant tubes that are some of the plural liquid refrigerant tubes during cooling is sent to second row-side heat transfer tubes that are one of the heat transfer tubes in the first row. The refrigerant that has been sent to the second row-side heat transfer tubes passes through the second row-side heat transfer tubes and, in the outlets of the second row-side heat transfer tubes, is thereafter caused by in-second-row branching portions to branch into two of the heat transfer tubes in the second row. The refrigerant that has been sent to the two of the heat transfer tubes in the second row passes through the two of the heat transfer tubes in the second row and is thereafter sent from the outlets of the two of the heat transfer tubes in the second row to the second row-side gas refrigerant tubes. The refrigerant that has passed through third row-side liquid refrigerant tubes that are the rest of the plural liquid refrigerant tubes during cooling is sent to third row-side heat transfer tubes that are the heat transfer tubes in the first row apart from the second row-side heat transfer tubes. The refrigerant that has been sent to the third row-side heat transfer tubes passes through the third row-side heat transfer tubes and, in the outlets of the third row-side heat transfer tubes, is thereafter caused by in-third-row branching portions to branch into two of the heat transfer tubes in the third row. The refrigerant that has been sent to the two of the heat transfer tubes in the third row passes through the two of the heat transfer tubes in the third row and is thereafter sent from the outlets of the two of the heat transfer tubes in the third row to the third row-side gas refrigerant tubes.

In this ceiling-mounted air conditioning unit, during cooling, some of the refrigerant is sent through the second row-side liquid refrigerant tubes to the second row-side heat transfer tubes, and the refrigerant that has become gas-rich because of heat exchange with the air in the second row-side heat transfer tubes is caused to branch into and is sent through the two heat transfer tubes in the second row, while the rest of the refrigerant is sent through the third row-side liquid refrigerant tubes to the third row-side heat transfer tubes, and the refrigerant that has become gas-rich because of heat exchange with the air in the third row-side heat transfer tubes is caused to branch into and is sent through the two heat transfer tubes in the third row, so an increase in the flow speed of the refrigerant that has become gas-rich can be suppressed. Further, in this ceiling-mounted air conditioning unit, during heating, the refrigerant that has become liquid-rich because of heat exchange with the air in the two heat transfer tubes in the second row and the refrigerant that has become liquid-rich because of heat exchange with the air in the two heat transfer tubes in the third row are caused to merge together and become sent to the second row-side heat transfer tubes and the third row-side heat transfer tubes, so the flow speed of the refrigerant that has become liquid-rich can be increased to increase the heat transfer coefficient in the second row-side heat transfer tubes and the third row-side heat transfer tubes. Moreover, in this ceiling-mounted air conditioning unit, during cooling, the refrigerant is caused to branch into the second row-side liquid refrigerant tubes and the third row-side liquid refrigerant tubes at the stage of the liquid refrigerant tubes before being passed through the heat transfer tubes in the first row. Moreover, in this ceiling-mounted air conditioning unit, the refrigerant flows in such a way that, after heading from the one lengthwise direction end of the indoor heat exchanger to the other end, it is caused to branch or merges together in the in-row branching portions at the other lengthwise direction end of the indoor heat exchanger and turns back from the other lengthwise direction end of the indoor heat exchanger to the one end. For this reason, the paths on which the refrigerant flows become short paths where the refrigerant makes one round trip in the lengthwise direction through the indoor heat exchanger.

Because of this, in this ceiling-mounted air conditioning unit, an increase in pressure drop can be suppressed as a result of the in-second-row branching portions and the in-third-row branching portions causing the flows of the refrigerant to branch, so the heat exchange efficiency of the indoor heat exchanger during cooling can be further improved. In particular, in this ceiling-mounted air conditioning unit, an increase in the flow speed of the refrigerant in the heat transfer tubes in the second row and the heat transfer tubes in the third row through which flows the gas-rich refrigerant whose effect with respect to pressure drop is large is suppressed, so the heat exchange efficiency of the indoor heat exchanger during cooling can be effectively improved. Further, in this ceiling-mounted air conditioning unit, the heat transfer coefficient is increased by increasing the flow speed of the refrigerant in the second row-side heat transfer tubes and the third row-side heat transfer tubes through which flows the liquid-rich refrigerant whose effect with respect to pressure drop is small, so it becomes easier for the degree of subcooling in the refrigerant outlet during heating of the indoor heat exchanger to become larger, and a drop in the heat exchange efficiency during heating can be further suppressed. Moreover, in this ceiling-mounted air conditioning unit, branching portions for causing the refrigerant to branch into the heat transfer tubes in the second row and the heat transfer tubes in the third row become unnecessary. Moreover, in this ceiling-mounted air conditioning unit, the paths on which the refrigerant flows become short paths where the refrigerant makes one round trip in the lengthwise direction through the indoor heat exchanger, and an increase in pressure drop can be suppressed, so the heat exchange efficiency of the indoor heat exchanger during cooling can be further improved, and a drop in the heat exchange efficiency of the indoor heat exchanger during heating can be further suppressed.

A ceiling-mounted air conditioning unit pertaining to a fifteenth aspect of the invention is the ceiling-mounted air conditioning unit pertaining to the fourteenth aspect of the invention, wherein the third row-side liquid refrigerant tubes have a tube inner diameter that is smaller than, or a tube length that is longer than, that of the second row-side liquid refrigerant tubes adjacent thereto on upper sides or lower sides.

In this ceiling-mounted air conditioning unit, during cooling, it becomes easier for more of the refrigerant to flow into the second row-side liquid refrigerant tubes whose flow path resistance is small, so more of the refrigerant flows into the heat transfer tubes in the second row than the heat transfer tubes in the third row.

Because of this, in this ceiling-mounted air conditioning unit, it becomes easier for the degree of superheat of the refrigerant exiting from the refrigerant outlet during cooling of the indoor heat exchanger to become larger, and the heat exchange efficiency of the indoor heat exchanger during cooling can be further improved.

DESCRIPTION OF EMBODIMENTS

Embodiments of a ceiling-mounted air conditioning unit pertaining to the present invention will be described below on the basis of the drawings.

<Basic Configuration>

Figure 1:
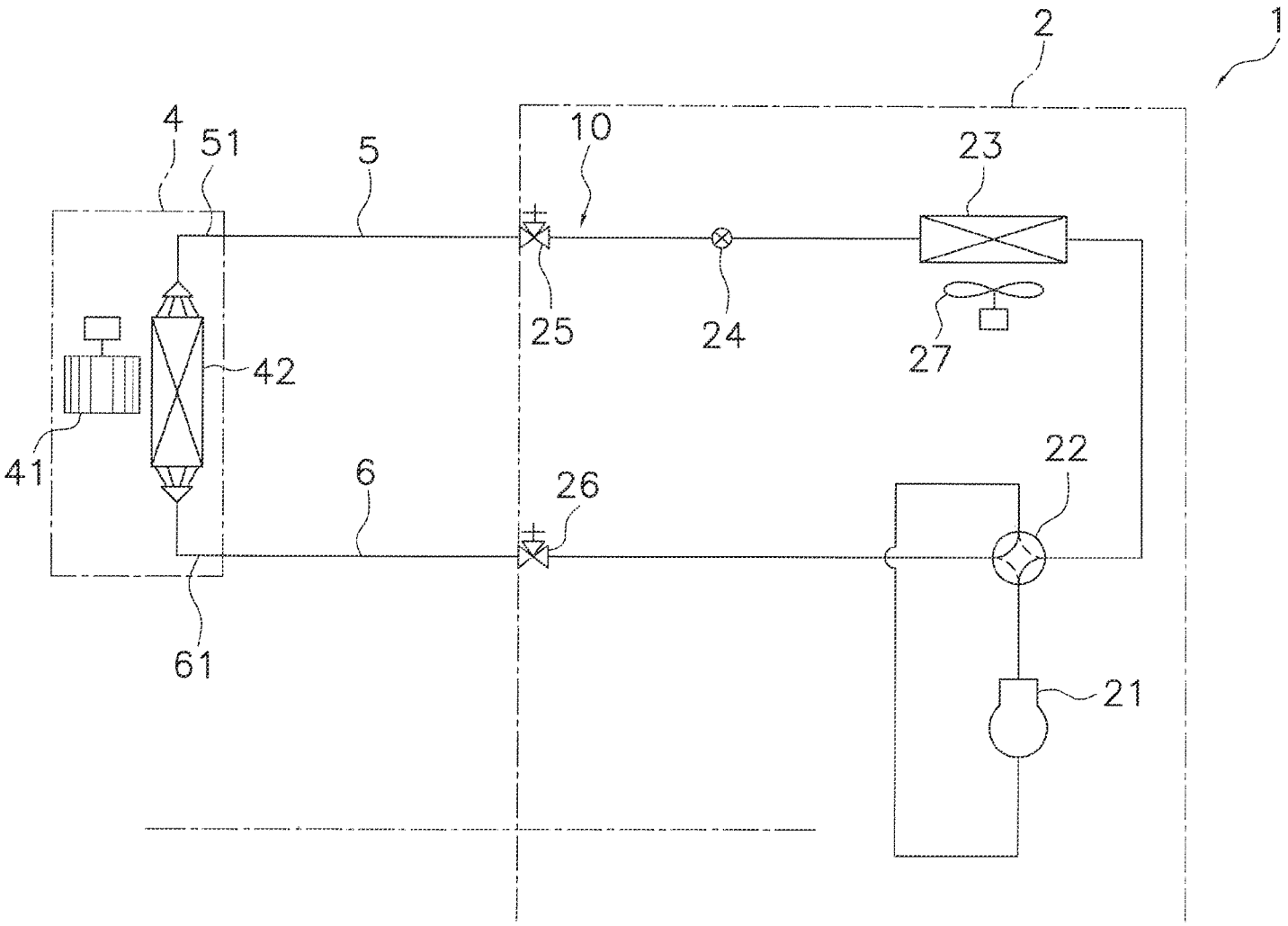
FIG. 1 is a schematic configuration diagram of an air conditioning apparatus in which an indoor unit serving as a ceiling-mounted air conditioning unit pertaining to embodiments of the present invention is employed.

FIG. 1 is a schematic configuration diagram of an air conditioning apparatus 1 in which an indoor unit 4 serving as a ceiling-mounted air conditioning unit pertaining to the embodiments of the present invention is employed. The air conditioning apparatus 1 is a split type air conditioning apparatus, mainly has an outdoor unit 2, the indoor unit 4, and a liquid refrigerant connection tube 5 and a gas refrigerant connection tube 6 that interconnect the outdoor unit 2 and the indoor unit 4, and configures a vapor compression refrigerant circuit 10.

The outdoor unit 2 is installed outdoors or the like and mainly has a compressor 21, a four-way switching valve 22, an outdoor heat exchanger 23, an expansion valve 24, a liquid-side stop valve 25, and a gas-side stop valve 26.

The compressor 21 is a compressor for sucking in low-pressure gas refrigerant, compressing the low-pressure gas refrigerant into high-pressure gas refrigerant, and thereafter discharging the high-pressure gas refrigerant.

The four-way switching valve 22 is a valve for switching the direction of the flow of the refrigerant when switching between cooling and heating. During cooling, the four-way switching valve 22 is capable of interconnecting the discharge side of the compressor 21 and the gas side of the outdoor heat exchanger 23 and also interconnecting the gas-side stop valve 26 and the suction side of the compressor 21 (refer to the solid lines of the four-way switching valve 22 in FIG. 1). Further, during heating, the four-way switching valve 22 is capable of interconnecting the discharge side of the compressor 21 and the gas-side stop valve 26 and also interconnecting the gas side of the outdoor heat exchanger 23 and the suction side of the compressor 21 (refer to the broken lines of the four-way switching valve 22 in FIG. 1).

The outdoor heat exchanger 23 is a heat exchanger that functions as a condenser of the refrigerant during cooling and functions as an evaporator of the refrigerant during heating. The liquid side of the outdoor heat exchanger 23 is connected to the expansion valve 24, and the gas side of the outdoor heat exchanger 23 is connected to the four-way switching valve 22.

The expansion valve 24 is an electrical expansion valve which, during cooling, is capable of reducing the pressure of the high-pressure liquid refrigerant that has been condensed in the outdoor heat exchanger 23 before sending it to an indoor heat exchanger 42 (described later) and which, during heating, is capable of reducing the pressure of the high-pressure liquid refrigerant that has been condensed in the indoor heat exchanger 42 before sending it to the outdoor heat exchanger 23.

The liquid-side stop valve 25 and the gas-side stop valve 26 are valves disposed in openings that connect to external devices and pipes (specifically, the liquid refrigerant connection tube 5 and the gas refrigerant connection tube 6).

The liquid-side stop valve 25 is connected to the expansion valve 24. The gas-side stop valve 26 is connected to the four-way switching valve 22.

Further, an outdoor fan 27 for sucking outdoor air into the inside of the unit, supplying the outdoor air to the outdoor heat exchanger 23, and thereafter discharging the outdoor air to the outside of the unit is disposed in the outdoor unit 2. That is, the outdoor heat exchanger 23 is a heat exchanger that uses the outdoor air as a cooling source or a heating source to condense and evaporate the refrigerant.

Figure 2:
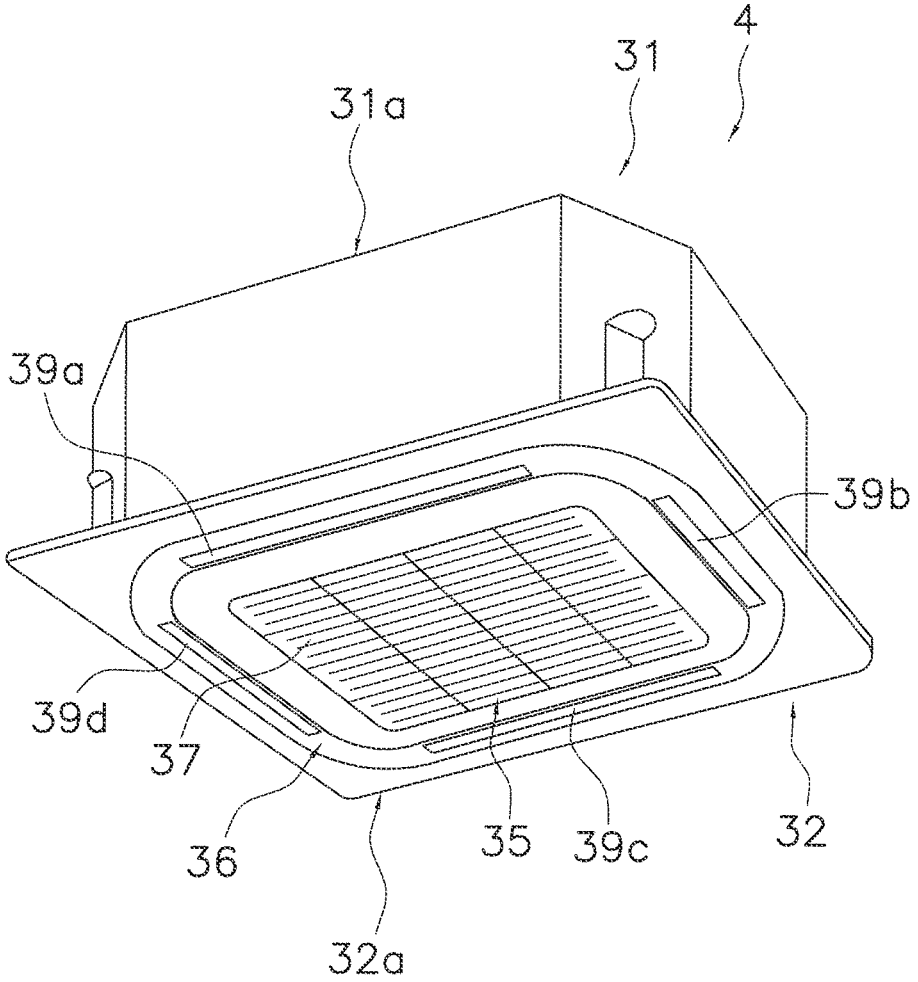
FIG. 2 is an external perspective view of the indoor unit serving as the ceiling-mounted air conditioning unit pertaining to the embodiments of the present invention.
Figure 3:
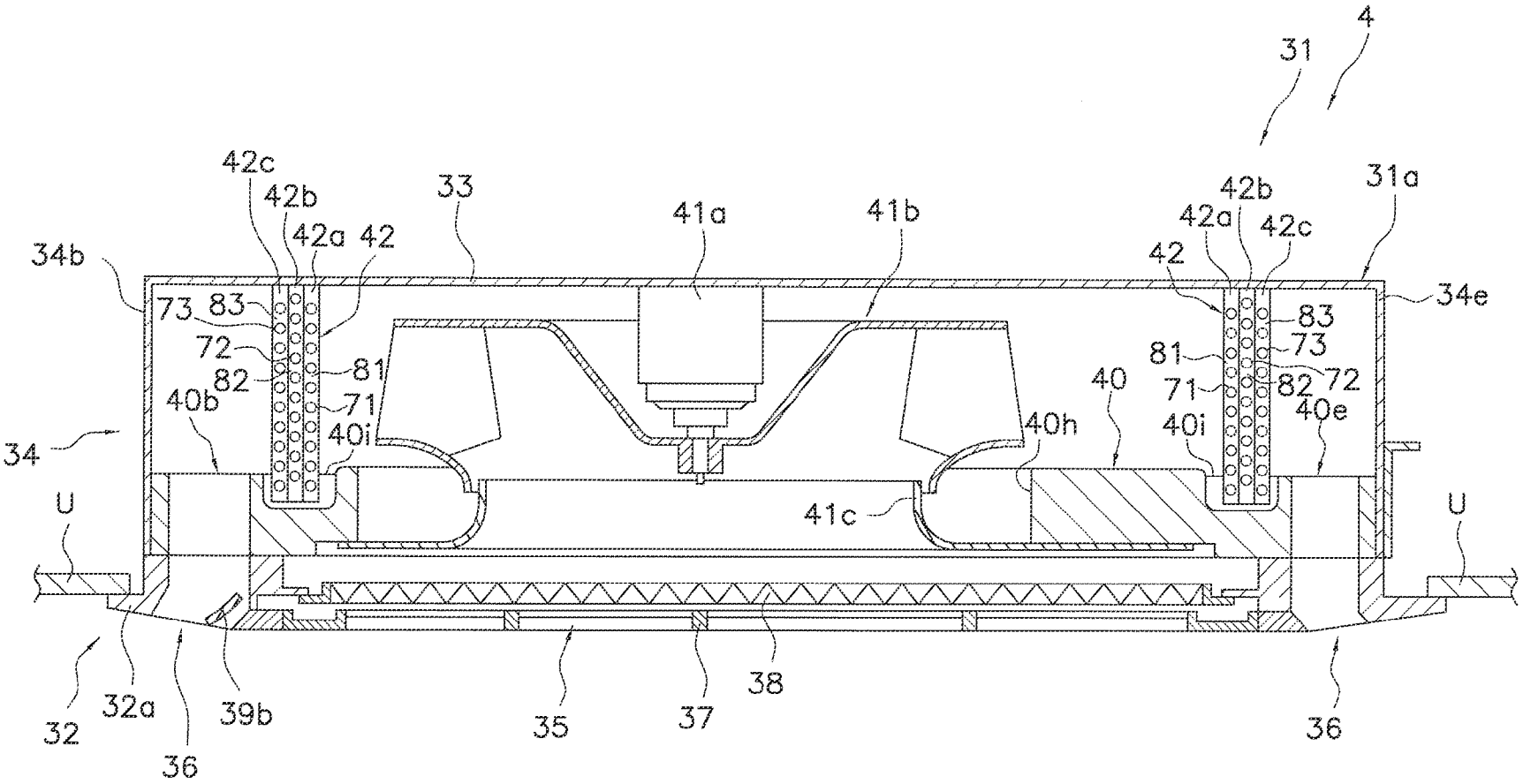
FIG. 3 is a schematic side sectional view of the indoor unit serving as the ceiling-mounted air conditioning unit pertaining to the embodiments of the present invention and is a sectional view taken along A-O-A in FIG. 4.

In the present embodiment, the indoor unit 4 is a form of ceiling-mounted air conditioning unit called a ceiling-embedded type and has a casing 31 that stores various types of components inside. The casing 31 is configured from a casing body 31*a* and a decorative panel 32 that is placed on the underside of the casing body 31*a*. As shown in FIG. 3, the casing body 31*a* is inserted and placed in an opening formed in a ceiling U of an air-conditioned room. Additionally, the decorative panel 32 is placed in such a way as to be fitted into the opening in the ceiling U. Here, FIG. 2 is an external perspective view of the indoor unit 4 serving as the ceiling-mounted air conditioning unit pertaining to the embodiments of the present invention. FIG. 3 is a schematic side sectional view of the indoor unit 4 serving as the ceiling-mounted air conditioning unit pertaining to the embodiments of the present invention and is a sectional view taken along A-O-A in FIG. 4.

Figure 4:
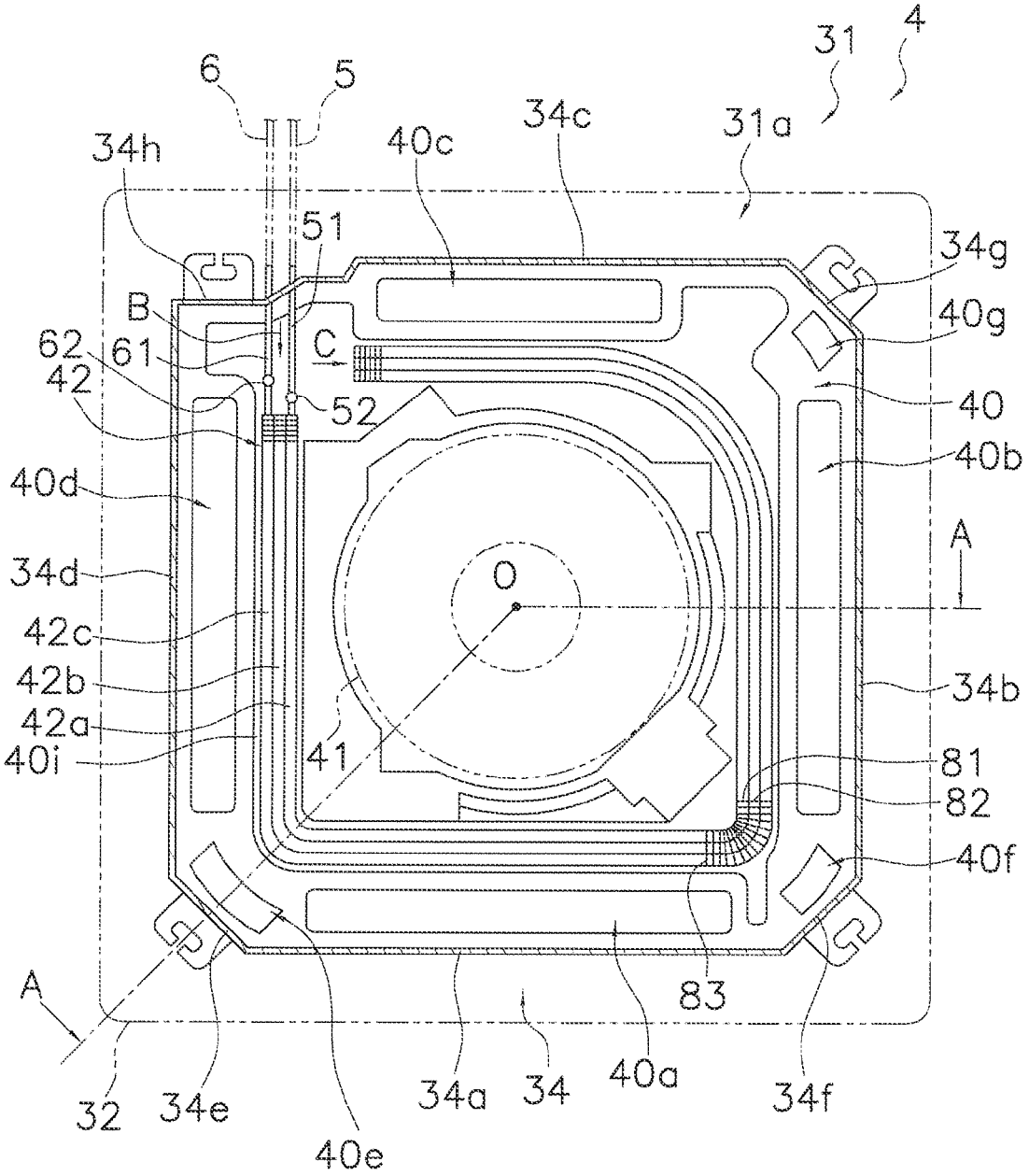
FIG. 4 is a schematic plan view showing a state where a top plate of the indoor unit serving as the ceiling-mounted air conditioning unit pertaining to the embodiments of the present invention has been removed.

As shown in FIG. 3 and FIG. 4, the casing body 31*a* is a box-like body whose undersurface is open and which has a substantially octagonal shape where long sides and short sides are alternately formed as seen in a plan view thereof. The casing body 31*a* has a top plate 33 that has a substantially octagonal shape where long sides and short sides are alternately continuously formed and a side plate 34 that extends downward from the peripheral edge portion of the top plate 33. Here, FIG. 4 is a schematic plan view showing a state where the top plate 33 of the indoor unit 4 serving as the ceiling-mounted air conditioning unit pertaining to the embodiments of the present invention has been removed. The side plate 34 is configured from side plates 34*a*, 34*h*, 34*c*, and 34*d* that correspond to the long sides of the top plate 33 and side plates 34*e*, 34*f*, 34*g*, and 34*h* that correspond to the short sides of the top plate 33. The side plate 34*h* configures a portion penetrated by a liquid-side connecting tube 51 and a gas-side connecting tube 61 for interconnecting the indoor heat exchanger 42 and the refrigerant connection tubes 5 and 6.

As shown in FIG. 2, FIG. 3, and FIG. 4, the decorative panel 32 is a plate-like body that has a substantially quadrilateral shape as seen in a plan view. The decorative panel 32 is mainly configured from a panel body 32*a* that is fixed to the lower end portion of the casing body 31*a*. The panel body 32*a* has a suction opening 35 that is disposed in the substantial center of the panel body 32*a* and sucks in the air inside the air-conditioned room and a blow-out opening 36 that is formed in such a way as to surround the periphery of the suction opening 35 as seen in a plan view and blows out the air into the air-conditioned room. The suction opening 35 is an opening that has a substantially quadrilateral shape. A suction grille 37 and a filter 38 for removing dirt and dust in the air that has been sucked in from the suction opening 35 are disposed in the suction opening 35. The blow-out opening 36 is an opening that has a substantially four-sided annular shape. Horizontal flaps 39*a*, 39*b*, 39*c*, and 39*d* that adjust the direction of the air blown out into the air-conditioned room are disposed in the blow-out opening 36 in such a way as to correspond to the sides of the quadrilateral shape of the panel body 32*a*.

Inside the casing body 31*a*, there are mainly placed: an indoor fan 41 serving as a centrifugal blower that sucks the air inside the air-conditioned room through the suction opening 35 in the decorative panel 32 into the inside of the casing body 31*a* and blows out the air through the blow-out opening 36 in the decorative panel 32 from the inside of the casing body 31*a*; and an indoor heat exchanger 42.

The indoor fan 41 has a fan motor 41*a* that is disposed in the center of the top plate 33 of the casing body 31*a* and an impeller 41*b* that is coupled to and driven to rotate by the fan motor 41*a*. The impeller 41*b* is an impeller with turbo blades and can suck air into the inside of the impeller 41*b* from below and blow out the air toward the outer peripheral side of the impeller 41*b* as seen in a plan view.

The indoor heat exchanger 42 is a fin-and-tube heat exchanger placed on the outer peripheral side of the indoor fan 41 as seen in a plan view. More specifically, the indoor heat exchanger 42 is bent and placed in such a way as to surround the periphery of the indoor fan 41 and is a fin-and-tube heat exchanger called a cross-fin type that has numerous heat transfer fins placed a predetermined interval apart from each other and plural heat transfer tubes disposed in a state where they penetrate these heat transfer fins in their plate thickness direction. As described above, the liquid side of the indoor heat exchanger 42 is connected to the liquid refrigerant connection tube 5 via the liquid-side connecting tube 51, and the gas side of the indoor heat exchanger 42 is connected to the gas refrigerant connection tube 6 via the gas-side connecting tube 61. Additionally, the indoor heat exchanger 42 functions as an evaporator of the refrigerant during cooling and as a condenser of the refrigerant during heating. Because of this, the indoor heat exchanger 42 can perform heat exchange with the air that has been blown out from the indoor fan 41, cool the air during cooling, and heat the air during heating. Structures and characteristics of the indoor heat exchanger 42 will be described in detail in the sections "<Indoor Heat Exchanger Pertaining to First Embodiment>", "<Indoor Heat Exchanger Pertaining to Second Embodiment>", and "<Indoor Heat Exchanger Pertaining to Third Embodiment>".

Further, a drain pan 40 for receiving drain water produced as a result of moisture in the air being condensed in the indoor heat exchanger 42 is placed on the underside of the indoor heat exchanger 42. The drain pan 40 is attached to the lower portion of the casing body 31*a*. Blow-out holes 40*a*, 40*b*, 40*c*, 40*d*, 40*e*, 40*f*, and 40*g*, a suction hole 40*h*, and a drain water receiving groove 40*i* are formed in the drain pan 40. The blow-out holes 40*a*, 40*b*, 40*c*, 40*d*, 40*e*, 40*f*, and 40*g* are formed in such a way as to be communicated with the blow-out opening 36 in the decorative panel 32. The suction hole 40*h* is formed in such a way as to be communicated with the suction opening 35 in the decorative panel 32. The drain water receiving groove 40*i* is formed on the underside of the indoor heat exchanger 42. Further, a bellmouth 41*c* for guiding the air sucked in from the suction opening 35 to the impeller 41*b* of the indoor fan 41 is placed in the suction hole 40*h* in the drain pan 40.

<Basic Actions>

Next, the actions of the air conditioning apparatus 1 during a cooling operation and a heating operation will be described.

In the refrigerant circuit 10 during cooling, the four-way switching valve 22 is in the state indicated by the solid lines in FIG. 1. Further, the liquid-side stop valve 25 and the gas-side stop valve 26 are placed in an open state, and the opening degree of the expansion valve 24 is adjusted in such a way that the expansion valve 24 reduces the pressure of the refrigerant.

In this state of the refrigerant circuit 10, low-pressure gas refrigerant is sucked into the compressor 21 and is compressed and becomes high-pressure gas refrigerant in the compressor 21, and the high-pressure gas refrigerant is discharged from the compressor 21. This high-pressure gas refrigerant is sent through the four-way switching valve 22 to the outdoor heat exchanger 23 and performs heat exchange with the outdoor air, condenses, and becomes high-pressure liquid refrigerant in the outdoor heat exchanger 23. This high-pressure liquid refrigerant is sent to the expansion valve 24 and has its pressure reduced and becomes low-pressure refrigerant in a gas-liquid two-phase state in the expansion valve 24. This low-pressure refrigerant in a gas-liquid two-phase state is sent through the liquid-side stop valve 25, the liquid refrigerant connection tube 5, and the liquid-side connecting tube 51 to the indoor heat exchanger 42 and performs heat exchange with the air blown out from the indoor fan 41, evaporates, and becomes low-pressure gas refrigerant in the indoor heat exchanger 42. This low-pressure gas refrigerant is sent through the gas-side connecting tube 61, the gas refrigerant connection tube 6, the gas-side stop valve 26, and the four-way switching valve 22 back to the compressor 21.

Next, in the refrigerant circuit 10 during heating, the four-way switching valve 22 is in the state indicated by the broken lines in FIG. 1. Further, the liquid-side stop valve 25 and the gas-side stop valve 26 are placed in an open state, and the opening degree of the expansion valve 24 is adjusted in such a way that the expansion valve 24 reduces the pressure of the refrigerant.

In this state of the refrigerant circuit 10, low-pressure gas refrigerant is sucked into the compressor 21 and is compressed and becomes high-pressure gas refrigerant in the compressor 21, and the high-pressure gas refrigerant is discharged from the compressor 21. This high-pressure gas refrigerant is sent through the four-way switching valve 22, the gas-side stop valve 26, the gas refrigerant connection tube 6, and the gas-side connecting tube 61 to the indoor heat exchanger 42 and performs beat exchange with the air blown out from the indoor fan 41, condenses, and becomes high-pressure liquid refrigerant in the indoor heat exchanger 42. This high-pressure liquid refrigerant is sent through the liquid-side connecting tube 51, the liquid refrigerant connection tube 5, and the liquid-side stop valve 25 to the expansion valve 24 and has its pressure reduced and becomes low-pressure refrigerant in a gas-liquid two-phase state in the expansion valve 24. This low-pressure refrigerant in a gas-liquid two-phase state is sent to the outdoor heat exchanger 23 and performs heat exchange with the outdoor air, evaporates, and becomes low-pressure gas refrigerant in the outdoor heat exchanger 23. This low-pressure gas refrigerant is sent through the four-way switching valve 22 back to the compressor 21.

<Indoor Heat Exchanger Pertaining to First Embodiment>

(1) Structure of Indoor Heat Exchanger

As shown in FIG. 3 and FIG. 4, the indoor heat exchanger 42 pertaining to a first embodiment employs a structure where plural heat transfer tubes 71, 72, and 73 inside of which flows the refrigerant are placed in multiple stages in a vertical direction and, in order to increase performance, are arranged in three rows in the flow direction of the air blown out from the indoor fan 41 serving as the centrifugal blower.

Figure 5:
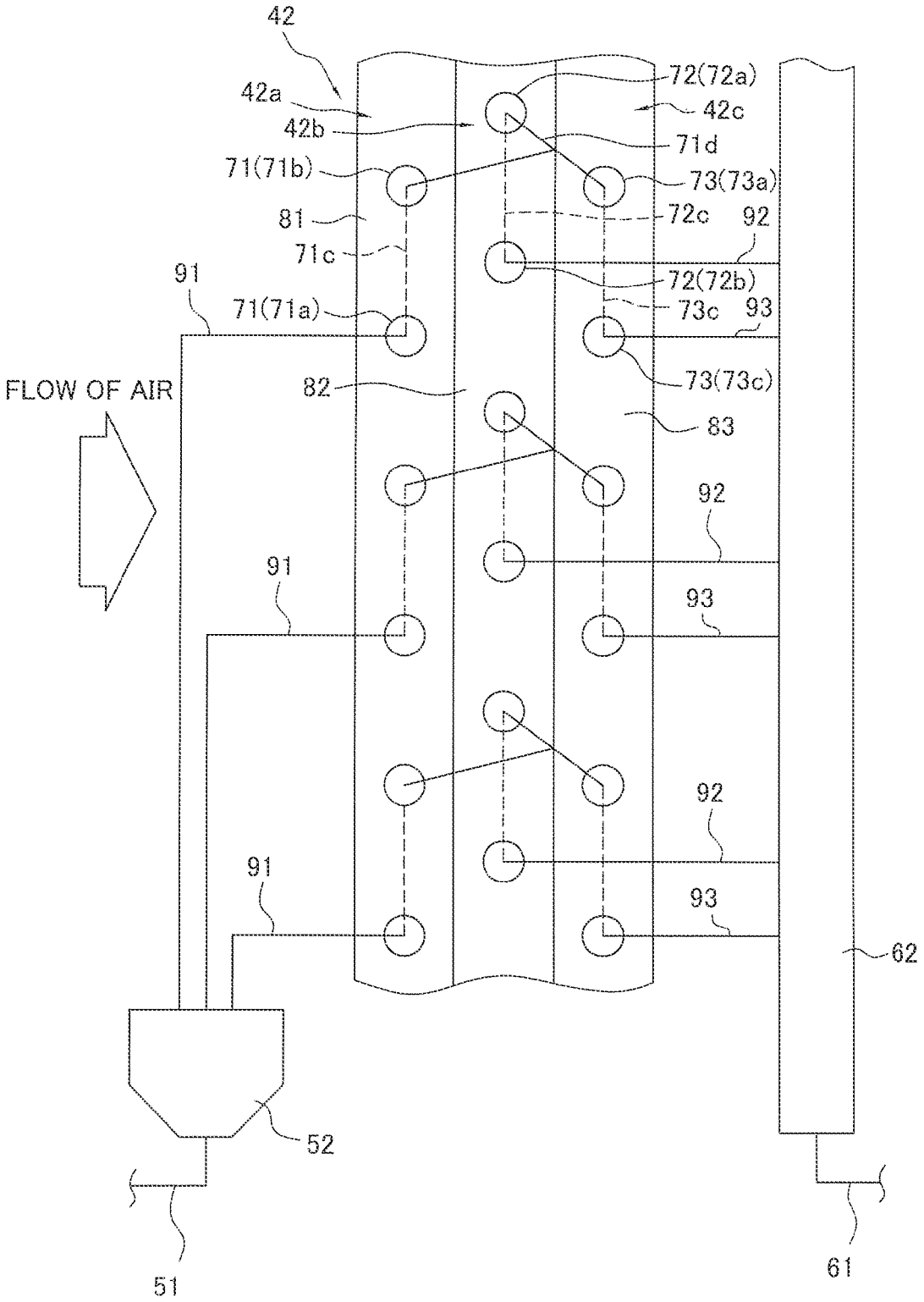
FIG. 5 is a view showing refrigerant paths in an indoor heat exchanger in the indoor unit serving as the ceiling-mounted air conditioning unit pertaining to a first embodiment.

More specifically, as shown in FIG. 3 to FIG. 5, the indoor heat exchanger 42 mainly has a first heat exchange section 42*a*, a second heat exchange section 42*b*, and a third heat exchange section 42*c*. Here, FIG. 5 is a view showing refrigerant paths in the indoor heat exchanger 42 in the indoor unit 4 serving as the ceiling-mounted air conditioning unit pertaining to the first embodiment. In FIG. 5, a state where one lengthwise direction end side of the indoor heat exchanger 42 is seen from the direction of arrow B is indicated by the solid lines and, for the convenience of illustration, a state where the other lengthwise direction end side of the indoor heat exchanger 42 is seen from the direction of arrow C is illustrated by broken lines superimposed on the one end side of the indoor heat exchanger 42.

The first heat exchange section 42*a* configures a row on the most upwind side (hereinafter called a first row) of the indoor heat exchanger 42 in the flow direction of the air. The first heat exchange section 42*a* has numerous first heat transfer fins 81 placed a predetermined interval apart from each other and plural (here, ten) first heat transfer tubes 71 disposed in a state where they penetrate these first heat transfer fins 81 in their plate thickness direction. The first heat transfer fins 81 are plate-like members that are long and narrow in the vertical direction. The first heat transfer tubes 71 are tube members extending in the lengthwise direction of the indoor heat exchanger 42 and are placed in ten stages in the vertical direction.

The second heat exchange section 42*b* configures a second row of the indoor heat exchanger 42 in the flow direction of the air. The second heat exchange section 42*b* has numerous second heat transfer fins 82 placed a predetermined interval apart from each other and plural (here, ten) second heat transfer tubes 72 disposed in a state where they penetrate these second heat transfer tins 82 in their plate thickness direction. The second heat transfer fins 82 are plate-like members that are long and narrow in the vertical direction. The second heat transfer tubes 72 are tube members extending in the lengthwise direction of the indoor heat exchanger 42 and are placed in ten stages in the vertical direction.

The third heat exchange section 42*c* configures a row on the most downwind side (hereinafter called a third row) of the indoor heat exchanger 42 in the flow direction of the air. The third heat exchange section 42*c* has numerous third heat transfer fins 83 placed a predetermined interval apart from each other and plural (here, ten) third heat transfer tubes 73 disposed in a state where they penetrate these third heat transfer fins 83 in their plate thickness direction. The third heat transfer fins 83 are plate-like members that are long and narrow in the vertical direction. The third heat transfer tubes 73 are tube members extending in the lengthwise direction of the indoor heat exchanger 42 and are placed in ten stages in the vertical direction.

The indoor heat exchanger 42 is configured by stacking together these heat exchange sections 42*a*, 42*b*, and 42*c* in the flow direction of the air and bending them in such a way as to surround the periphery of the indoor fan 41 as seen in a plan view. Here, the heat transfer tubes 71, 72, and 73 are staggered with respect to the heat transfer fins 81, 82, and 83 overall.

A flow divider 52 that becomes a refrigerant inlet of the indoor heat exchanger 42 in a case where the indoor heat exchanger 42 functions as an evaporator of the refrigerant during cooling and becomes a refrigerant outlet of the indoor heat exchanger 42 in a case where the indoor heat exchanger 42 functions as a condenser of the refrigerant during heating is connected to the liquid-side connecting tube 51. Plural (in FIG. 5, only three are illustrated) liquid refrigerant tubes 91 connected to the first heat transfer tubes 71 of the indoor heat exchanger 42 on the one lengthwise direction end side of the indoor heat exchanger 42 are connected to the flow divider 52. Here, the liquid refrigerant tubes 91 comprise capillary tubes.

A header 62 that becomes a refrigerant outlet of the indoor heat exchanger 42 in a case where the indoor heat exchanger 42 functions as an evaporator of the refrigerant during cooling and becomes a refrigerant inlet of the indoor heat exchanger 42 in a case where the indoor heat exchanger 42 functions as a condenser of the refrigerant during heating is connected to the gas-side connecting tube 61. Plural (in FIG. 5, only three are illustrated) second row-side gas refrigerant tubes 92 connected to the second heat transfer tubes 72 of the indoor heat exchanger 42 on the one lengthwise direction end side of the indoor heat exchanger 42 and plural (in FIG. 5, only three are illustrated) third row-side gas refrigerant tubes 93 connected to the heat transfer tubes 73 in the third row of the indoor heat exchanger 42 on the one lengthwise direction end side of the indoor heat exchanger 42 are connected to the header 62.

Figure 6:
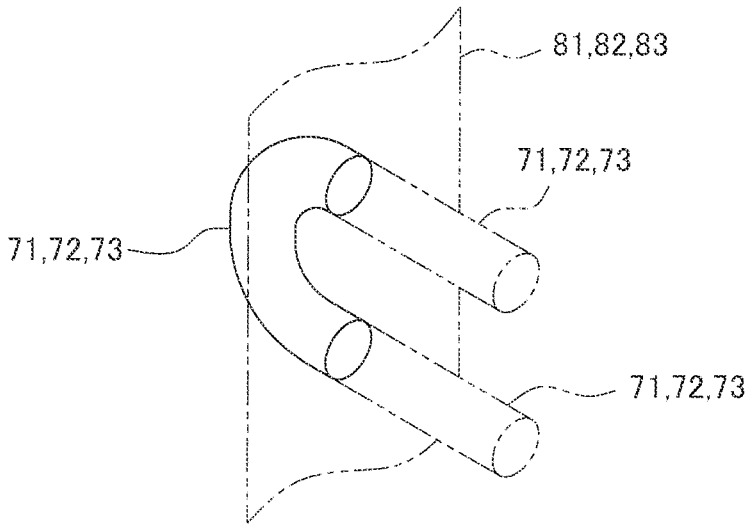
FIG. 6 is a view showing the shape of a U-shaped portion.
Figure 7:
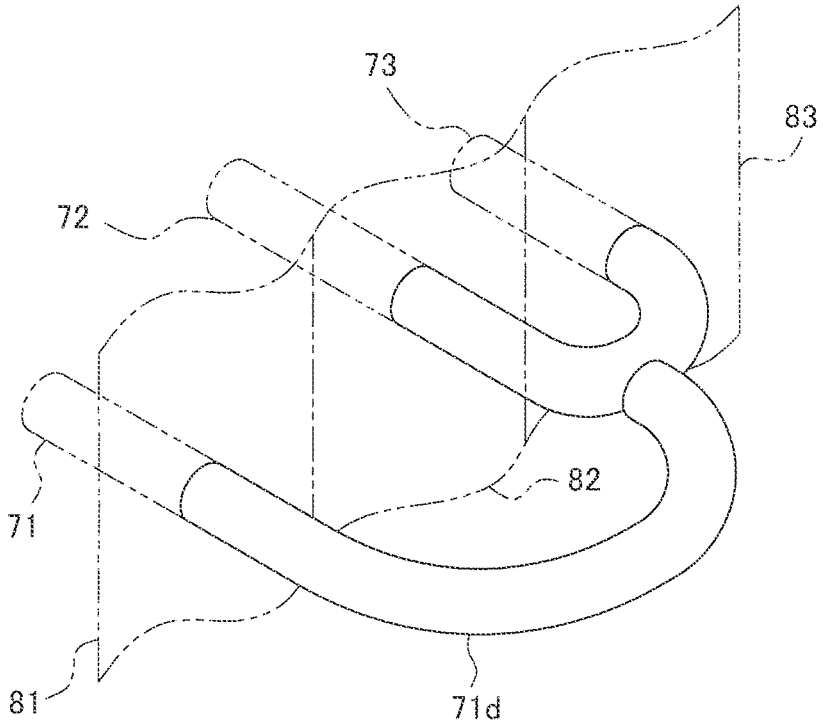
FIG. 7 is a view showing the shape of an inter-row branching portion in the first embodiment and modification 4 thereof.

The indoor heat exchanger 42 has plural stages (in FIG. 5, only three are illustrated) of refrigerant paths that are configured as a result of the heat transfer tubes 71, 72, and 73 in two stages each in three rows being interconnected. Each of the refrigerant paths has first heat transfer tubes 71*a* which, of the first heat transfer tubes 71, are connected to the liquid refrigerant tubes 91. The first heat transfer tubes 71*a* are connected via U-shaped portions 71*c* to first heat transfer tubes 71*b* that are the first heat transfer tubes 71 placed one stage on the upper sides of the first heat transfer tubes 71*a* on the other lengthwise direction end side of the indoor heat exchanger 42. As shown in FIG. 6, each of the U-shaped portions 71*c* is a U-shaped tube portion joining together the heat transfer tubes placed in the same row (here, the first heat transfer tubes 71). The first heat transfer tubes 71*b* are connected to inter-row branching portions 71*d* on the one lengthwise direction end side of the indoor heat exchanger 42. The inter-row branching portions 71*d* are portions that cause the refrigerant that has passed through the first heat transfer tubes 71*b* during cooling to branch into two flows. One of the branches of each of the inter-row branching portions 71*d* is connected, on the one lengthwise direction end side of the indoor heat exchanger 42, to second heat transfer tubes 72*a* which, of the second heat transfer tubes 72, are the second heat transfer tubes 72 placed on the upper sides of the first heat transfer tubes 71*b*. The other of the branches of each of the inter-row branching portions 71*d* is connected, on the one lengthwise direction end side of the indoor heat exchanger 42, to third heat transfer tubes 73*a* which, of the third heat transfer tubes 73, are the third heat transfer tubes 73 placed on the lower sides of the second heat transfer tubes 72*a*. As shown in FIG. 7, each of the inter-row branching portions 71*d* is a tube portion having a shape where the end portion of a U-shaped tube portion extending from the first heat transfer tube 71 is joined together with the middle portion of a U-shaped tube portion joining together the second heat transfer tube 72 and the third heat transfer tube 73. Here, the position at which the U-shaped tube portion extending from the first heat transfer tube 71 and the U-shaped tube portion joining together the second heat transfer tube 72 and the third heat transfer tube 73 are interconnected is set in such a way that the flow path length from the second heat transfer tube 72 and the flow path length from the third heat transfer tube 73 become the same. The second heat transfer tubes 72*a* are connected, on the other lengthwise direction end side of the indoor heat exchanger 42, via U-shaped portions 72*c* (see FIG. 6) to second heat transfer tubes 72*b* that are the second heat transfer tubes 72 placed one stage on the lower sides of the second heat transfer tubes 72*a*. The third heat transfer tubes 73*a* are connected, on the other lengthwise direction end side of the indoor heat exchanger 42, via U-shaped portions 73*c* (see FIG. 6) to third heat transfer tubes 73*b* that are the third heat transfer tubes 73 placed one stage on the lower sides of the third heat transfer tube 73*a*. The second heat transfer tubes 72*b* are connected to the second row-side gas refrigerant tubes 92 on the one lengthwise direction end side of the indoor heat exchanger 42. The third heat transfer tubes 73*b* are connected to the third row-side gas refrigerant tubes 93 on the one lengthwise direction end side of the indoor heat exchanger 42. Here, the heat transfer tubes 71*a* and 71*b* are configured as single heat transfer tubes bent in the shape of hairpins including the U-shaped portions 71*c*. Further, the heat transfer tubes 72*a* and 72*b* are configured as single heat transfer tubes bent in the shape of hairpins including the U-shaped portions 72*c*. Moreover, the heat transfer tubes 73*a* and 73*b* are configured as single heat transfer tubes bent in the shape of hairpins including the U-shaped portions 73*c*.

Because of this, in the indoor heat exchanger 42 of the present embodiment, in a case where the indoor heat exchanger 42 functions as an evaporator of the refrigerant during cooling, the refrigerant that has traveled through the liquid-side connecting tube 51 and the flow divider 52 serving as the refrigerant inlet during cooling and has passed through the liquid refrigerant tubes 91 is sent to the first heat transfer tubes 71*a* (first upstream-side heat transfer tubes) that are one of the first heat transfer tubes 71 in the first row. The refrigerant that has been sent to the first heat transfer tubes 71*a* passes through the first heat transfer tubes 71*a* and thereafter further passes through the first heat transfer tubes 71*b* (first downstream-side heat transfer tubes) that are the first heat transfer tubes 71 in the first row apart from the first heat transfer tubes 71*a*. At the outlets of the first heat transfer tubes 71*b*, the refrigerant that has passed through the first heat transfer tubes 71*b* is caused by the inter-row branching portions 71*d* to branch into the second heat transfer tubes 72*a* (second upstream-side heat transfer tubes) that is one of the heat transfer tubes 72 in the second row and the third heat transfer tubes 73*a* (third upstream-side heat transfer tubes) that is one of the third heat transfer tubes 73 in the third row. Then, the refrigerant that has been sent to the second heat transfer tubes 72*a* passes through the second heat transfer tubes 72*a*, thereafter further passes through the second heat transfer tubes 72*b* (second downstream-side heat transfer tubes) that are the second heat transfer tubes 72 in the second row apart from the second heat transfer tubes 72*a*, and is sent from the outlets of the second heat transfer tubes 72*h* to the second row-side gas refrigerant tubes 92. Further, the refrigerant that has been sent to the third heat transfer tubes 73*a* passes through the third heat transfer tubes 73*a*, thereafter further passes through the third heat transfer tubes 73*h* (third downstream-side heat transfer tubes) that are the third heat transfer tithes 73 in the third row apart from the third heat transfer tubes 73*a*, and is sent from the outlets of the third heat transfer tubes 73*b* to the third row-side gas refrigerant tubes 93. The refrigerant that has passed through the second row-side gas refrigerant tubes 92 and the third row-side gas refrigerant tubes 93 is sent to the header 62 and the gas-side connecting tube 61 serving as the refrigerant outlet during cooling.

Further, in the indoor heat exchanger 42 of the present embodiment, in a case where the indoor heat exchanger 42 functions as a condenser of the refrigerant during heating, the refrigerant that has traveled through the gas-side connecting tube 61 and the header 62 serving as the refrigerant inlet during heating and has passed through the second row-side gas refrigerant tubes 92 and the third row-side gas refrigerant tubes 93 is sent to the second heat transfer tubes 72*h* that are one of the second heat transfer tubes 72 in the second row and the third heat transfer tubes 73*b* that are one of the third heat transfer tubes 73 in the third row. The refrigerant that has been sent to the second heat transfer tubes 72*b* passes through the second heat transfer tubes 72*b* and thereafter further passes through the second heat transfer tubes 72*a* that are the second heat transfer tubes 72 in the second row apart from the second heat transfer tubes 72*b*. The refrigerant that has been sent to the third heat transfer tubes 73*b* passes through the third heat transfer tubes 73*b* and thereafter further passes through the third heat transfer tubes 73*a* that are the third heat transfer tubes 73 in the third row apart from the third heat transfer tubes 73*b*. The refrigerant that has passed through the second heat transfer tubes 72*a* and the refrigerant that has passed through the third heat transfer tubes 73*a* are caused by the inter-row branching portions 71*d* to merge together in the outlets of the second heat transfer tubes 72*a* and the outlets of the third heat transfer tubes 73*a* and are sent to the first heat transfer tubes 71*b* that are one of the first heat transfer tubes 71 in the first row. Then, the refrigerant that has been sent to the first heat transfer tubes 71*b* passes through the first heat transfer tubes 71*b*, thereafter further passes through the first heat transfer tubes 71*a* that are the first heat transfer tubes 71 in the first row apart from the first heat transfer tubes 71*b*, and is sent to the liquid refrigerant tubes 91. The refrigerant that has passed through the liquid refrigerant tubes 91 is sent to the flow divider 52 and the liquid-side connecting tube 51 serving as the refrigerant outlet during heating.

(2) Characteristics of Indoor Unit Having Indoor Heat Exchanger

The indoor unit 4 serving as the ceiling-mounted air conditioning unit having the indoor heat exchanger 42 of the present embodiment has the following characteristics.

(A)

The indoor heat exchanger 42 of the present embodiment has a structure where the plural liquid refrigerant tubes 91 connected to the refrigerant inlet of the indoor heat exchanger 42 in a case where the indoor heat exchanger 42 functions as an evaporator of the refrigerant during cooling are connected to the heat transfer tubes 71 in the first row that is the row on the most upwind side in the flow direction of the air. Further, this indoor heat exchanger 42 has a structure where the second row-side gas refrigerant tubes 92 that are some of the plural gas refrigerant tubes 92 and 93 connected to the refrigerant outlet of the indoor heat exchanger 42 during cooling are connected to the heat transfer tubes 72 in the second row in the flow direction of the air. Moreover, this indoor heat exchanger 42 has a structure where the third row-side gas refrigerant tubes 93 that are the rest of the plural gas refrigerant tubes 92 and 93 are connected to the heat transfer tubes 73 in the third row that is the row on the most downwind side in the flow direction of the air.

For this reason, in the indoor unit 4 of the present embodiment, during cooling, some of the refrigerant inflowing from the refrigerant inlet during cooling of the indoor heat exchanger 42 is sent to the second row-side gas refrigerant tubes 92 immediately after performing heat exchange with the air crossing the heat transfer tubes 72 in the second row whose temperature is higher than that of the air crossing the heat transfer tubes 73 in the third row. Further, in this indoor unit 4, during cooling, the rest of the refrigerant inflowing from the refrigerant inlet during cooling of the indoor heat exchanger 42 is sent to the third row-side gas refrigerant tubes 93 immediately after performing heat exchange with the air crossing the heat transfer tubes 73 in the third row. Additionally, the refrigerant that has passed through the second row-side gas refrigerant tubes 92 and the refrigerant that has passed through the third row-side gas refrigerant tubes 93 merge together and exit from the refrigerant outlet during cooling of the indoor heat exchanger 42. Here, the degree of superheat of the refrigerant immediately after performing heat exchange with the air crossing the heat transfer tubes 72 in the second row easily becomes larger than the degree of superheat of the refrigerant immediately after performing heat exchange with the air crossing the heat transfer tubes 73 in the third row because it is affected by the temperature of the air crossing the heat transfer tubes 72 in the second row.

Because of this, in this indoor unit 4, it becomes easier for the degree of superheat of the refrigerant exiting from the refrigerant outlet during cooling of the indoor heat exchanger 42 to become larger compared to the case of employing a structure where all of the gas refrigerant tubes 92 and 93 are connected to the heat transfer tubes 73 in the third row, and the heat exchange efficiency during cooling can be improved.

Further, in this indoor unit 4, during heating, all the refrigerant inflowing from the refrigerant inlet during heating of the indoor heat exchanger 42 is sent to the liquid refrigerant tubes 91 immediately after performing heat exchange with the air crossing the heat transfer tubes 71 in the first row whose temperature is the lowest.

Because of this, in this indoor unit 4, it becomes difficult for the degree of subcooling in the refrigerant outlet during heating of the indoor heat exchanger 42 to become smaller, and a drop in the heat exchange efficiency during heating can be suppressed.

As described above, in this indoor unit 4, it can be made more difficult for the degree of subcooling in the refrigerant outlet during heating of the indoor heat exchanger 42 to become smaller and it can also be made easier for the degree of superheat of the refrigerant exiting from the refrigerant outlet during cooling of the indoor heat exchanger 42 to become larger, and the heat exchange efficiency of the indoor heat exchanger 42 during cooling can be improved while suppressing a drop in the heat exchange efficiency of the indoor heat exchanger 42 during heating.

(B)

In the indoor heat exchanger 42 of the present embodiment, the liquid refrigerant tubes 91, the second row-side gas refrigerant tubes 92, and the third row-side gas refrigerant tubes 93 are connected to the lengthwise direction single ends of the corresponding heat transfer tubes 71, 72, and 73.

Because of this, in the indoor unit 4 of the present embodiment, the work of connecting the liquid refrigerant tubes 91, the second row-side gas refrigerant tubes 92, and the third row-side gas refrigerant tubes 93 to the heat transfer tubes 71, 72, and 73 can be consolidated and performed on the one lengthwise direction end side of the indoor heat exchanger 42, so the assemblability of the indoor heat exchanger 42 improves.

Moreover, in the indoor heat exchanger 42 of the present embodiment, the refrigerant flowing through the heat transfer tubes 71, 72, and 73 in each row flows in such a way that, after heading from the one lengthwise direction end of the indoor heat exchanger 42 to the other end, it turns back from the other lengthwise direction end to the one end. For this reason, not only are the liquid refrigerant tubes 91, the second row-side gas refrigerant tubes 92, and the third row-side gas refrigerant tubes 93 consolidated on the one lengthwise direction end side of the indoor heat exchanger 42, but the inter-row branching portions 71*d* also become placed on the one lengthwise direction end side of the indoor heat exchanger 42.

Because of this, in the indoor unit 4 of the present embodiment, in the case of employing a structure that requires the work of connecting, by soldering or the like, the inter-row branching portions 71*d* to the heat transfer tubes 71, 72, and 73 when assembling the indoor heat exchanger 42, the work of connecting the liquid refrigerant tubes 91, the second row-side gas refrigerant tubes 92, the third row-side gas refrigerant tubes 93, and the inter-row branching portions 71*d* to the heat transfer tubes 71, 72, and 73 can be consolidated and performed on the one lengthwise direction end side of the indoor heat exchanger 42, so the assemblability of the indoor heat exchanger 42 further improves.

(C)

The indoor heat exchanger 42 of the present embodiment has the inter-row branching portions 71*d* that cause the refrigerant that has been sent to the outlets of the heat transfer tubes 71 in the first row during cooling to branch into the heat transfer tubes 72 in the second row and the heat transfer tubes 73 in the third row. Additionally, the outlets of the heat transfer tubes 72 in the second row in a case where the indoor heat exchanger 42 functions as an evaporator of the refrigerant during cooling are connected to the second row-side gas refrigerant tubes 92. Further, the outlets of the heat transfer tubes 73 in the third row in a case where the indoor heat exchanger 42 functions as an evaporator of the refrigerant during cooling are connected to the third row-side gas refrigerant tubes 93.

In this indoor heat exchanger 42, during cooling, the refrigerant that has become gas-rich because of heat exchange with the air in the heat transfer tubes 71 in the first row is caused to branch into and is sent through the heat transfer tubes 72 in the second row and the heat transfer tubes 73 in the third row, so an increase in the flow speed of the refrigerant that has become gas-rich can be suppressed. Further, in this indoor heat exchanger 42, during heating, the refrigerant that has become liquid-rich because of heat exchange with the air in the heat transfer tubes 72 in the second row and the refrigerant that has become liquid-rich because of heat exchange with the air in the heat transfer tubes 73 in the third row are caused to merge together and become sent to the heat transfer tubes 71 in the first row, so the flow speed of the refrigerant that has become liquid-rich can be increased to thereby increase the heat transfer coefficient in the heat transfer tubes 71 in the first row.

Because of this, in the indoor unit 4 of the present embodiment, an increase in pressure drop can be suppressed as a result of the inter-row branching portions 71*d* causing the flow of the refrigerant to branch, so the heat exchange efficiency of the indoor heat exchanger 42 during cooling can be further improved. In particular, in this indoor unit 4, an increase in the flow speed of the refrigerant in the heat transfer tubes 72 in the second row and the heat transfer tubes 73 in the third row through which flows the gas-rich refrigerant whose effect with respect to pressure drop is large is suppressed, so the heat exchange efficiency of the indoor heat exchanger 42 during cooling can be effectively improved. Further, in this indoor unit 4, the heat transfer coefficient is increased by increasing the flow speed of the refrigerant in the heat transfer tubes 71 in the first row through which flows the liquid-rich refrigerant whose effect with respect to pressure drop is small, so it becomes easier for the degree of subcooling in the refrigerant outlet during heating of the indoor heat exchanger 42 to become larger, and a drop in the heat exchange efficiency during heating can be further suppressed.

(D)

In the indoor heat exchanger 42 of the present embodiment, the first heat transfer tubes 71*b* (first downstream-side heat transfer tubes) connected to the inter-row branching portions 71*d* are placed one stage on the upper sides of the first heat transfer tubes 71*a* (first upstream-side heat transfer tubes), which are connected to the upstream sides of the first heat transfer tubes 71*b* during cooling and are connected to the liquid refrigerant tubes 91.

In this indoor heat exchanger 42, during heating, the refrigerant passing through the first heat transfer tubes 71*a* and 71*b* flows in such a way as to descend toward the liquid refrigerant tubes 91.

Because of this, in the indoor unit 4 of the present embodiment, it becomes easier for the degree of subcooling in the refrigerant outlet during heating of the indoor heat exchanger 42 to become larger, and a drop in the heat exchange efficiency during heating can be further suppressed.

(3) Modification 1

In the indoor heat exchanger 42 configuring the indoor unit 4 described above (see FIG. 5), the inter-row branching portions 71*d* are connected, on the one lengthwise direction end side of the indoor heat exchanger 42, to the second heat transfer tubes 72*a* (second upstream-side heat transfer tubes) and the third heat transfer tubes 73*a* (third upstream-side heat transfer tubes) placed on the lower sides of the second heat transfer tubes 72*a*.

Figure 8:
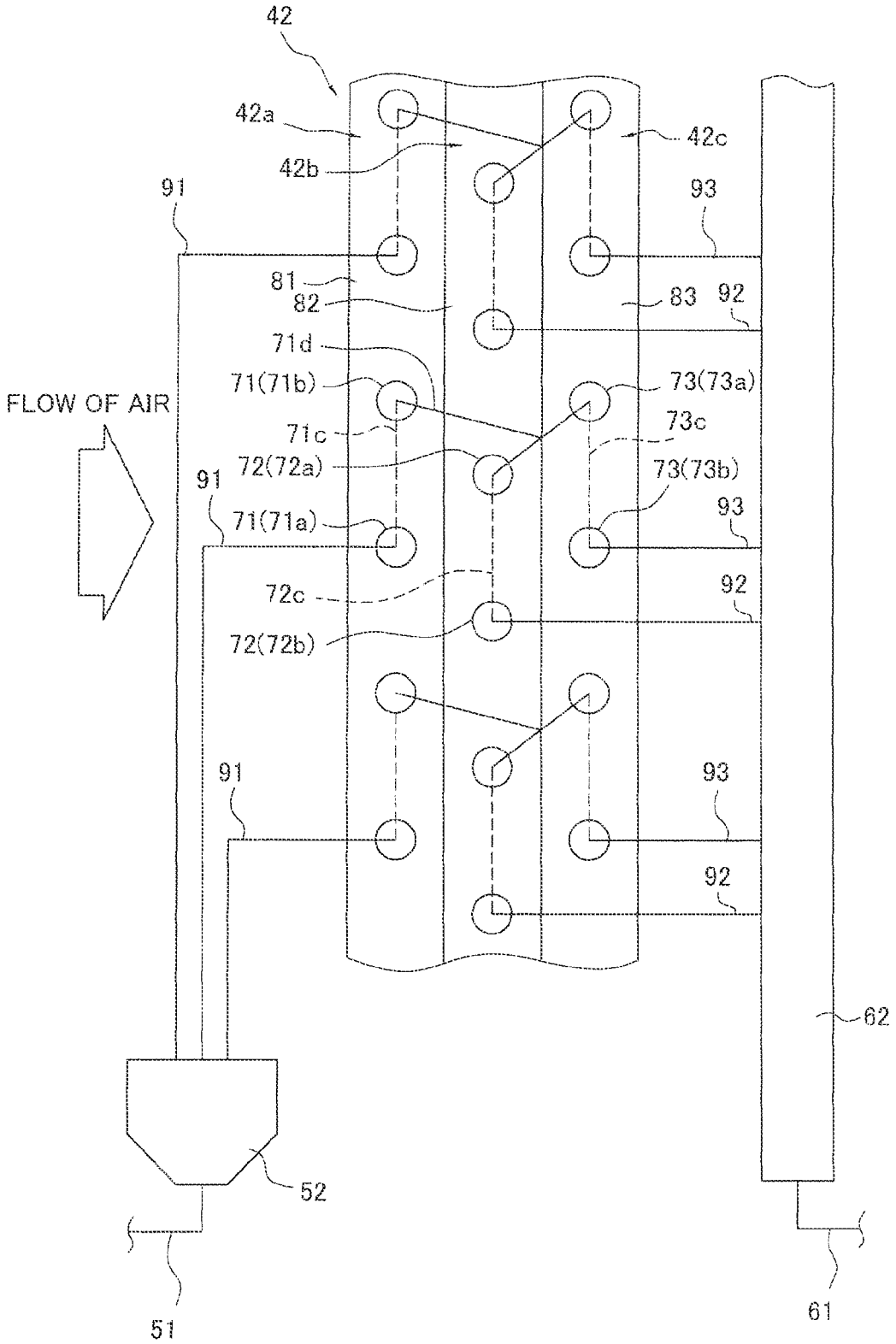
FIG. 8 is a view showing the refrigerant paths in the indoor heat exchanger in the indoor unit serving as the ceiling-mounted air conditioning unit pertaining to modification 1 of the first embodiment.
Figure 9:
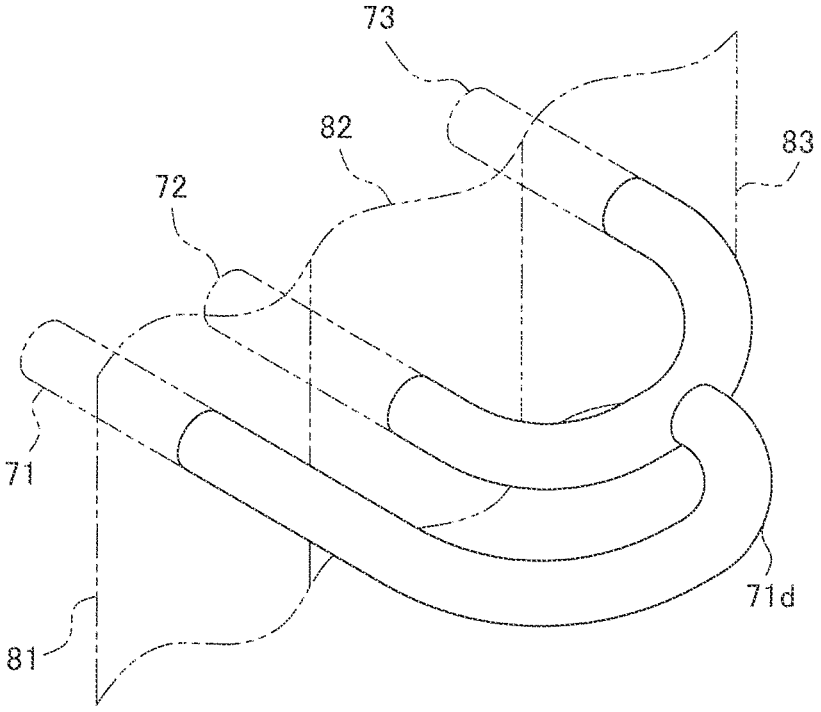
FIG. 9 is a view showing the shape of the inter-row branching portion in modification 1 of the first embodiment.

In contrast, in the indoor heat exchanger 42 configuring the indoor unit 4 of the present modification, as shown in FIG. 8, FIG. 6, and FIG. 9, the second heat transfer tubes 72*a* (second upstream-side heat transfer tubes) to which the inter-row branching portions 71*d* are connected are placed on the lower sides of the third heat transfer tubes 73*a* (third upstream-side heat transfer tubes) to which the inter-row branching portions 71*d* are connected.

For this reason, in this indoor heat exchanger 42, during cooling, it becomes easier for more of the refrigerant to flow into the second heat transfer tubes 72*a* than the third heat transfer tubes 73*a* because of the action of gravity.

Because of this, in the indoor unit 4 of the present modification, it becomes easier for the degree of superheat of the refrigerant exiting from the refrigerant outlet during cooling of the indoor heat exchanger 42 to become larger, and the heat exchange efficiency of the indoor heat exchanger 42 during cooling can be further improved.

(4) Modification 2

In the indoor heat exchanger 42 configuring the indoor unit 4 described above (see FIG. 5), the inter-row branching portions 71*d* are formed in such a way that the flow path length from the outlets of the first heat transfer tubes 71*b* (first downstream-side heat transfer tubes) to the inlets of the second heat transfer tubes 72*a* (second upstream-side heat transfer tubes) and the flow path length from the outlets of the first heat transfer tubes 71*b* to the inlets of the third heat transfer tubes 73*a* (third upstream-side heat transfer tubes) in a case where the indoor heat exchanger 42 functions as an evaporator of the refrigerant during cooling become the same.

Figure 10:
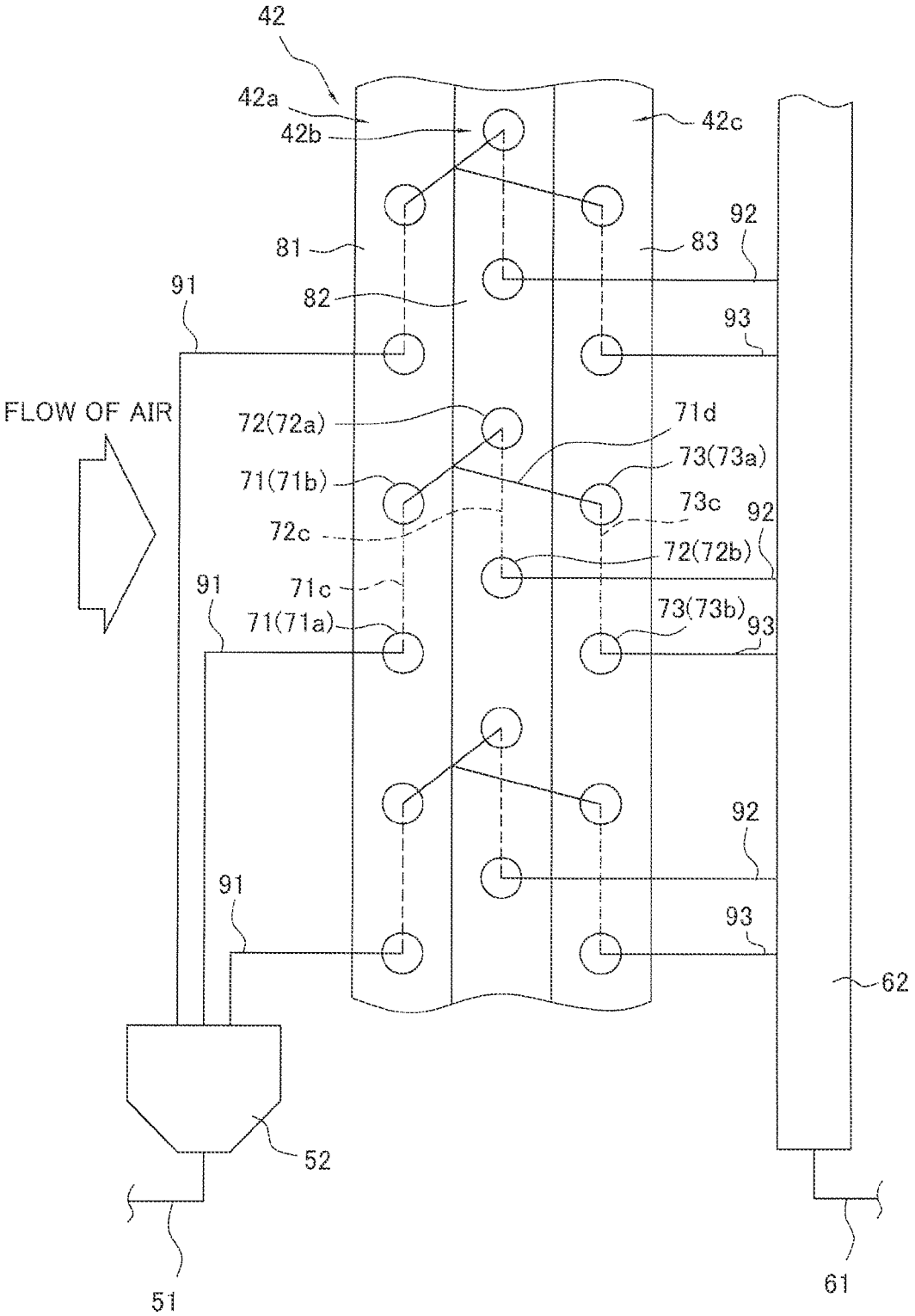
FIG. 10 is a view showing the refrigerant paths in the indoor heat exchanger in the indoor unit serving as the ceiling-mounted air conditioning unit pertaining to modification 2 of the first embodiment.
Figure 11:
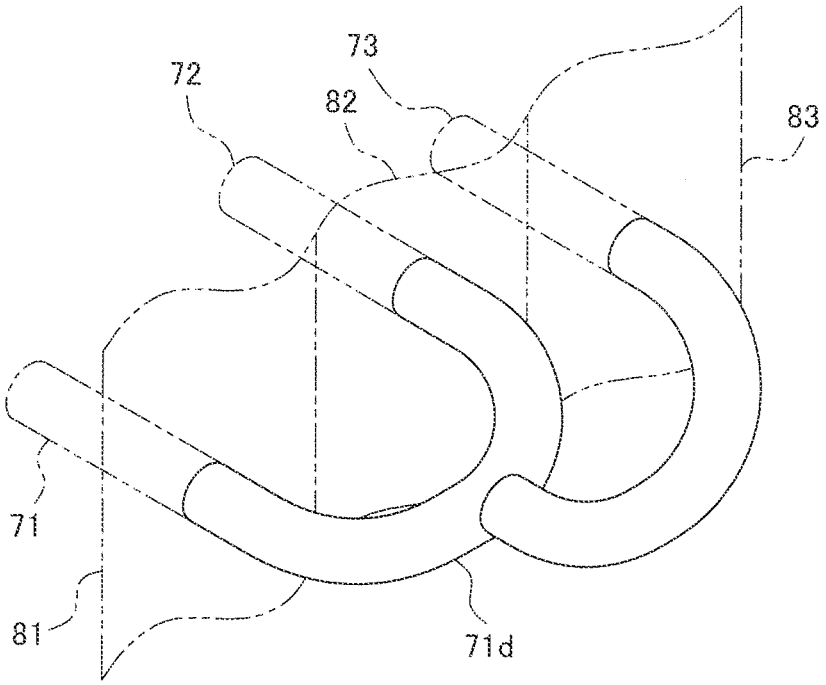
FIG. 11 is a view showing the shape of the inter-row branching portion in modification 2 of the first embodiment.

In contrast, in the indoor heat exchanger 42 configuring the indoor unit 4 of the present modification, as shown in FIG. 10, FIG. 6, and FIG. 11, the inter-row branching portions 71*d* are formed in such a way that the flow path length from the outlets of the first heat transfer tubes 71*b* (first downstream-side heat transfer tubes) to the inlets of the third heat transfer tubes 73*a* (third upstream-side heat transfer tubes) becomes longer than the flow path length from the outlets of the first heat transfer tubes 71*b* (first downstream-side heat transfer tubes) to the inlets of the second heat transfer tubes 72*a* (second upstream-side heat transfer tubes) in a case where the indoor heat exchanger 42 functions as an evaporator of the refrigerant during cooling. More specifically, in the present modification, as shown in FIG. 11, each of the inter-row branching portions 71*d* is made into a tube portion having a shape where the end portion of a U-shaped tube portion extending from the third heat transfer tube 73 is joined together with the middle portion of a U-shaped tube portion joining together the first heat transfer tube 71 and the second heat transfer tube 72.

For this reason, in this indoor heat exchanger 42, during cooling, it becomes easier for more of the refrigerant to flow into the second heat transfer tubes 72*a* where the flow path resistance from the outlets of the first heat transfer tubes 71*b* through the inter-row branching portions 71*d* to the inlets of the second heat transfer tubes 72*a* is small.

Because of this, in the indoor unit 4 of the present modification, it becomes easier for the degree of superheat of the refrigerant exiting from the refrigerant outlet during cooling of the indoor heat exchanger 42 to become larger, and the heat exchange efficiency of the indoor heat exchanger 42 during cooling can be further improved.

(5) Modification 3

The characteristics of modification 1 and the characteristics of modification 2 may also be combined and applied with respect to the indoor heat exchanger 42 configuring the indoor unit 4 described above (see FIG. 5).

Figure 12:
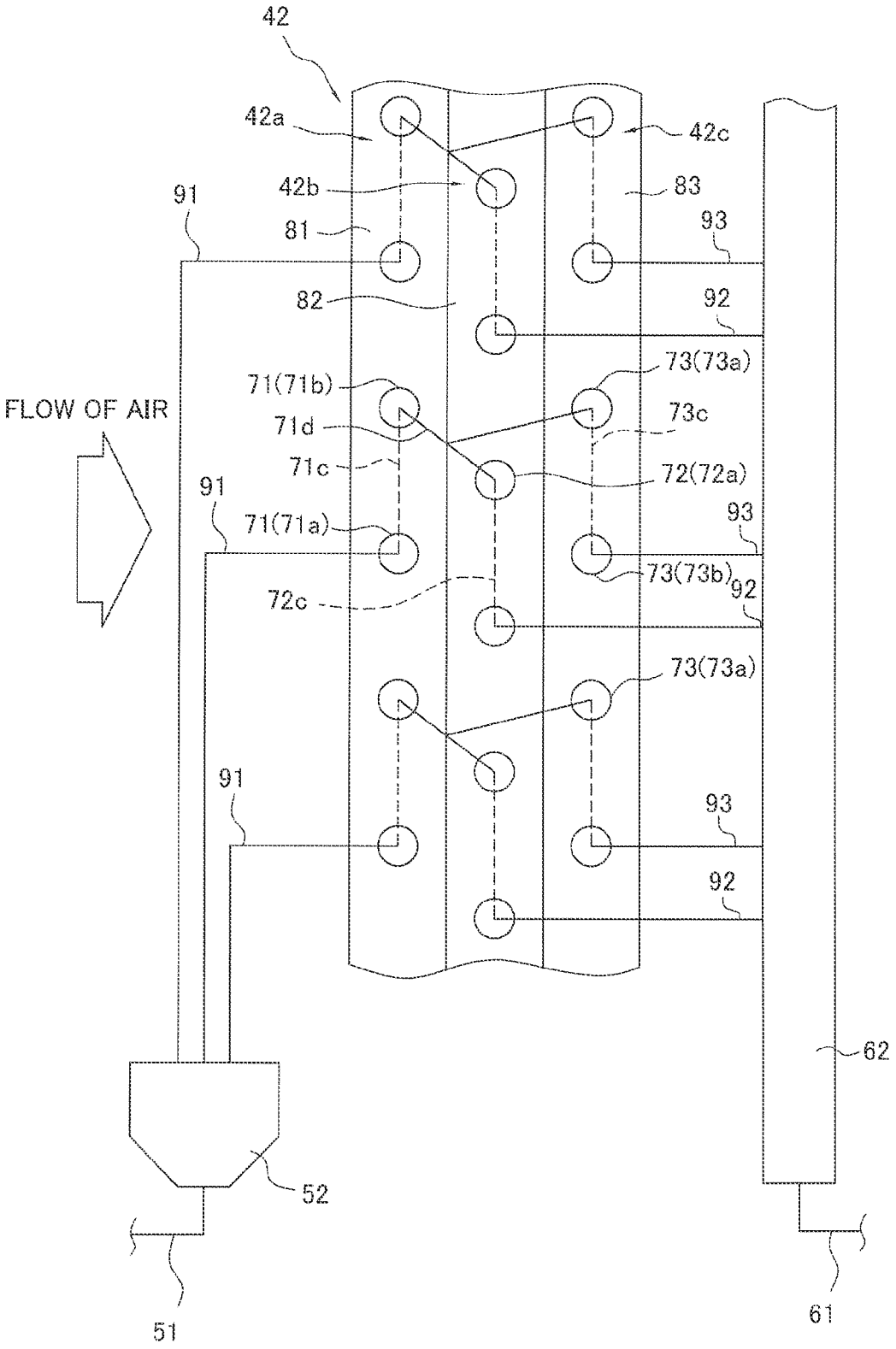
FIG. 12 is a view showing the refrigerant paths in the indoor heat exchanger in the indoor unit serving as the ceiling-mounted air conditioning unit pertaining to modification 3 of the first embodiment.
Figure 13:
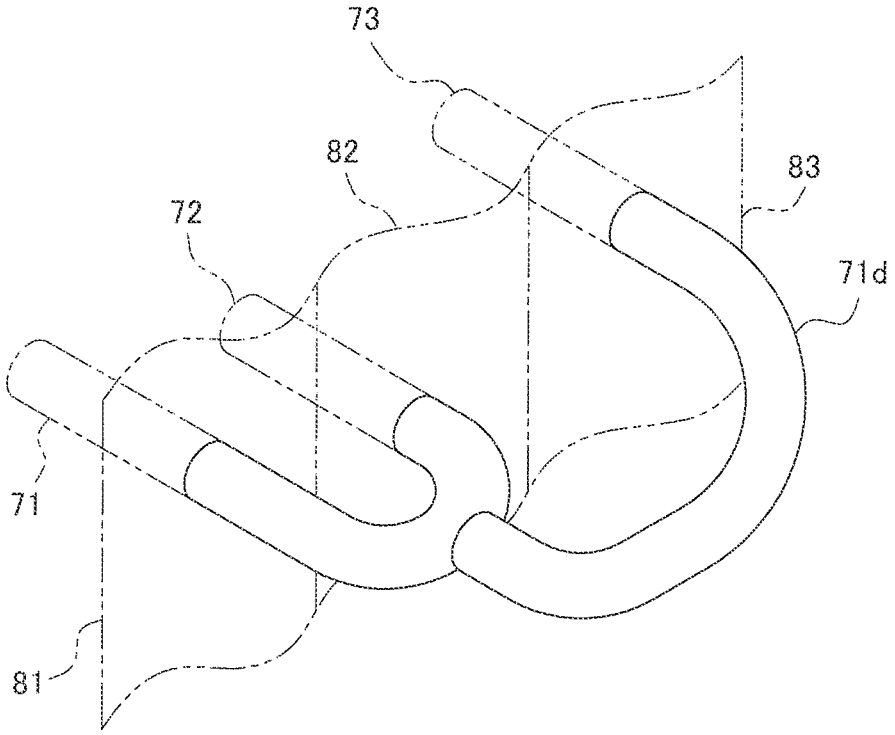
FIG. 13 is a view showing the shape of the inter-row branching portion in modification 3 of the first embodiment.

That is, in the indoor heat exchanger 42 configuring the indoor unit 4 of the present modification, as shown in FIG. 12, FIG. 6, and FIG. 13, like in modification 1, the second heat transfer tubes 72*a* (second upstream-side heat transfer tubes) to which the inter-row branching portions 71*d* are connected are placed on the lower sides of the third heat transfer tubes 73*a* (third upstream-side heat transfer tubes) to which the inter-row branching portions 71*d* are connected. Moreover, in the indoor heat exchanger 42 configuring the indoor unit 4 of the present modification, like in modification 2, the inter-row branching portions 71*d* are formed in such a way that the flow path length from the outlets of the first heat transfer tubes 71*b* (first downstream-side heat transfer tubes) to the inlets of the third heat transfer tubes 73*a* (third upstream-side heat transfer tubes) becomes longer than the flow path length from the outlets of the first heat transfer tubes 71*b* (first downstream-side heat transfer tubes) to the inlets of the second heat transfer tubes 72*a* (second upstream-side heat transfer tubes) in a case where the indoor heat exchanger 42 functions as an evaporator of the refrigerant during cooling.

Because of this, in the indoor unit 4 of the present modification, both the action and effects of modification 1 and the action and effects of modification 2 can be obtained.

(6) Modification 4

In the indoor heat exchanger 42 configuring the indoor unit 4 described above (see FIG. 5), the second heat transfer tubes 72*b* (second downstream-side heat transfer tubes) connected to the second row-side gas refrigerant tubes 92 are placed one stage on the lower sides of the second heat transfer tubes 72*a* (second upstream-side heat transfer tubes) connected to the upstream sides of the second heat transfer tubes 72*b* during cooling. Further, in the indoor heat exchanger 42 configuring the indoor unit 4 described above (see FIG. 5), the third heat transfer tubes 73*b* (third downstream-side heat transfer tubes) connected to the third row-side gas refrigerant tubes 93 are placed one stage on the lower sides of the third heat transfer tubes 73*a* (third upstream-side heat transfer tubes) connected to the upstream sides of the third heat transfer tubes 73*b* during cooling.

Figure 14:
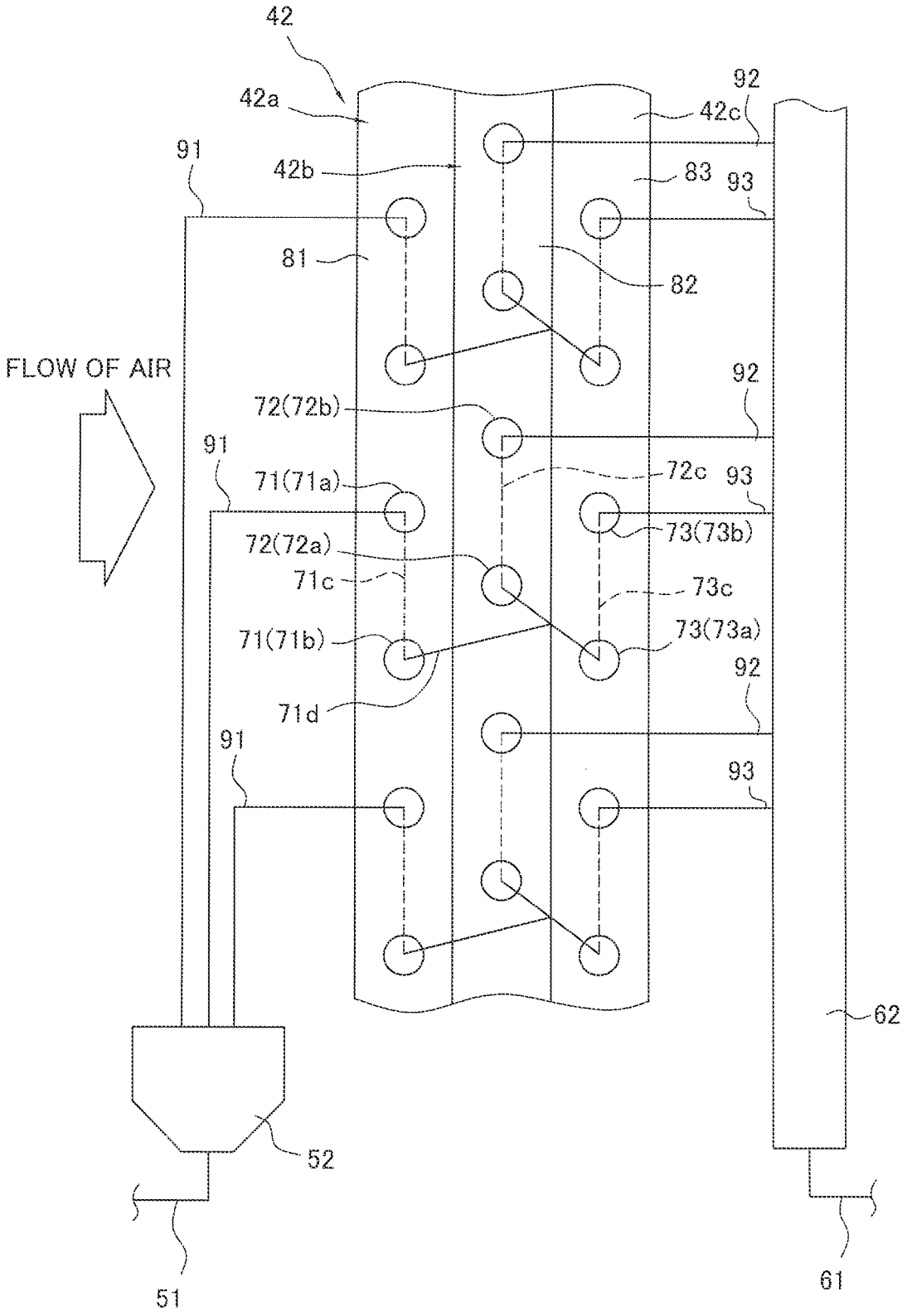
FIG. 14 is a view showing the refrigerant paths in the indoor heat exchanger in the indoor unit serving as the ceiling-mounted air conditioning unit pertaining to modification 4 of the first embodiment.

In contrast, in the indoor heat exchanger 42 configuring the indoor unit 4 of the present modification, as shown in FIG. 14, FIG. 6, and FIG. 7, the second heat transfer tubes 72*h* (second downstream-side heat transfer tubes) connected to the second row-side gas refrigerant tubes 92 are placed one stage on the upper sides of the second heat transfer tubes 72*a* (second upstream-side heat transfer tubes) connected to the upstream sides of the second heat transfer tubes 72*b* during cooling. Further, in the indoor heat exchanger 42 configuring the indoor unit 4 of the present modification, the third heat transfer tubes 73*b* (third downstream-side heat transfer tubes) connected to the third row-side gas refrigerant tubes 93 are placed one stage on the upper sides of the third heat transfer tubes 73*a* (third upstream-side heat transfer tubes) connected to the upstream sides of the third heat transfer tubes 73*b* during cooling.

For this reason, in this indoor heat exchanger 42, during cooling, the refrigerant passing through the second heat transfer tubes 72*a* and 72*b* flows in such a way as to smoothly ascend toward the second row-side gas refrigerant tubes 92, and the refrigerant passing through the third heat transfer tubes 73*a* and 73*b* flows in such a way as to smoothly ascend toward the third row-side gas refrigerant tubes 93.

Because of this, in the indoor unit 4 of the present modification, an increase in pressure drop when the refrigerant passes through the second heat transfer tubes 72*a* and 72*b* can be suppressed, and an increase in pressure drop when the refrigerant passes through the third heat transfer tubes 73*a* and 73*b* can be suppressed, so the heat exchange efficiency of the indoor heat exchanger 42 during cooling can be further improved.

In the present modification, the second heat transfer tubes 72*b* are placed on the upper sides of the second heat transfer tubes 72*a*, and the third heat transfer tubes 73*b* are placed on the upper sides of the third heat transfer tubes 73*a*, but the modification may also be configured in such a way as to just place the second heat transfer tubes 72*b* on the upper sides of the second heat transfer tubes 72*a* or so as to just place the third heat transfer tubes 73*h* on the upper sides of the third heat transfer tubes 73*a*.

(7) Modification 5

In the indoor heat exchanger 42 configuring the indoor unit 4 pertaining to modification 4 (see FIG. 14), the first heat transfer tubes 71*b* (first downstream-side heat transfer tubes) connected to the inter-row branching portions 71*d* are placed one stage on the lower sides of the first heat transfer tubes 71*a* (first upstream-side heat transfer tubes), which are connected to the upstream sides of the first heat transfer tubes 71*b* during cooling and are connected to the liquid refrigerant tubes 91.

Figure 15:
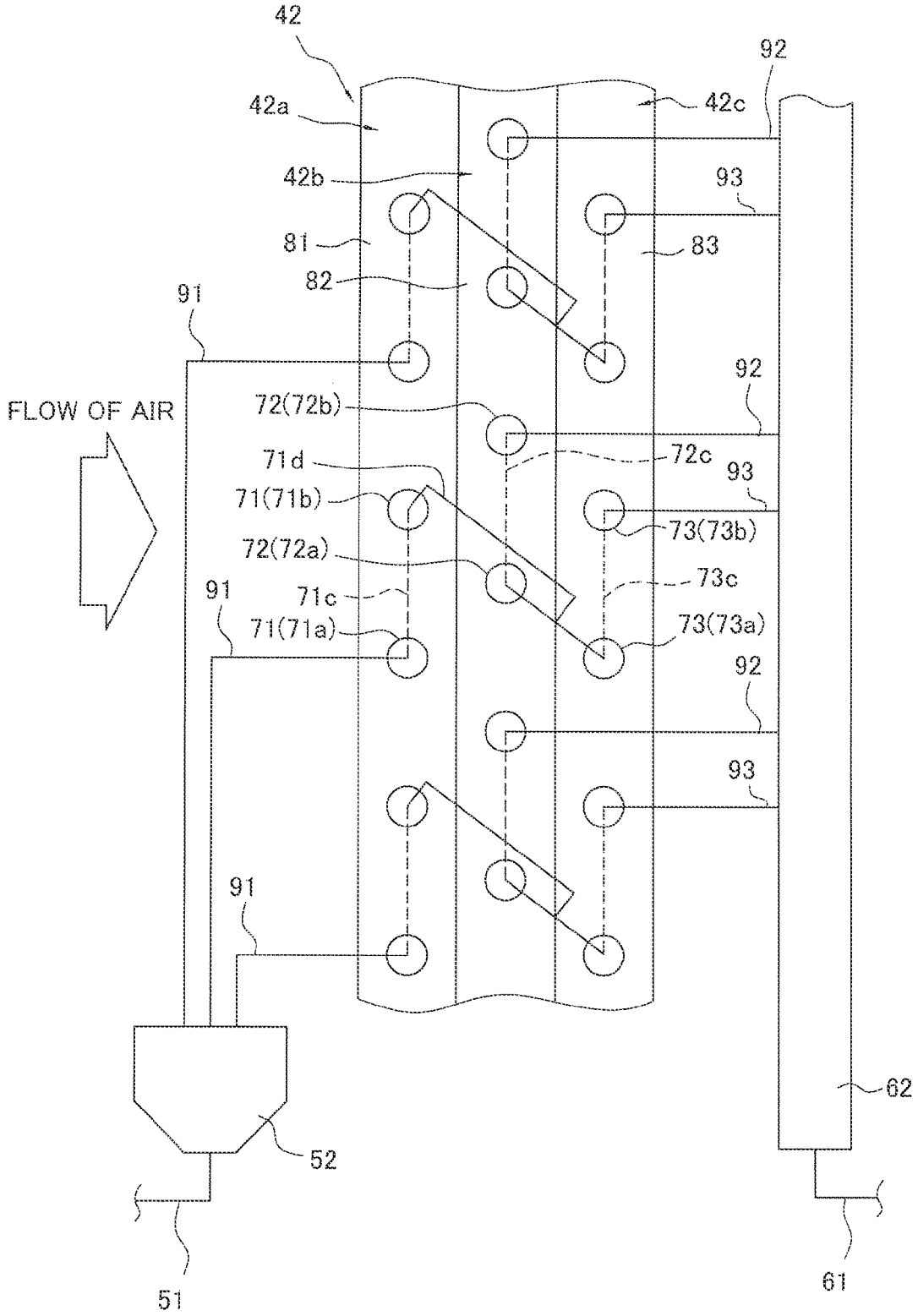
FIG. 15 is a view showing the refrigerant paths in the indoor heat exchanger in the indoor unit serving as the ceiling-mounted air conditioning unit pertaining to modification 5 of the first embodiment.
Figure 16:
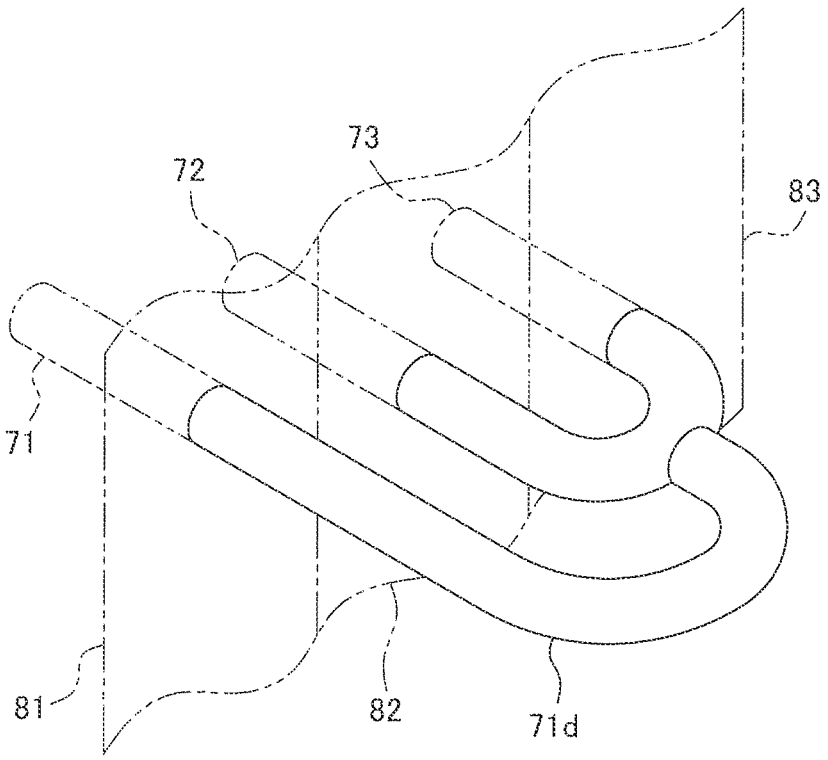
FIG. 16 is a view showing the shape of the inter-row branching portion in modification 5 of the first embodiment.

In contrast, in the indoor heat exchanger 42 configuring the indoor unit 4 of the present modification, as shown in FIG. 15, FIG. 6, and FIG. 16, the first heat transfer tubes 71*b* (first downstream-side heat transfer tubes) connected to the inter-row branching portions 71*c*1 are placed one stage on the upper sides of the first heat transfer tubes 71*a* (first upstream-side heat transfer tubes), which are connected to the upstream sides of the first heat transfer tubes 71*b* during cooling and are connected to the liquid refrigerant tubes 91.

For this reason, in this indoor heat exchanger 42, like in the indoor heat exchanger 42 configuring the indoor unit 4 described above (see FIG. 5), during heating, the refrigerant passing through the first heat transfer tubes 71*a* and 71*b* flows in such a way as to descend toward the liquid refrigerant tubes 91.

Because of this, in the indoor unit 4 of the present modification, it becomes easier than in modification 4 for the degree of subcooling in the refrigerant outlet during heating of the indoor heat exchanger 42 to become larger, and a drop in the heat exchange efficiency during heating can be further suppressed.

(8) Modification 6

In the indoor heat exchanger 42 configuring the indoor unit 4 pertaining to modification 5 (see FIG. 15), the inter-row branching portions 71*d* are connected, on the one lengthwise direction end side of the indoor heat exchanger 42, to the second heat transfer tubes 72*a* (second upstream-side heat transfer tubes) and the third heat transfer tubes 73*a* (third upstream-side heat transfer tubes) placed on the lower sides of the second heat transfer tubes 72*a*.

Figure 17:
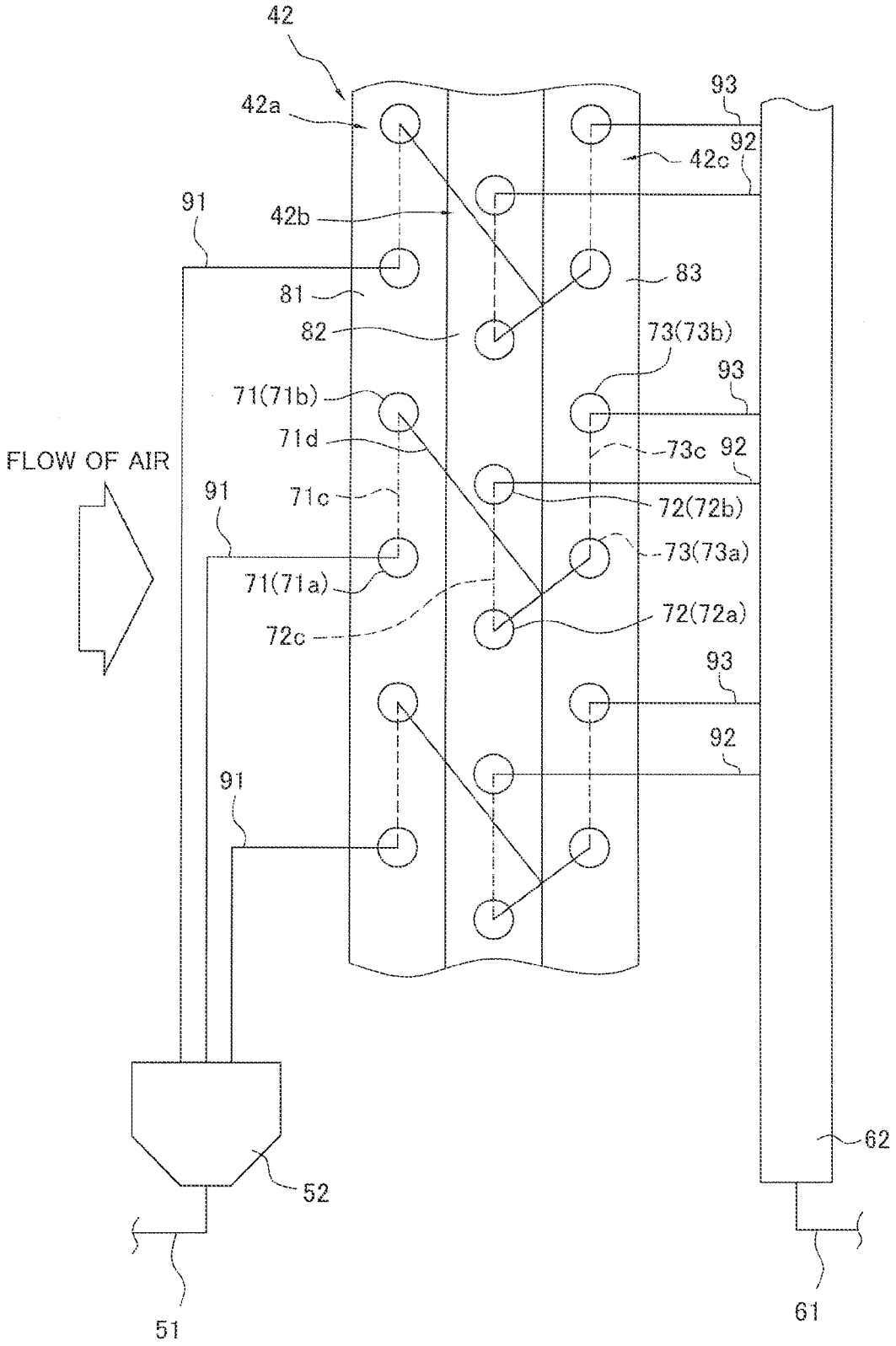
FIG. 17 is a view showing the refrigerant paths in the indoor heat exchanger in the indoor unit serving as the ceiling-mounted air conditioning unit pertaining to modification 6 of the first embodiment.
Figure 18:
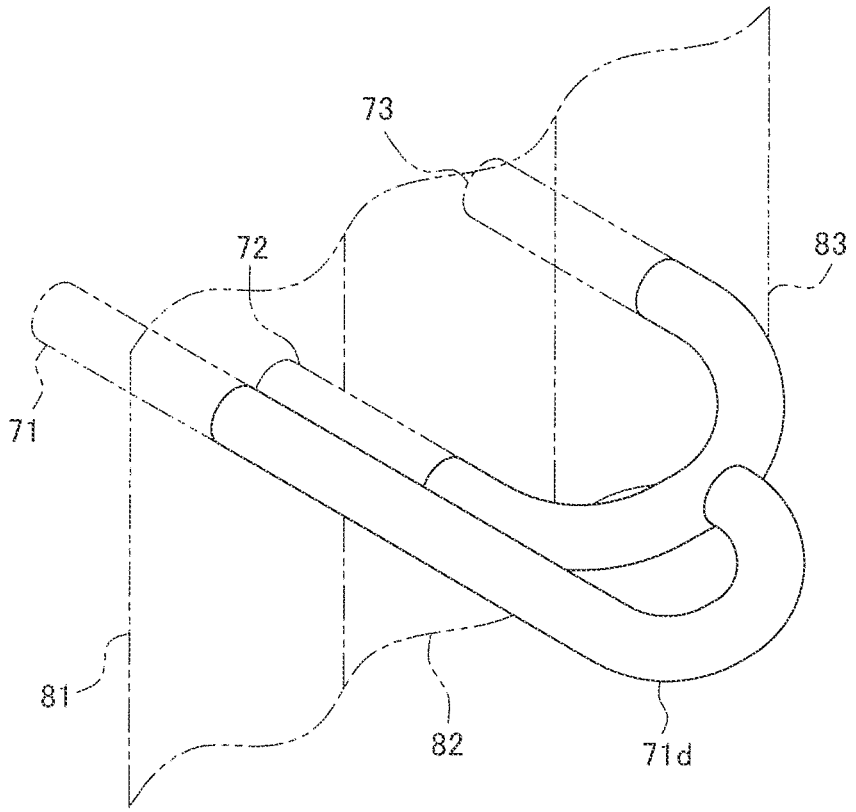
FIG. 18 is a view showing the shape of the inter-row branching portion in modification 6 and modification 9 of the first embodiment.

In contrast, in the indoor heat exchanger 42 configuring the indoor unit 4 of the present modification, like in the indoor heat exchanger 42 configuring the indoor unit 4 of modification 1 (see FIG. 8), as shown in FIG. 17, FIG. 6, and FIG. 18, the second heat transfer tubes 72*a* (second upstream-side heat transfer tubes) to which the inter-row branching portions 71*d* are connected are placed on the lower sides of the third heat transfer tubes 73*a* (third upstream-side heat transfer tubes) to which the inter-row branching portions 71*d* are connected.

For this reason, in this indoor heat exchanger 42, during cooling, it becomes easier fir more of the refrigerant to flow into the third heat transfer tubes 73*a* than the second heat transfer tubes 72*a* because of the action of gravity.

Because of this, it becomes easier for the degree of superheat of the refrigerant exiting from the refrigerant outlet during cooling of the indoor heat exchanger 42 to become larger, and the heat exchange efficiency of the indoor heat exchanger 42 during cooling can be further improved.

(9) Modification 7

In the indoor heat exchanger 42 configuring the indoor unit 4 pertaining to modification 5 (see FIG. 15), the inter-row branching portions 71*d* are formed in such a way that the flow path length from the outlets of the first heat transfer tubes 71*b* (first downstream-side heat transfer tubes) to the inlets of the second heat transfer tubes 72*a* (second upstream-side heat transfer tubes) and the flow path length from the outlets of the first heat transfer tubes 71*b* to the inlets of the third heat transfer tubes 73*a* (third upstream-side heat transfer tubes) in a case where the indoor heat exchanger 42 functions as an evaporator of the refrigerant during cooling become the same.

Figure 19:
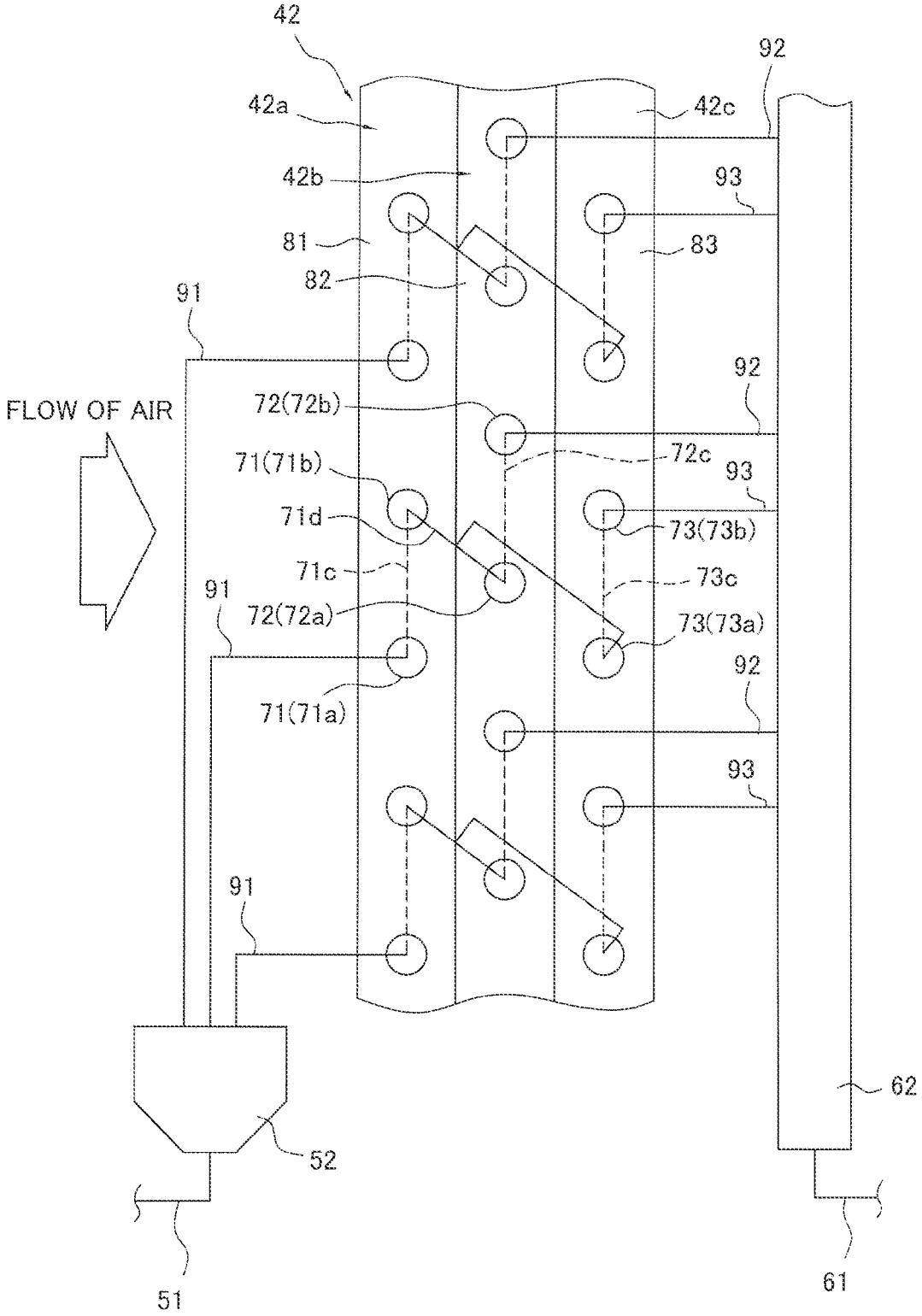
FIG. 19 is a view showing the refrigerant paths in the indoor heat exchanger in the indoor unit serving as the ceiling-mounted air conditioning unit pertaining to modification 7 of the first embodiment.
Figure 20:
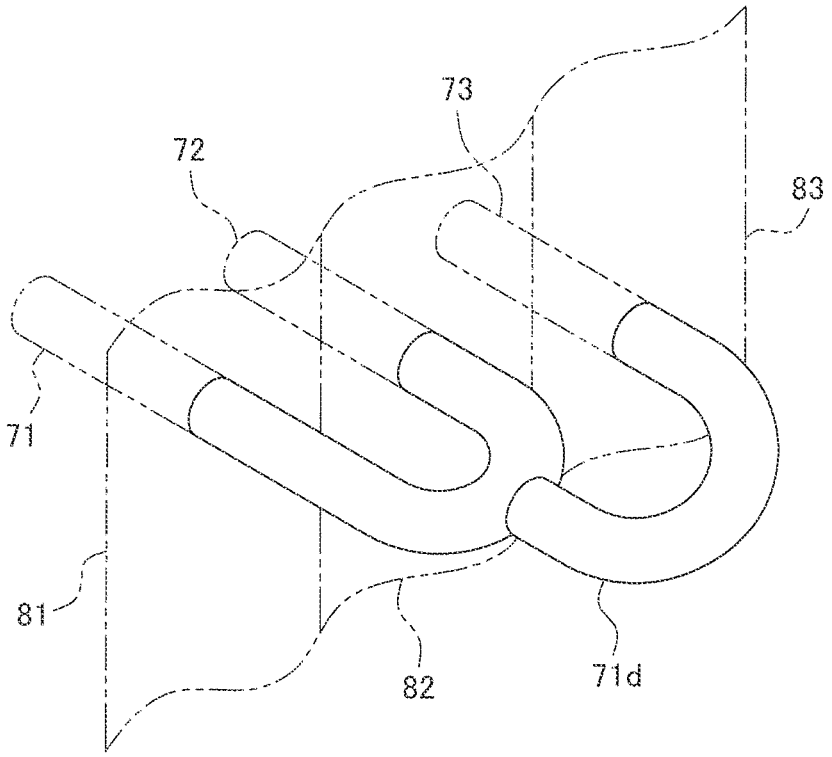
FIG. 20 is a view showing the shape of the inter-row branching portion in modification 7 of the first embodiment.

In contrast, in the indoor heat exchanger 42 configuring the indoor unit 4 of the present modification, like in the indoor heat exchanger 42 configuring the indoor unit 4 of modification 2 (see FIG. 10), as shown in FIG. 19, FIG. 6, and FIG. 20, the inter-row branching portions 71*d* are formed in such a way that the flow path length from the outlets of the first heat transfer tubes 71*b* (first downstream-side heat transfer tubes) to the inlets of the third heat transfer tubes 73*a* (third upstream-side heat transfer tubes) becomes longer than the flow path length from the outlets of the first heat transfer tubes 71*b* (first downstream-side heat transfer tubes) to the inlets of the second heat transfer tubes 72*a* (second upstream-side heat transfer tubes) in a case where the indoor heat exchanger 42 functions as an evaporator of the refrigerant during cooling. More specifically, in the present modification, as shown in FIG. 20, each of the inter-row branching portions 71*d* is made into a tube portion having a shape where the end portion of a U-shaped tube portion extending from the third heat transfer tube 73 is joined together with the middle portion of a U-shaped tube portion joining together the first heat transfer tube 71 and the second heat transfer tube 72.

For this reason, in this indoor heat exchanger 42, during cooling, it becomes easier for more of the refrigerant to flow into the second heat transfer tubes 72*a* where the flow path resistance from the outlets of the first heat transfer tubes 71*b* through the inter-row branching portions 71*d* to the inlets of the second heat transfer tubes 72*a* is small.

Because of this, in the indoor unit 4 of the present modification, it becomes easier for the degree of superheat of the refrigerant exiting from the refrigerant outlet during cooling of the indoor heat exchanger 42 to become larger, and the heat exchange efficiency of the indoor heat exchanger 42 during cooling can be further improved.

(10) Modification 8

The characteristics of modification 6 and the characteristics of modification 7 may also be combined and applied with respect to the indoor heat exchanger 42 configuring the indoor unit 4 pertaining to modification 5 (see FIG. 15).

Figure 21:
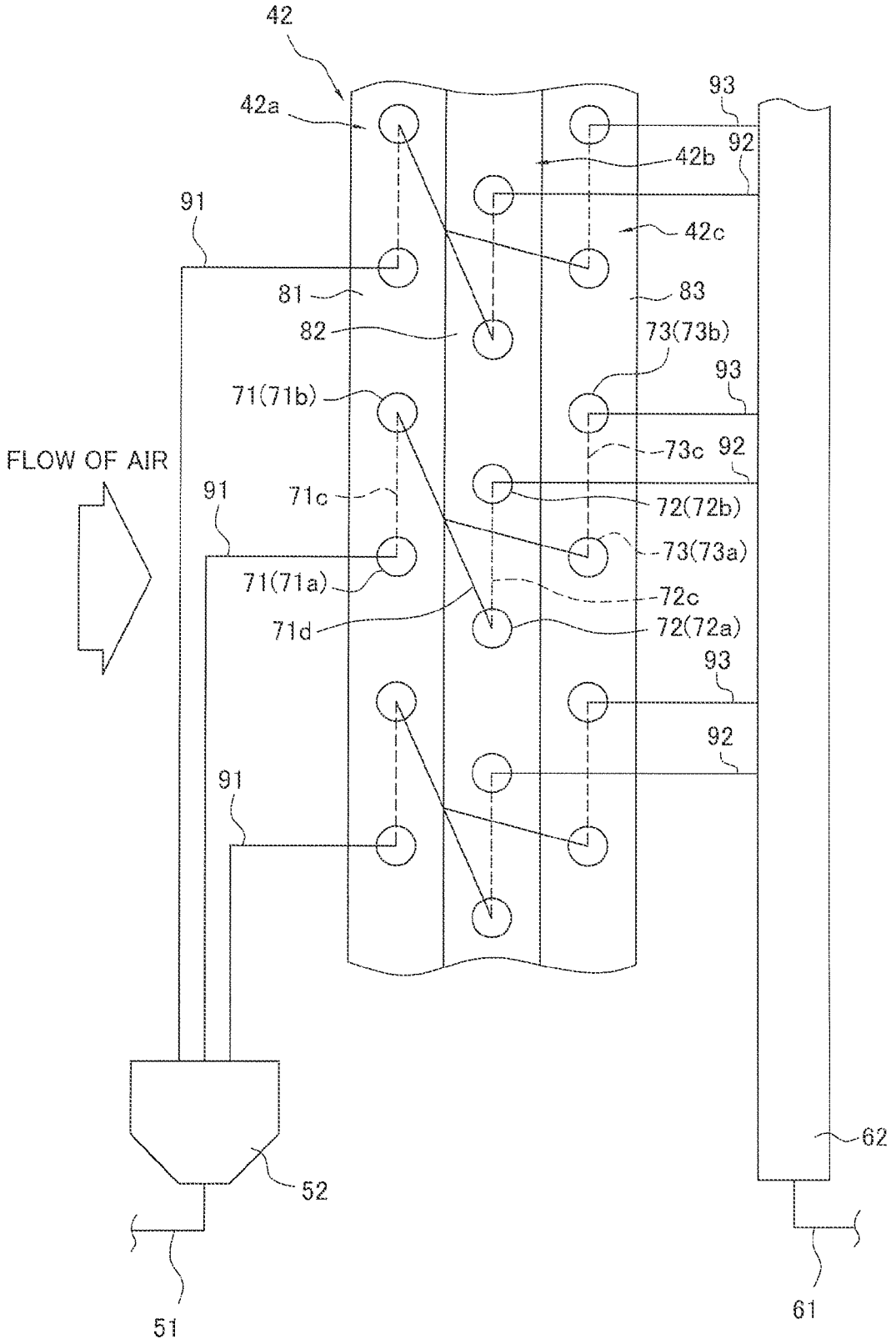
FIG. 21 is a view showing the refrigerant paths in the indoor heat exchanger in the indoor unit serving as the ceiling-mounted air conditioning unit pertaining to modification 8 of the first embodiment.
Figure 22:
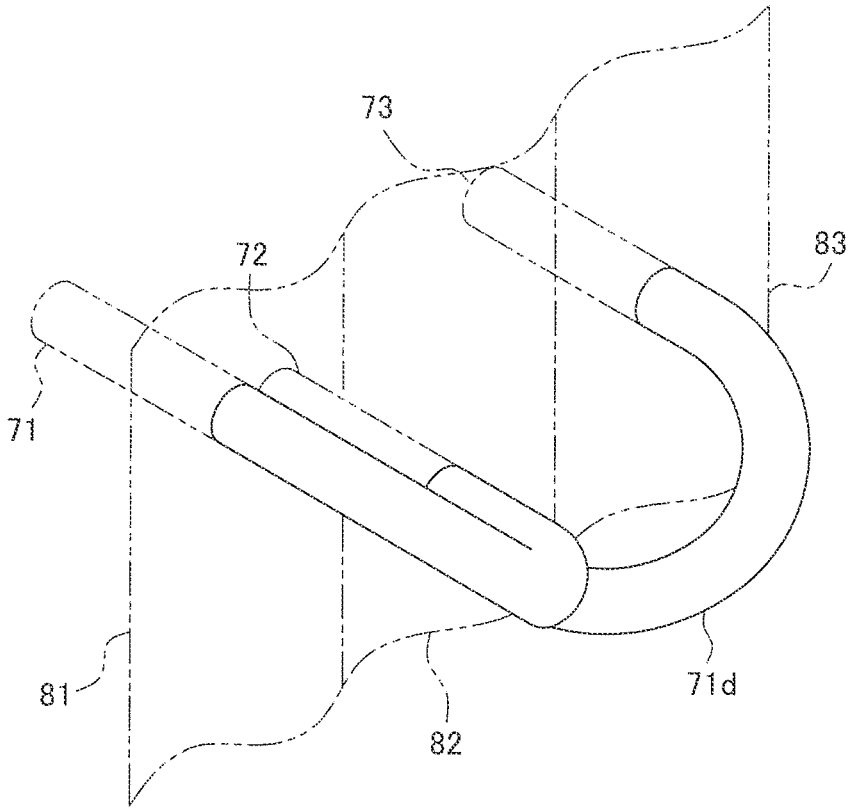
FIG. 22 is a view showing the shape of the inter-row branching portion in modification 8 of the first embodiment.
Figure 23:
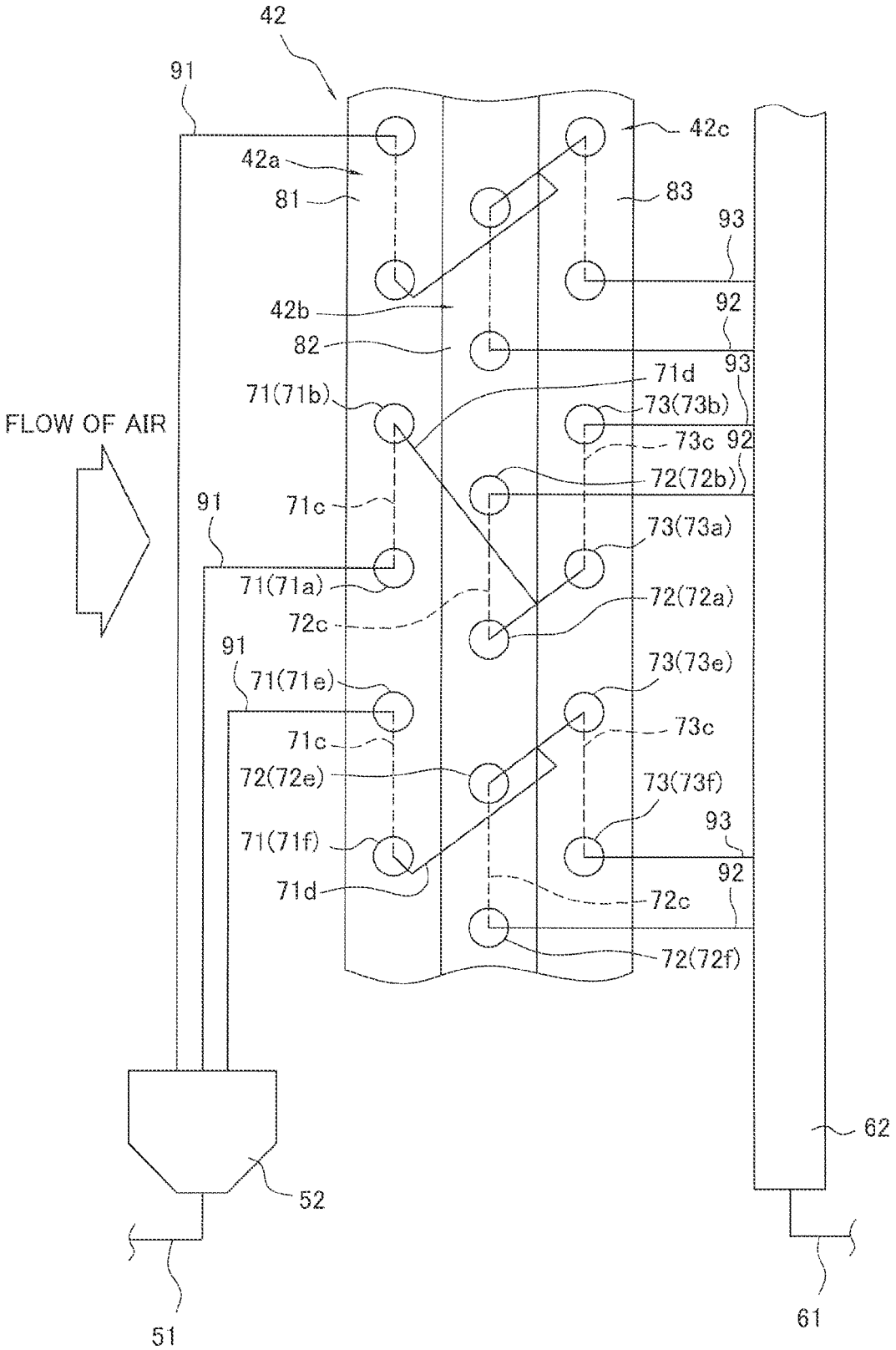
FIG. 23 is a view showing the refrigerant paths in the indoor heat exchanger in the indoor unit serving as the ceiling-mounted air conditioning unit pertaining to modification 9 of the first embodiment.

That is, in the indoor heat exchanger 42 configuring the indoor unit 4 of the present modification, as shown in FIG. 21, FIG. 6, and FIG. 22, like in modification 6, the second heat transfer tubes 72*a* (second upstream-side heat transfer tubes) to which the inter-row branching portions 71*d* are connected are placed on the lower sides of the third heat transfer tubes 73*a* (third upstream-side heat transfer tubes) to which the inter-row branching portions 71*d* are connected. Moreover, in the indoor heat exchanger 42 configuring the indoor unit 4 of the present modification, like in modification 7, the inter-row branching portions 71*d* are formed in such a way that the flow path length from the outlets of the first heat transfer tubes 71*b* (first downstream-side heat transfer tubes) to the inlets of the third heat transfer tubes 73*a* (third upstream-side heat transfer tubes) becomes longer than the flow path length from the outlets of the first heat transfer tubes 71*b* (first downstream-side heat transfer tubes) to the inlets of the second heat transfer tubes 72*a* (second upstream-side heat transfer tubes) in a case where the indoor heat exchanger 42 functions as an evaporator of the refrigerant during cooling.

Because of this, in the indoor unit 4 of the present modification, both the action and effects of modification 6 and the action and effects of modification 7 can be obtained.

(11) Modification 9

The indoor heat exchanger 42 configuring the indoor unit 4 described above (see FIG. 5) has plural stages (in FIG. 5, only three are illustrated) of refrigerant paths that are configured as a result of the heat transfer tubes 71, 72, and 73 in two stages each in three rows being interconnected; moreover, as for these refrigerant paths, the paths that join together the liquid refrigerant tubes 91 and the gas refrigerant tubes 92 and 93 are the same. For this reason, the outlets of the second heat transfer tubes 72*b* (second downstream-side heat transfer tubes) connected to the second row-side gas refrigerant tubes 92 and the outlets of the third heat transfer tubes 73*h* (third downstream-side heat transfer tubes) connected to the third row-side gas refrigerant tubes 93 in a case where the indoor heat exchanger 42 functions as an evaporator of the refrigerant during cooling are placed away from the outlets of the other second heat transfer tubes 72*b* (second downstream-side heat transfer tubes) and the outlets of the other third heat transfer tubes 73*b* (third downstream-side heat transfer tubes) configuring the refrigerant paths placed on the upper sides or the lower sides. Additionally, the inlets of the first heat transfer tubes 71*a* (first upstream-side heat transfer tubes) connected to the liquid refrigerant tubes 91 in a case where the indoor heat exchanger 42 functions as an evaporator of the refrigerant during cooling are placed away from the inlets of the other first heat transfer tubes 71*a* (first upstream-side heat transfer tubes) placed on the upper sides or the lower sides.

In contrast, in the indoor heat exchanger 42 configuring the indoor unit 4 of the present modification, as shown in FIG. 23, FIG. 6, FIG. 18, and FIG. 24, the outlets of the second heat transfer tubes 72*b* (second downstream-side heat transfer tubes) and the outlets of the third heat transfer tubes 73*b* (third downstream-side heat transfer tubes) in a case where the indoor heat exchanger 42 functions as an evaporator of the refrigerant during cooling are placed in such a way as to be adjacent to the outlets of other second heat transfer tubes 72*f* (second downstream-side heat transfer tubes) and the outlets of other third heat transfer tubes 73*f* (third downstream-side heat transfer tubes) placed on the upper sides or the lower sides. Additionally, the inlets of the first heat transfer tubes 71*a* (first upstream-side heat transfer tubes) in a case where the indoor heat exchanger 42 functions as an evaporator of the refrigerant during cooling are placed in such a way as to be adjacent to the inlets of other first heat transfer tubes 71*e* (first upstream-side heat transfer tubes) placed on the upper sides or the lower sides.

Figure 24:
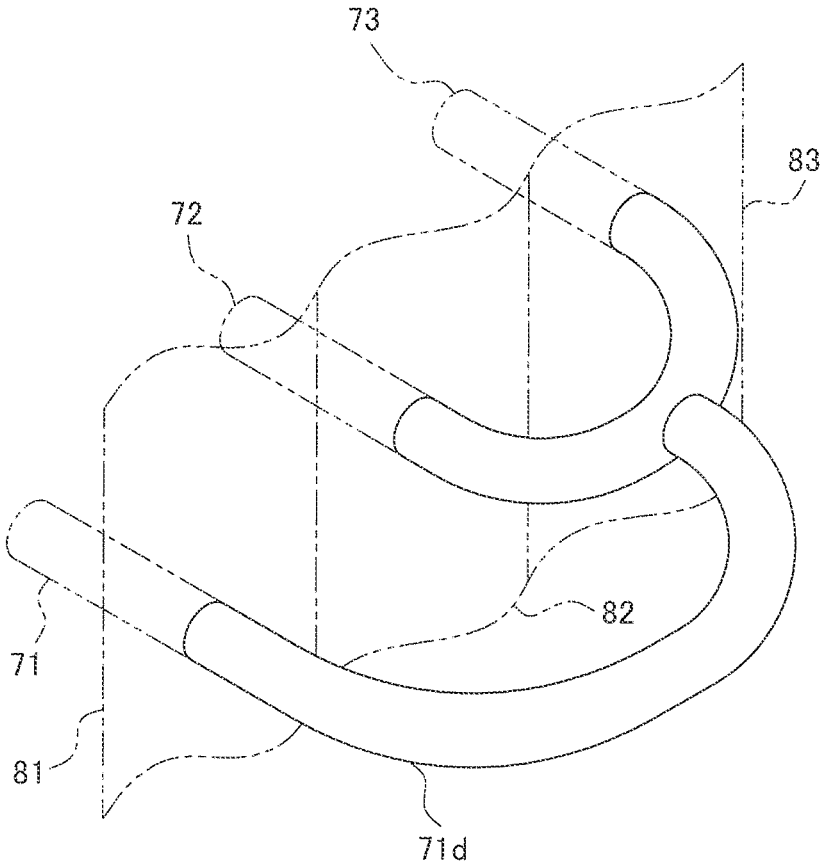
FIG. 24 is a view showing the shape of the inter-row branching portion in modification 9 of the first embodiment.

Specifically, the indoor heat exchanger 42 of the present modification has plural stages (in FIG. 23, only three are illustrated) where first refrigerant paths that are configured as a result of heat transfer tubes in two stages each in three rows being interconnected and second refrigerant paths that are configured as a result of other heat transfer tubes in two stages each in three rows being interconnected alternate. The first refrigerant paths here are the same as the refrigerant paths configuring the indoor heat exchanger 42 of modification 6 (see FIG. 17 and FIG. 18). The second refrigerant paths have the first heat transfer tubes 71*e* which, of the first heat transfer tubes 71, are connected to the liquid refrigerant tubes 91 and placed one stage on the lower sides of the first heat transfer tubes 71*a* configuring the first refrigerant paths. The first heat transfer tubes 71*e* are connected, on the other lengthwise direction end side of the indoor heat exchanger 42, via the U-shaped portions 71*c* (see FIG. 6) to first heat transfer tubes 71*f* that are the first heat transfer tubes 71 placed one stage on the lower sides of the first heat transfer tubes 71*e*. The first heat transfer tubes 71*f* are connected to the inter-row branching portions 71*d* on the one lengthwise direction end side of the indoor heat exchanger 42. The inter-row branching portions 71*d* are portions that cause the refrigerant that has passed through the first heat transfer tubes 71*f* during cooling to branch into two flows. One of the branches of each of the inter-row branching portions 71*d* is connected, on the one lengthwise direction end side of the indoor heat exchanger 42, to the second heat transfer tubes 72*e* which, of the second heat transfer tubes 72, are the second heat transfer tubes 72 placed on the upper sides of the first heat transfer tubes 71*f*. The other of the branches of each of the inter-row branching portions 71*d* is connected, on the one lengthwise direction end side of the indoor heat exchanger 42, to the third heat transfer tubes 73*e* which, of the third heat transfer tubes 73, are the third heat transfer tubes 73 placed on the upper sides of the second heat transfer tubes 72*e*. As shown in FIG. 24, each of the inter-row branching portions 71*d* is a tube portion having a shape where the end portion of a U-shaped tube portion extending from the first heat transfer tube 71 is joined together with the middle portion of a U-shaped tube portion joining together the second heat transfer tube 72 and the third heat transfer tube 73. Here, the position at which the U-shaped tube portion extending from the first heat transfer tube 71 and the U-shaped tube portion joining together the second heat transfer tube 72 and the third heat transfer tube 73 are interconnected is set in such a way that the flow path length from the second heat transfer tube 72 and the flow path length from the third heat transfer tube 73 become the same. The second heat transfer tubes 72*e* are connected, on the other lengthwise direction end side of the indoor heat exchanger 42, via the U-shaped portions 72*c* (see FIG. 6) to the second heat transfer tubes 72*f* that are the second heat transfer tubes 72 placed one stage on the lower sides of the second heat transfer tubes 72*e* and placed one stage on the upper sides of the second heat transfer tubes 72*b* configuring the first refrigerant paths. The third heat transfer tubes 73*e* are connected, on the other lengthwise direction end side of the indoor heat exchanger 42, via the U-shaped portions 73*c* (see FIG. 6) to the third heat transfer tubes 73*f* that are the third heat transfer tubes 73 placed one stage on the lower sides of the third heat transfer tubes 73*e* and placed one stage on the upper sides of the third heat transfer tubes 73*b* configuring the first refrigerant paths. The second heat transfer tubes 72*f* are connected to the second row-side gas refrigerant tubes 92. The third heat transfer tubes 73*b* are connected to the third row-side gas refrigerant tubes 93. Here, the heat transfer tubes 71*e* and 71*f* are configured as single heat transfer tubes bent in the shape of hairpins including the U-shaped portions 71*c*. Further, the heat transfer tubes 72*e* and 72*f* are configured as single heat transfer tubes bent in the shape of hairpins including the U-shaped portions 72*c*. Moreover, the heat transfer tubes 73*e* and 73*f* are configured as single heat transfer tubes bent in the shape of hairpins including the U-shaped portions 73*c*.

For this reason, in this indoor heat exchanger 42, the second heat transfer tubes 72*b* and 72*f* (second downstream-side heat transfer tubes) and the third heat transfer tubes 73*b* and 73*f* (third downstream-side heat transfer tubes) whose temperature becomes higher become placed together on the heat transfer fins 81, 82, and 83, and the first heat transfer tubes 71*a* and 71*e* (first upstream-side heat transfer tubes) whose temperature becomes lower become placed together on the heat transfer fins 81, 82, and 83. Additionally, in this indoor heat exchanger 42, during cooling, it becomes more difficult for the hot thermal energy of the second heat transfer tubes 72*b* and 72*f* (second downstream-side heat transfer tubes) and the third heat transfer tubes 73*b* and 73*f* (third downstream-side heat transfer tubes) to travel via the heat transfer fins 81, 82, and 83 to other portions of the heat transfer fins 81, 82, and 83, and during heating, it becomes more difficult for the cold thermal energy of the first heat transfer tubes 71*a* and 71*e* (first upstream-side heat transfer tubes) to travel via the heat transfer fins 81, 82, and 83 to other portions of the heat transfer fins 81, 82, and 83.

Because of this, in the indoor unit 4 of the present modification, a situation where a drop in the heat exchange efficiency of the indoor heat exchanger 42 during cooling and during heating arises because of heat conduction via the heat transfer fins 81, 82, and 83 can be suppressed as much as possible.

<Indoor Heat Exchanger Pertaining to Second Embodiment>

(1) Structure of Indoor Heat Exchanger

An indoor heat exchanger 42 pertaining to the present embodiment employs a structure where, like the indoor heat exchanger 42 pertaining to the first embodiment and its modifications, as shown in FIG. 3 and FIG. 4, the plural heat transfer tubes 71, 72, and 73 inside of which flows the refrigerant are placed in multiple stages in the vertical direction and, in order to increase performance, are arranged in three rows in the flow direction of the air blown out from the indoor fan 41 serving as the centrifugal blower.

Figure 25:
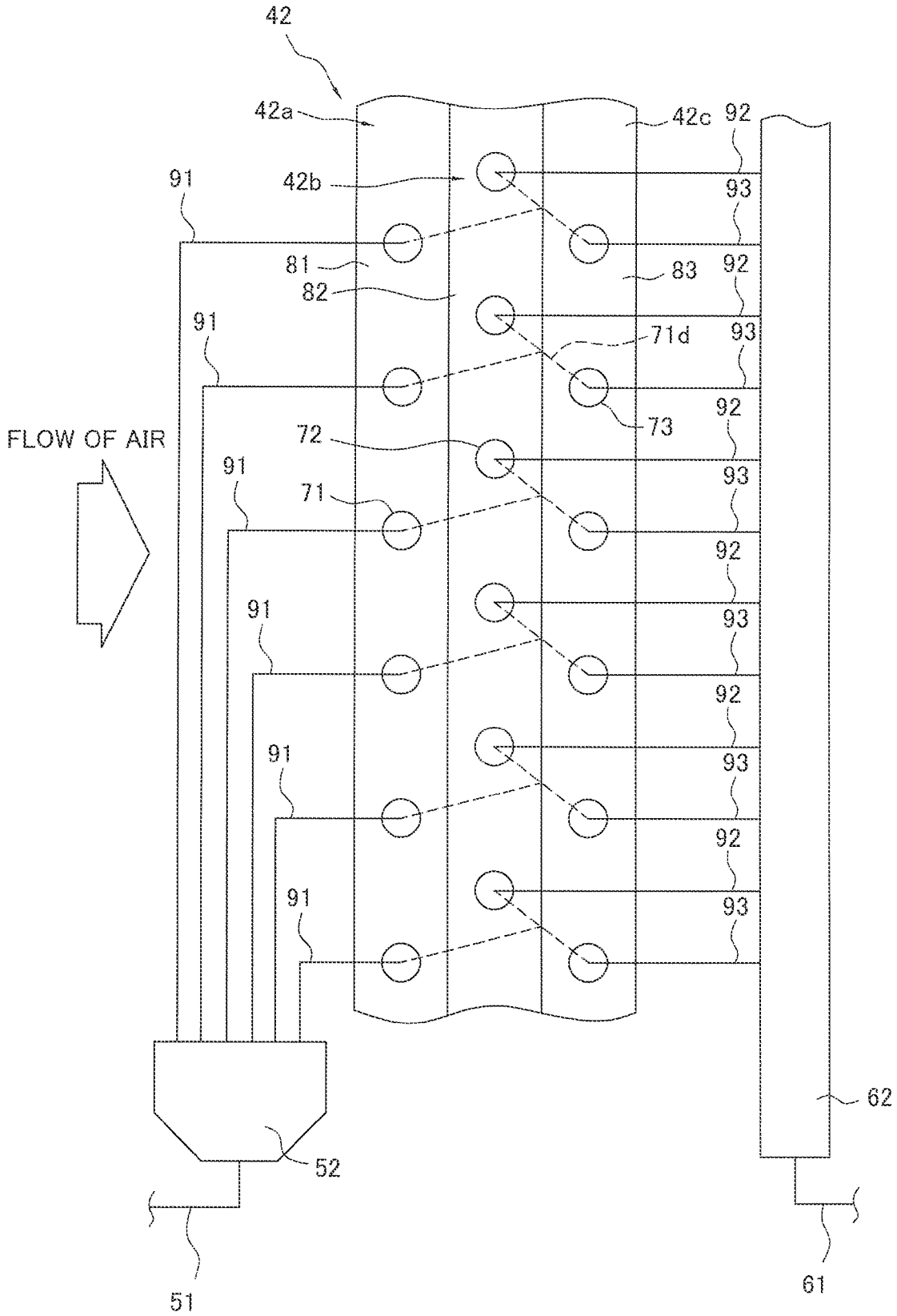
FIG. 25 is a view showing the refrigerant paths in the indoor heat exchanger in the indoor unit serving as the ceiling-mounted air conditioning unit pertaining to a second embodiment.

As shown in FIG. 25, the configurations of the liquid refrigerant tubes 91, the gas refrigerant tubes 92 and 93, and the refrigerant paths in the indoor heat exchanger 42 pertaining to the present embodiment differ from those in the indoor heat exchanger 42 pertaining to the first embodiment and its modifications, but the other configurations are the same as those in the indoor heat exchanger 42 pertaining to the first embodiment and its modifications, so description is omitted here.

A flow divider 52 that becomes a refrigerant inlet of the indoor heat exchanger 42 in a case where the indoor heat exchanger 42 functions as an evaporator of the refrigerant during cooling and becomes a refrigerant outlet of the indoor heat exchanger 42 in a case where the indoor heat exchanger 42 functions as a condenser of the refrigerant during heating is connected to the liquid-side connecting tube 51. Plural (in FIG. 25, only six are illustrated) liquid refrigerant tubes 91 connected to the first heat transfer tubes 71 of the indoor heat exchanger 42 on the one lengthwise direction end side of the indoor heat exchanger 42 are connected to the flow divider 52. Here, the liquid refrigerant tubes 91 comprise capillary tubes.

A header 62 that becomes a refrigerant outlet of the indoor heat exchanger 42 in a case where the indoor heat exchanger 42 functions as an evaporator of the refrigerant during cooling and becomes a refrigerant inlet of the indoor heat exchanger 42 in a case where the indoor heat exchanger 42 functions as a condenser of the refrigerant during heating is connected to the gas-side connecting tube 61. Plural (in FIG. 25, only six are illustrated) second row-side gas refrigerant tubes 92 connected to the second heat transfer tubes 72 of the indoor heat exchanger 42 on the one lengthwise direction end side of the indoor heat exchanger 42 and plural (in FIG. 25, only six are illustrated) third row-side gas refrigerant tubes 93 connected to the heat transfer tubes 73 in the third row of the indoor heat exchanger 42 on the one lengthwise direction end side of the indoor heat exchanger 42 are connected to the header 62.

Figure 26:
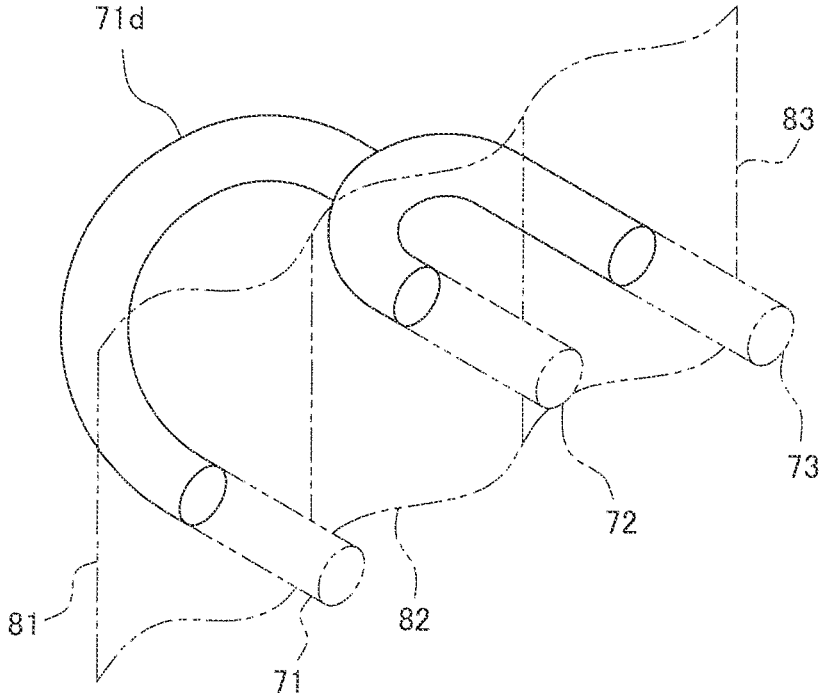
FIG. 26 is a view showing the shape of the inter-row branching portion in the second embodiment.

The indoor heat exchanger 42 has plural stages (in FIG. 25, only six are illustrated) of refrigerant paths that are configured as a result of the heat transfer tubes 71, 72, and 73 in one stage each in three rows being interconnected. Each of the refrigerant paths has the first heat transfer tubes 71 connected to the liquid refrigerant tubes 91. The first heat transfer tubes 71 are connected to inter-row branching portions 71*d* on the other lengthwise direction end side of the indoor heat exchanger 42. The inter-row branching portions 71*d* are portions that cause the refrigerant that has passed through the first heat transfer tubes 71 during cooling to branch into two flows. One of the branches of each of the inter-row branching portions 71*d* is connected, on the other lengthwise direction end side of the indoor heat exchanger 42, to the second heat transfer tubes 72 placed on the upper sides of the first heat transfer tubes 71. The other of the branches of each of the inter-row branching portions 71*d* is connected, on the other lengthwise direction end side of the indoor heat exchanger 42, to the third heat transfer tubes 73 placed on the lower sides of the second heat transfer tubes 72. As shown in FIG. 26, each of the inter-row branching portions 71*d* is a tube portion having a shape where the end portion of a U-shaped tube portion extending from the first heat transfer tube 71 is joined together with the middle portion of a U-shaped tube portion joining together the second heat transfer tube 72 and the third heat transfer tube 73. Here, the position at which the U-shaped tube portion extending from the first heat transfer tube 71 and the U-shaped tube portion joining together the second heat transfer tube 72 and the third heat transfer tube 73 are interconnected is set in such a way that the flow path length from the second heat transfer tube 72 and the flow path length from the third heat transfer tube 73 become the same. The second heat transfer tubes 72 are connected to the second row-side gas refrigerant tubes 92 on the one lengthwise direction end side of the indoor heat exchanger 42. The third heat transfer tubes 73 are connected to the third row-side gas refrigerant tubes 93 on the one lengthwise direction end side of the indoor heat exchanger 42.

Because of this, in the indoor heat exchanger 42 of the present embodiment, in a case where the indoor heat exchanger 42 functions as an evaporator of the refrigerant during cooling, the refrigerant that has traveled through the liquid-side connecting tube 51 and the flow divider 52 serving as the refrigerant inlet during cooling and has passed through the liquid refrigerant tubes 91 is sent to the first heat transfer tubes 71 that are one of the first heat transfer tubes 71 in the first row. The refrigerant that has been sent to the first heat transfer tubes 71 passes through the first heat transfer tubes 71 and, in the outlets of the first heat transfer tubes 71, is thereafter caused by the inter-row branching portions 71*d* to branch into the second heat transfer tubes 72 that are one of the heat transfer tubes 72 in the second row and the third heat transfer tubes 73 that are one of the heat transfer tubes 73 in the third row. Then, the refrigerant that has been sent to the second heat transfer tubes 72 passes through the second heat transfer tubes 72 and is thereafter sent from the outlets of the second heat transfer tubes 72 to the second row-side gas refrigerant tubes 92. Further, the refrigerant that has been sent to the third heat transfer tubes 73 passes through the third heat transfer tubes 73 and is thereafter sent from the outlets of the third heat transfer tubes 73 to the third row-side gas refrigerant tubes 93. The refrigerant that has passed through the second row-side gas refrigerant tubes 92 and the third row-side gas refrigerant tubes 93 is sent to the header 62 and the gas-side connecting tube 61 serving as the refrigerant outlet during cooling.

Further, in the indoor heat exchanger 42 of the present embodiment, in a case where the indoor heat exchanger 42 functions as a condenser of the refrigerant during heating, the refrigerant that has traveled through the gas-side connecting tube 61 and the header 62 serving as the refrigerant inlet during heating and has passed through the second row-side gas refrigerant tubes 92 and the third row-side gas refrigerant tubes 93 is sent to the second heat transfer tubes 72 that are one of the second heat transfer tubes 72 in the second row and the third heat transfer tubes 73 that are one of the third heat transfer tubes 73 in the third row. The refrigerant that has been sent to the second heat transfer tubes 72 passes through the second heat transfer tubes 72. The refrigerant that has been sent to the third heat transfer tubes 73 passes through the third heat transfer tubes 73. The refrigerant that has passed through the second heat transfer tubes 72 and the refrigerant that has passed through the third heat transfer tubes 73 are caused by the inter-row branching portions 71*d* to merge together in the outlets of the second heat transfer tubes 72 and the outlets of the third heat transfer tubes 73 and are sent to the first heat transfer tubes 71 that are one of the first heat transfer tubes 71 in the first row. Then, the refrigerant that has been sent to the first heat transfer tubes 71 passes through the first heat transfer tubes 71 and is thereafter sent to the liquid refrigerant tubes 91. The refrigerant that has passed through the liquid refrigerant tubes 91 is sent to the flow divider 52 and the liquid-side connecting tube 51 serving as the refrigerant outlet during heating.

(2) Characteristics of Indoor Unit Having Indoor Heat Exchanger

The indoor unit 4 serving as the ceiling-mounted air conditioning unit having the indoor heat exchanger 42 of the present embodiment has the following characteristics.

(A)

The indoor heat exchanger 42 of the present embodiment has a structure where the plural liquid refrigerant tubes 91 connected to the refrigerant inlet of the indoor heat exchanger 42 in a case where the indoor heat exchanger 42 functions as an evaporator of the refrigerant during cooling are connected to the heat transfer tubes 71 in the first row that is the row on the most upwind side in the flow direction of the air. Further, this indoor heat exchanger 42 has a structure where the second row-side gas refrigerant tubes 92 that are some of the plural gas refrigerant tubes 92 and 93 connected to the refrigerant outlet of the indoor heat exchanger 42 during cooling are connected to the heat transfer tubes 72 in the second row in the flow direction of the air. Moreover, this indoor heat exchanger 42 has a structure where the third row-side gas refrigerant tubes 93 that are the rest of the plural gas refrigerant tubes 92 and 93 are connected to the heat transfer tubes 73 in the third row that is the row on the most downwind side in the flow direction of the air.

For this reason, in the indoor unit 4 of the present embodiment, during cooling, some of the refrigerant inflowing from the refrigerant inlet during cooling of the indoor heat exchanger 42 is sent to the second row-side gas refrigerant tubes 92 immediately after performing heat exchange with the air crossing the heat transfer tubes 72 in the second row whose temperature is higher than that of the air crossing the heat transfer tubes 73 in the third row. Further, in this indoor unit 4, during cooling, the rest of the refrigerant inflowing from the refrigerant inlet during cooling of the indoor heat exchanger 42 is sent to the third row-side gas refrigerant tubes 93 immediately after performing heat exchange with the air crossing the heat transfer tubes 73 in the third row. Additionally, the refrigerant that has passed through the second row-side gas refrigerant tubes 92 and the refrigerant that has passed through the third row-side gas refrigerant tubes 93 merge together and exit from the refrigerant outlet during cooling of the indoor heat exchanger 42. Here, the degree of superheat of the refrigerant immediately after performing heat exchange with the air crossing the heat transfer tubes 72 in the second row easily becomes larger than the degree of superheat of the refrigerant immediately after performing heat exchange with the air crossing the heat transfer tubes 73 in the third row because it is affected by the temperature of the air crossing the heat transfer tubes 72 in the second row.

Because of this, in this indoor unit 4, it becomes easier for the degree of superheat of the refrigerant exiting from the refrigerant outlet during cooling of the indoor heat exchanger 42 to become larger compared to the case of employing a structure where all of the gas refrigerant tubes 92 and 93 are connected to the heat transfer tubes 73 in the third row, and the heat exchange efficiency during cooling can be improved.

Further, in this indoor unit 4, during heating, all the refrigerant inflowing from the refrigerant inlet during heating of the indoor heat exchanger 42 is sent to the liquid refrigerant tubes 91 immediately after performing heat exchange with the air crossing the heat transfer tubes 71 in the first row whose temperature is the lowest.

Because of this, in this indoor unit 4, it becomes difficult for the degree of subcooling in the refrigerant outlet during heating of the indoor heat exchanger 42 to become smaller, and a drop in the heat exchange efficiency during heating can be suppressed.

As described above, in this indoor unit 4, it can be made more difficult for the degree of subcooling in the refrigerant outlet of the indoor heat exchanger 42 during heating to become smaller and it can also be made easier for the degree of superheat of the refrigerant exiting from the refrigerant outlet of the indoor heat exchanger 42 during cooling to become larger, and the heat exchange efficiency of the indoor heat exchanger 42 during cooling can be improved while suppressing a drop in the heat exchange efficiency of the indoor heat exchanger 42 during heating.

(B)

In the indoor heat exchanger 42 of the present embodiment, the liquid refrigerant tubes 91, the second row-side gas refrigerant tubes 92, and the third row-side gas refrigerant tubes 93 are connected to the lengthwise direction single ends of the corresponding heat transfer tubes 71, 72, and 73.

Because of this, in the indoor unit 4 of the present embodiment, the work of connecting the liquid refrigerant tubes 91, the second row-side gas refrigerant tubes 92, and the third row-side gas refrigerant tubes 93 to the heat transfer tubes 71, 72, and 73 can be consolidated and performed on the one lengthwise direction end side of the indoor heat exchanger 42, so the assemblability of the indoor heat exchanger 42 improves.

(C)

The indoor heat exchanger 42 of the present embodiment has the inter-row branching portions 71*d* that cause the refrigerant that has been sent to the outlets of the heat transfer tubes 71 in the first row during cooling to branch to the heat transfer tubes 72 in the second row and the heat transfer tubes 73 in the third row. Additionally, the outlets of the heat transfer tubes 72 in the second row in a case where the indoor heat exchanger 42 functions as an evaporator of the refrigerant during cooling are connected to the second row-side gas refrigerant tubes 92. Further, the outlets of the heat transfer tubes 73 in the third row in a case where the indoor heat exchanger 42 functions as an evaporator of the refrigerant during cooling are connected to the third row-side gas refrigerant tubes 93.

In this indoor heat exchanger 42, during cooling, the refrigerant that has become gas-rich because of heat exchange with the air in the heat transfer tubes 71 in the first row is caused to branch into and is sent through the heat transfer tubes 72 in the second row and the heat transfer tubes 73 in the third row, so an increase in the flow speed of the refrigerant that has become gas-rich can be suppressed. Further, in this indoor heat exchanger 42, during heating, the refrigerant that has become liquid-rich because of heat exchange with the air in the heat transfer tubes 72 in the second row and the refrigerant that has become liquid-rich because of heat exchange with the air in the heat transfer tubes 73 in the third row are caused to merge together and become sent to the heat transfer tubes 71 in the first row, so the flow speed of the refrigerant that has become liquid-rich can be increased to thereby increase the heat transfer coefficient in the heat transfer tubes 71 in the first row.

Because of this, in the indoor unit 4 of the present embodiment, an increase in pressure drop can be suppressed as a result of the inter-row branching portions 71*d* causing the flow of the refrigerant to branch, so the heat exchange efficiency of the indoor heat exchanger 42 during cooling can be further improved. In particular, in this indoor unit 4, an increase in the flow speed of the refrigerant in the heat transfer tubes 72 in the second row and the heat transfer tubes 73 in the third row through which flows the gas-rich refrigerant whose effect with respect to pressure drop is large is suppressed, so the heat exchange efficiency of the indoor heat exchanger 42 during cooling can be effectively improved. Further, in this indoor unit 4, the heat transfer coefficient is increased by increasing the flow speed of the refrigerant in the heat transfer tubes 71 in the first row through which flows the liquid-rich refrigerant whose effect with respect to pressure drop is small, so it becomes easier for the degree of subcooling in the refrigerant outlet during heating of the indoor heat exchanger 42 to become larger, and a drop in the heat exchange efficiency during heating can be further suppressed.

(D)

In the indoor heat exchanger 42 of the present embodiment, the refrigerant flows in such a way that, after heading from the one lengthwise direction end of the indoor heat exchanger 42 to the other end, it is caused to branch or merges together in the inter-row branching portions 71*d* at the other lengthwise direction end of the indoor heat exchanger 42 and turns back from the other lengthwise direction end of the indoor heat exchanger 42 to the one end. For this reason, the paths on which the refrigerant flows become short paths where the refrigerant makes one round trip in the lengthwise direction through the indoor heat exchanger 42.

Because of this, in the indoor unit 4 of the present embodiment, an increase in pressure drop can be suppressed, so the heat exchange efficiency of the indoor heat exchanger 42 during cooling can be further improved, and a drop in the heat exchange efficiency of the indoor heat exchanger 42 during heating can be further suppressed.

(3) Modification 1

In the indoor heat exchanger 42 configuring the indoor unit 4 described above (see FIG. 25), the inter-row branching portions 71*d* are connected, on the other lengthwise direction end side of the indoor heat exchanger 42, to the second heat transfer tubes 72 and the third heat transfer tubes 73 placed on the lower sides of the second heat transfer tubes 72.

Figure 27:
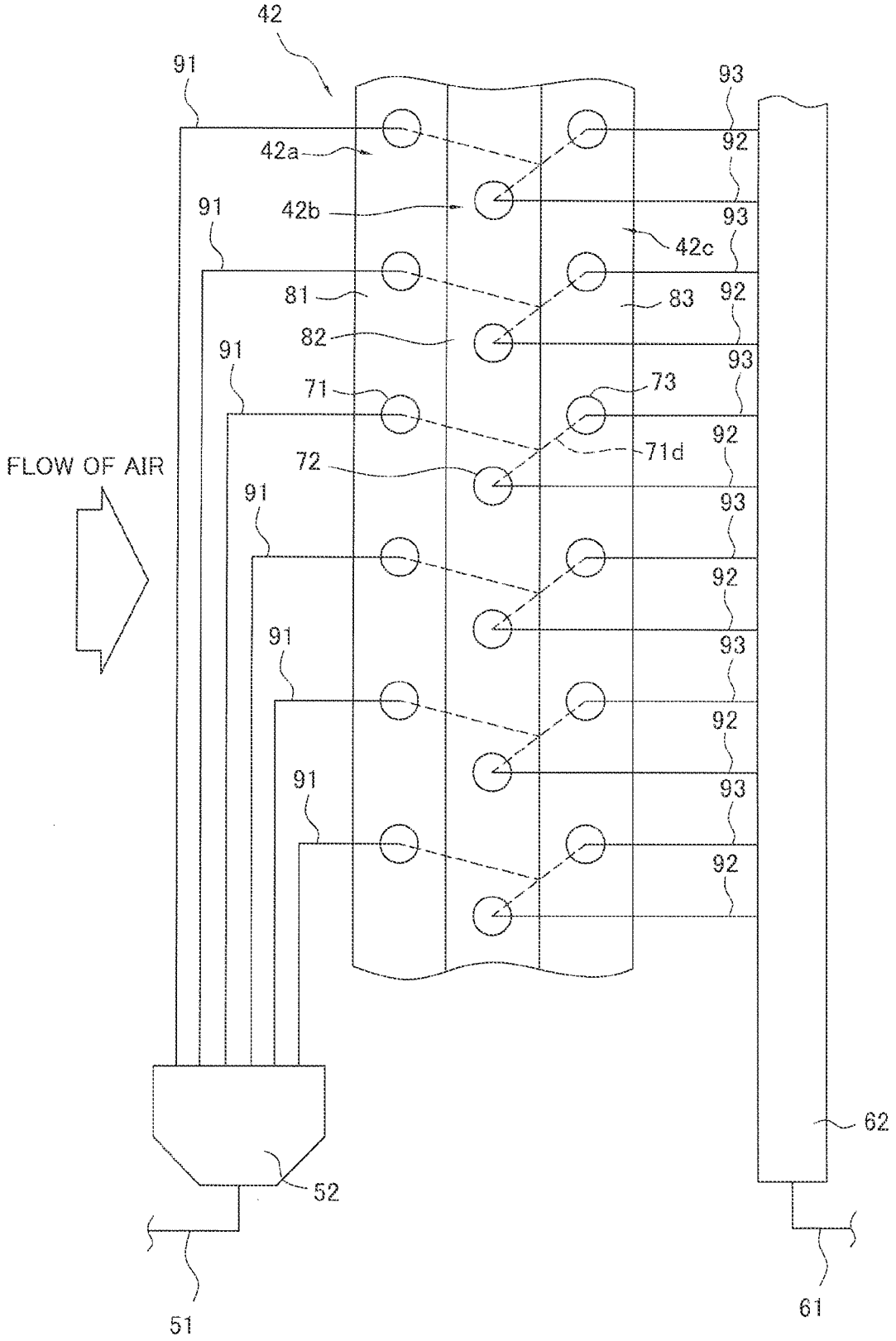
FIG. 27 is a view showing the refrigerant paths in the indoor heat exchanger in the indoor unit serving as the ceiling-mounted air conditioning unit pertaining to modification 1 of the second embodiment.
Figure 28:
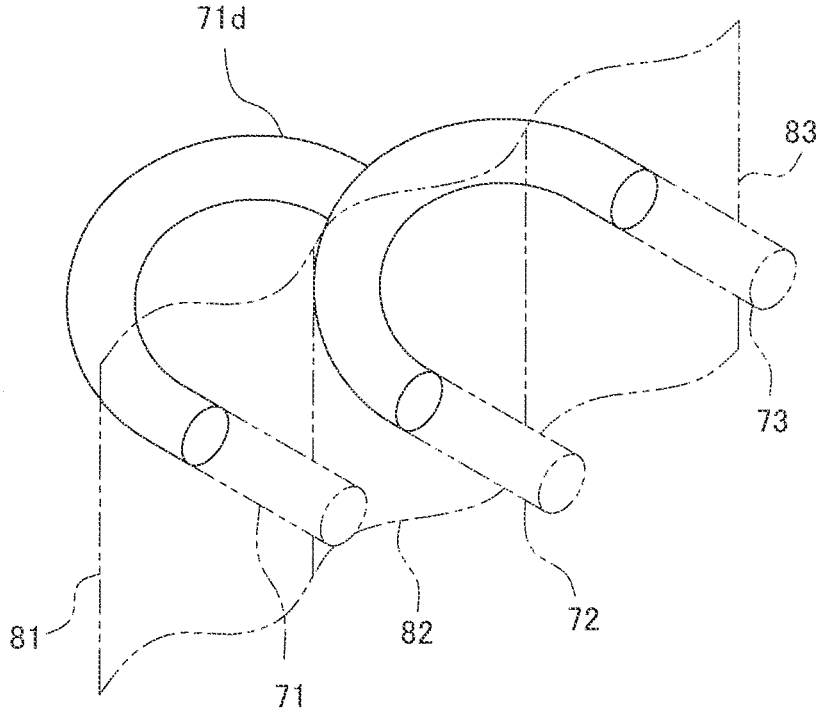
FIG. 28 is a view showing the shape of the inter-row branching portion in modification 1 of the second embodiment.

In contrast, in the indoor heat exchanger 42 configuring the indoor unit 4 of the present modification, as shown in FIG. 27 and FIG. 28, the second heat transfer tubes 72 to which the inter-row branching portions 71*d* are connected are placed on the lower sides of the third heat transfer tubes 73 to which the inter-row branching portions 71*d* are connected.

For this reason, in this indoor heat exchanger 42, during cooling, it becomes easier for more of the refrigerant to flow into the second heat transfer tubes 72 than the third heat transfer tubes 73 because of the action of gravity.

Because of this, in the indoor unit 4 of the present modification, it becomes easier for the degree of superheat of the refrigerant exiting from the refrigerant outlet during cooling of the indoor heat exchanger 42 to become larger, and the heat exchange efficiency of the indoor heat exchanger 42 during cooling can be further improved.

(4) Modification 2

In the indoor heat exchanger 42 configuring the indoor unit 4 described above (see FIG. 25), the inter-row branching portions 71*d* are formed in such a way that the flow path length from the outlets of the first heat transfer tubes 71 to the inlets of the second heat transfer tubes 72 and the flow path length from the outlets of the first heat transfer tubes 71 to the inlets of the third heat transfer tubes 73 in a case where the indoor heat exchanger 42 functions as an evaporator of the refrigerant during cooling become the same.

Figure 29:
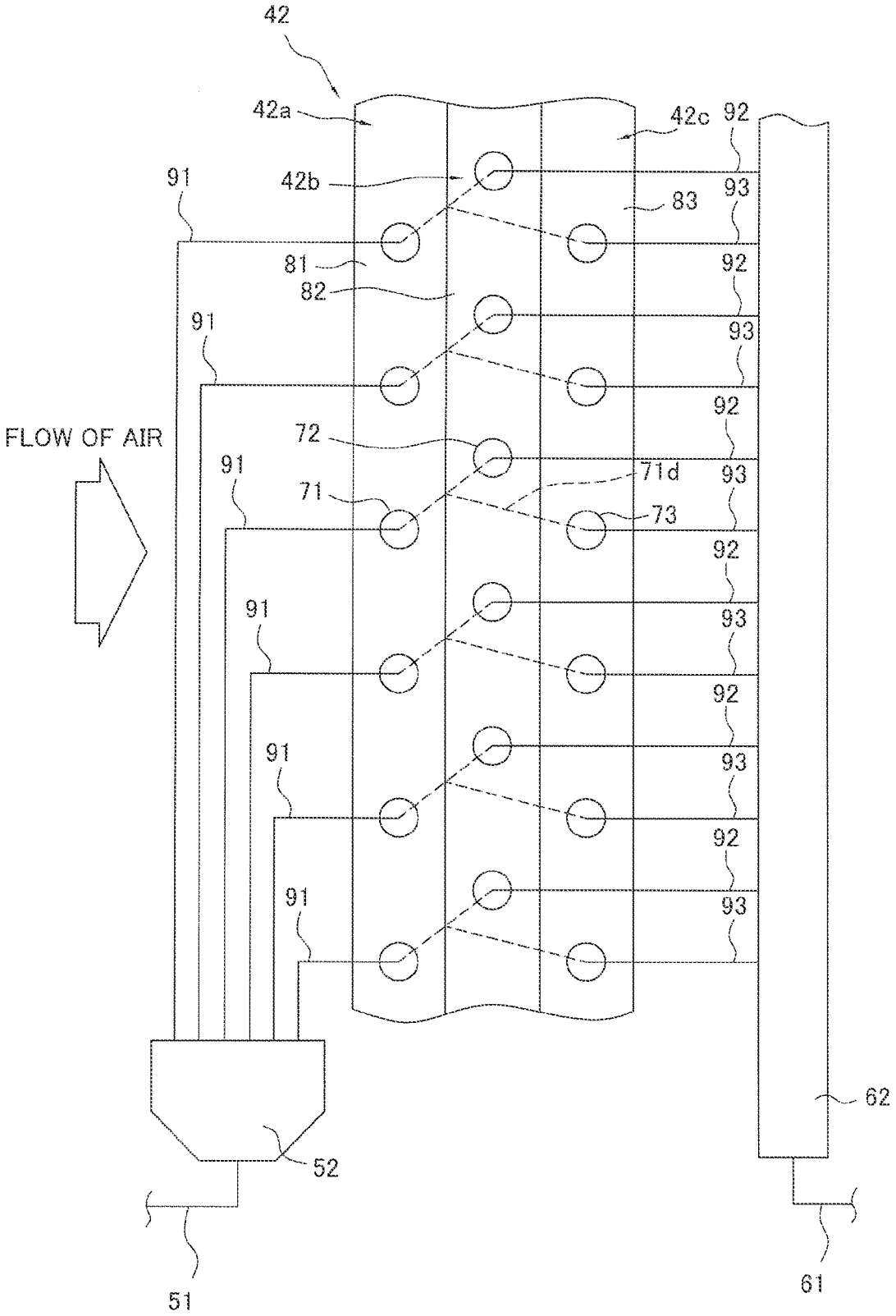
FIG. 29 is a view showing the refrigerant paths in the indoor heat exchanger in the indoor unit serving as the ceiling-mounted air conditioning unit pertaining to modification 2 of the second embodiment.
Figure 30:
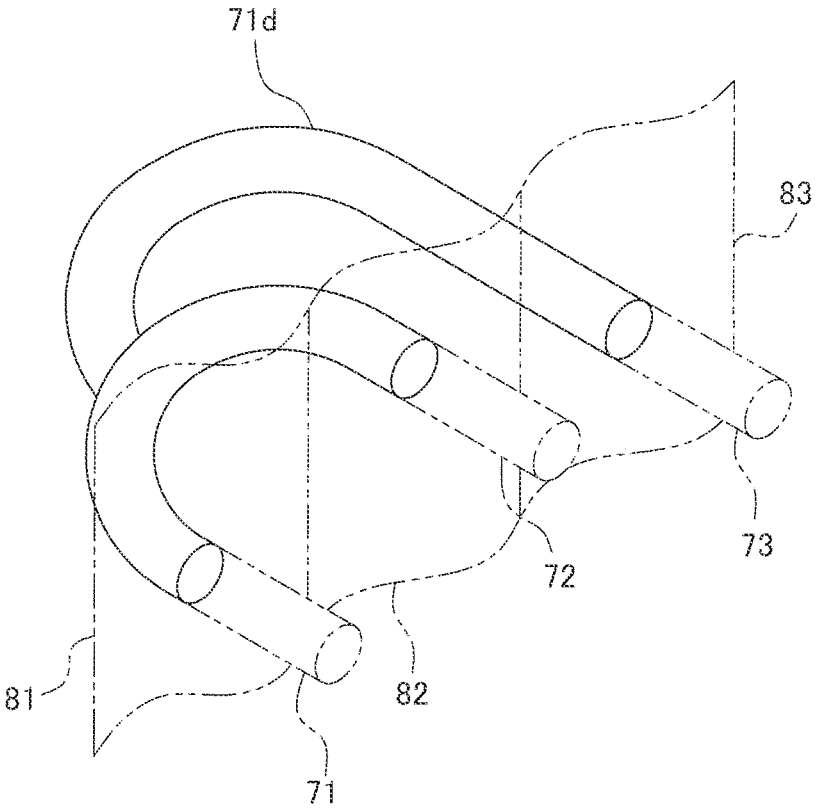
FIG. 30 is a view showing the shape of the inter-row branching portion in modification 2 of the second embodiment.

In contrast, in the indoor heat exchanger 42 configuring the indoor unit 4 of the present modification, as shown in FIG. 29 and FIG. 30, the inter-row branching portions 71*d* are formed in such a way that the flow path length from the outlets of the first heat transfer tubes 71 to the inlets of the third heat transfer tubes 73 becomes longer than the flow path length from the outlets of the first heat transfer tubes 71 to the inlets of the second heat transfer tubes 72 in a case where the indoor heat exchanger 42 functions as an evaporator of the refrigerant during cooling. More specifically, in the present modification, as shown in FIG. 30, each of the inter-row branching portions 71*d* is made into a tube portion having a shape where the end portion of a U-shaped tube portion extending from the third heat transfer tube 73 is joined together with the middle portion of a U-shaped tube portion joining together the first heat transfer tube 71 and the second heat transfer tube 72.

For this reason, in this indoor heat exchanger 42, during cooling, it becomes easier for more of the refrigerant to flow into the second heat transfer tubes 72 where the flow path resistance from the outlets of the first heat transfer tubes 71 through the inter-row branching portions 71*d* to the inlets of the second heat transfer tubes 72 is small.

Because of this, in the indoor unit 4 of the present modification, it becomes easier for the degree of superheat of the refrigerant exiting from the refrigerant outlet during cooling of the indoor heat exchanger 42 to become larger, and the heat exchange efficiency of the indoor heat exchanger 42 during cooling can be further improved.

(5) Modification 3

The characteristics of modification 1 and the characteristics of modification 2 may also be combined and applied with respect to the indoor heat exchanger 42 configuring the indoor unit 4 described above (see FIG. 25).

Figure 31:
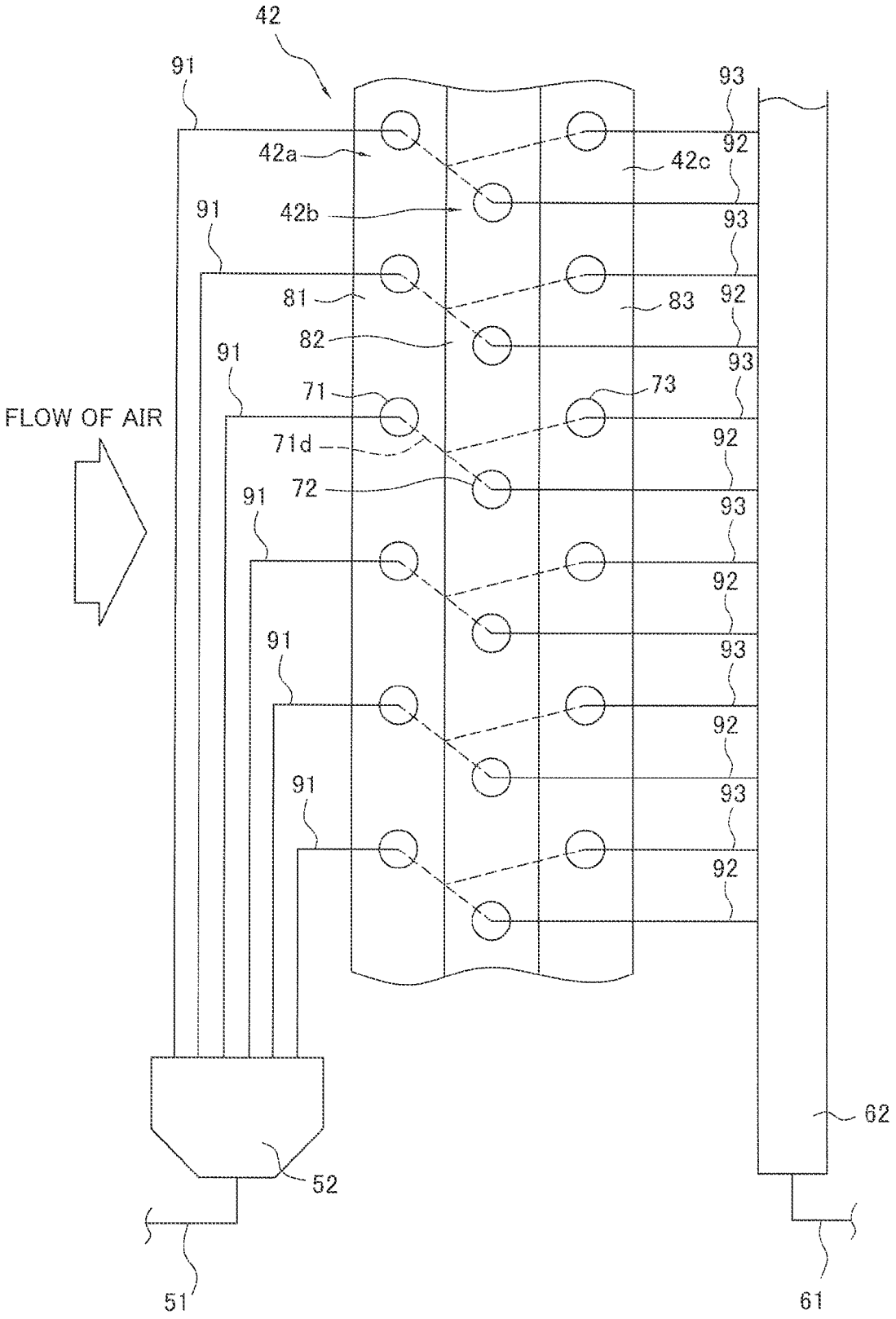
FIG. 31 is a view showing the refrigerant paths in the indoor heat exchanger in the indoor unit serving as the ceiling-mounted air conditioning unit pertaining to modification 3 of the second embodiment.
Figure 32:
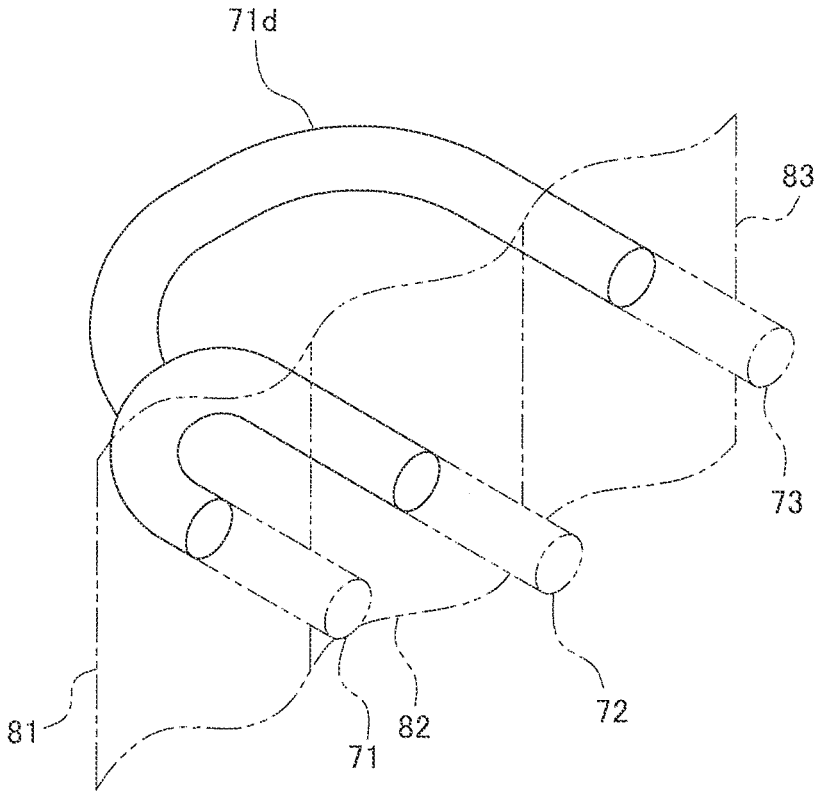
FIG. 32 is a view showing the shape of the inter-row branching portion in modification 3 of the second embodiment.

That is, in the indoor heat exchanger 42 configuring the indoor unit 4 of the present modification, as shown in FIG. 31 and FIG. 32, like in modification 1, the second heat transfer tubes 72 to which the inter-row branching portions 71*d* are connected are placed on the lower sides of the third heat transfer tubes 73 to which the inter-row branching portions 71*d* are connected. Moreover, in the indoor heat exchanger 42 configuring the indoor unit 4 of the present modification, like in the modification 2, the inter-row branching portions 71*d* are formed in such a way that the flow path length from the outlets of the first heat transfer tubes 71 to the inlets of the third heat transfer tubes 73 becomes longer than the flow path length from the outlets of the first heat transfer tubes 71 to the inlets of the second heat transfer tubes 72 in a case where the indoor heat exchanger 42 functions as an evaporator of the refrigerant during cooling.

Because of this, in the indoor unit 4 of the present modification, both the action and effects of modification 1 and the action and effects of modification 2 can be obtained.

<Indoor Heat Exchanger Pertaining to Third Embodiment>

(1) Structure of Indoor Heat Exchanger

An indoor heat exchanger 42 pertaining to the present embodiment employs a structure where, like the indoor heat exchanger 42 pertaining to the first embodiment and its modifications and the second embodiment and its modifications, as shown in FIG. 3 and FIG. 4, the plural heat transfer tubes 71, 72, and 73 inside of which flows the refrigerant are placed in multiple stages in the vertical direction and, in order to increase performance, are arranged in three rows in the flow direction of the air blown out from the indoor fan 41 serving as the centrifugal blower.

Figure 33:
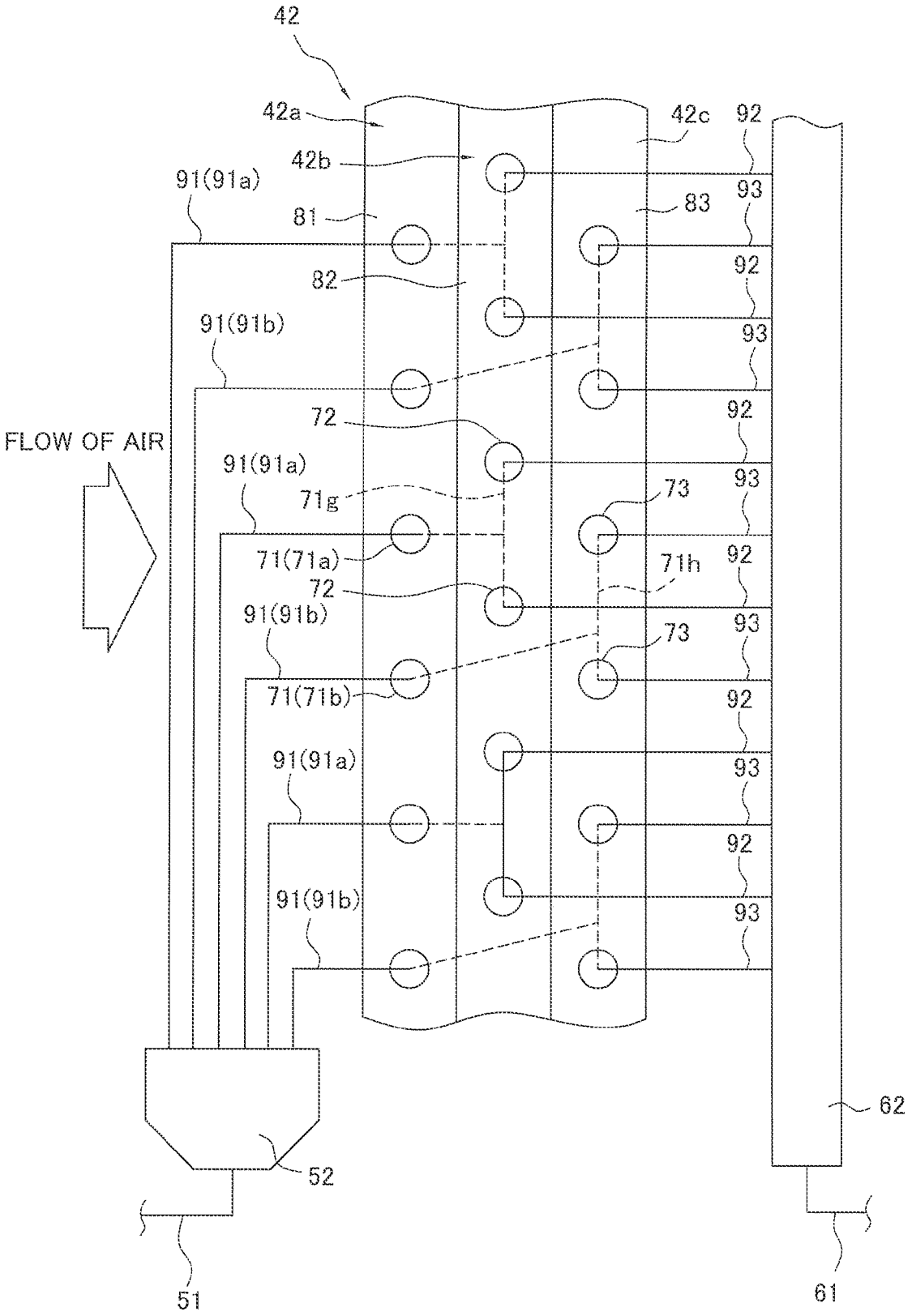
FIG. 33 is a view showing the refrigerant paths in the indoor heat exchanger in the indoor unit serving as the ceiling-mounted air conditioning unit pertaining to a third embodiment.

As shown in FIG. 33, the configurations of the liquid refrigerant tubes 91, the gas refrigerant tubes 92 and 93, and the refrigerant paths in the indoor heat exchanger 42 pertaining to the present embodiment differ from those in the indoor heat exchanger 42 pertaining to the first embodiment and its modifications and the second embodiment and its modifications, but the other configurations are the same as those in the indoor heat exchanger 42 pertaining to the first embodiment and its modifications and the second embodiment and its modifications, so description is omitted here.

A flow divider 52 that becomes a refrigerant inlet of the indoor heat exchanger 42 in a case where the indoor heat exchanger 42 functions as an evaporator of the refrigerant during cooling and becomes a refrigerant outlet of the indoor heat exchanger 42 in a case where the indoor heat exchanger 42 functions as a condenser of the refrigerant during heating is connected to the liquid-side connecting tube 51. Second row-side liquid refrigerant tubes 91*a* (in FIG. 33, only three are illustrated) that are the liquid refrigerant tubes 91 connected on the one lengthwise direction end side of the indoor heat exchanger 42 to second row-side heat transfer tubes 71*a* that are one of the first heat transfer tubes 71 of the indoor heat exchanger 42 are connected to the flow divider 52. Further, third row-side liquid refrigerant tubes 91*b* (in FIG. 33, only three are illustrated) that are the liquid refrigerant tubes 91 connected on the one lengthwise direction end side of the indoor heat exchanger 42 to third row-side heat transfer tubes 71*b* that the first heat transfer tubes 71 apart from the second row-side heat transfer tubes 71*a* of the indoor heat exchanger 42 are connected to the flow divider 52. Here, the second row-side liquid refrigerant tubes 91*a* and the third row-side liquid refrigerant tubes 91*b* comprise capillary tubes.

A header 62 that becomes a refrigerant outlet of the indoor heat exchanger 42 in a case where the indoor heat exchanger 42 functions as an evaporator of the refrigerant during cooling and becomes a refrigerant inlet of the indoor heat exchanger 42 in a case where the indoor heat exchanger 42 functions as a condenser of the refrigerant during heating is connected to the gas-side connecting tube 61. Plural (in FIG. 33, only six are illustrated) second row-side gas refrigerant tubes 92 connected to the second heat transfer tubes 72 of the indoor heat exchanger 42 on the one lengthwise direction end side of the indoor heat exchanger 42 and plural (in FIG. 33, only six are illustrated) third row-side gas refrigerant tubes 93 connected to the heat transfer tubes 73 in the third row of the indoor heat exchanger 42 on the one lengthwise direction end side of the indoor heat exchanger 42 are connected to the header 62.

Figure 34:
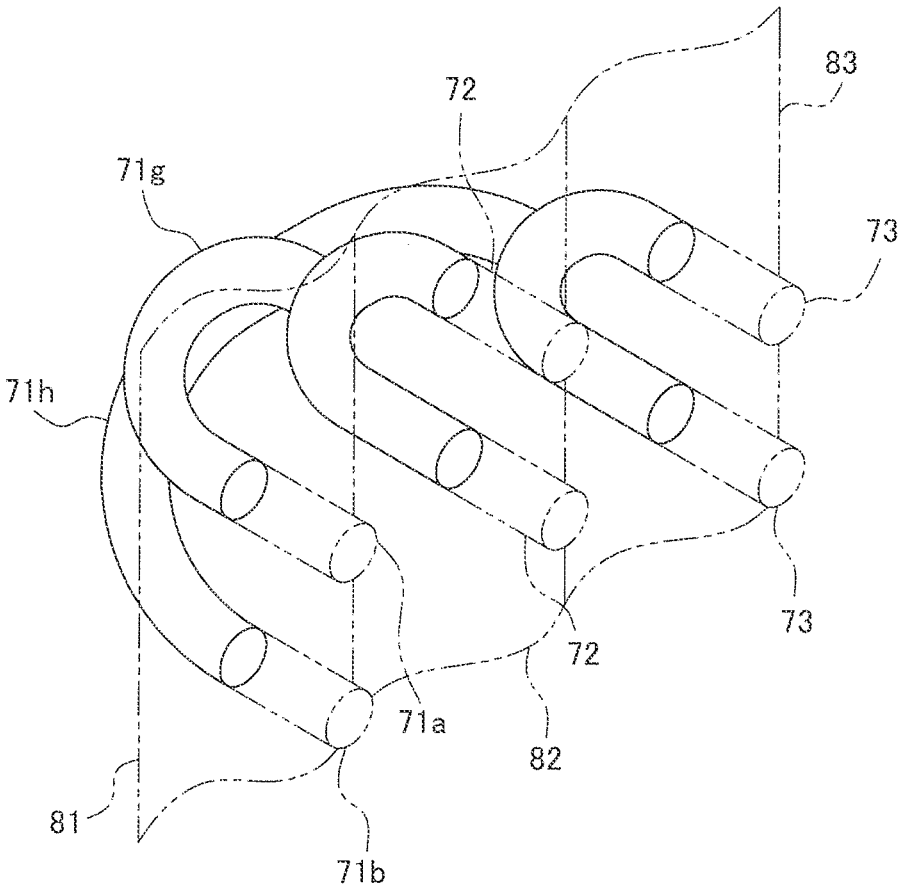
FIG. 34 is a view showing the shape of an in-second-row branching portion and the shape of an in-third-row branching portion in the third embodiment.

The indoor heat exchanger 42 has first refrigerant paths that are configured as a result of the heat transfer tubes 71 and 72 in two stages each in two rows being interconnected and second refrigerant paths that are configured as a result of the heat transfer tubes 71 and 73 in two stages each in two rows being interconnected. The first refrigerant paths and the second refrigerant paths are alternately placed in plural stages (in FIG. 33, only three each are illustrated). The first refrigerant paths have the second row-side heat transfer tubes 71*a* which, of the first heat transfer tubes 71, are connected to the second row-side liquid refrigerant tubes 91*a*. The second row-side heat transfer tubes 71*a* are connected to in-second-row branching portions 71*g* on the other lengthwise direction end side of the indoor heat exchanger 42. The in-second-row branching portions 71*g* are portions that cause the refrigerant that has passed through the second row-side heat transfer tubes 71*a* during cooling to branch into two flows. One of the branches of each of the in-second-row branching portions 71*g* is connected, on the other lengthwise direction end side of the indoor heat exchanger 42, to the second heat transfer tubes 72 placed one stage on the upper sides of the second row-side heat transfer tubes 71*a*. The other of the branches of each of the in-second-row branching portions 71*g* is connected, on the other lengthwise direction end side of the indoor heat exchanger 42, to the second heat transfer tubes 72 placed one stage on the lower sides of the second row-side heat transfer tubes 71*a*. As shown in FIG. 34, each of the in-second-row branching portions 71*g* is a tube portion having a shape where the end portion of a U-shaped tube portion extending from the second row-side heat transfer tube 71*a* is joined together with the middle portion of a U-shaped tube portion joining together the two second heat transfer tubes 72. The two second heat transfer tubes 72 are connected to the second row-side gas refrigerant tubes 92 on the one lengthwise direction end side of the indoor heat exchanger 42. The second refrigerant paths have the third row-side heat transfer tubes 71*b* which, of the first heat transfer tubes 71, are connected to the third row-side liquid refrigerant tubes 91*b*. The third row-side heat transfer tubes 71*b* are connected to in-third-row branching portions 71*h* on the other lengthwise direction end side of the indoor heat exchanger 42. The in-third-row branching portions 71*h* are portions that cause the refrigerant that has passed through the third row-side heat transfer tubes 71*b* during cooling to branch into two flows. One of the branches of each of the in-third-row branching portions 71*h* is connected, on the other lengthwise direction end side of the indoor heat exchanger 42, to the third heat transfer tubes 73 placed two stages on the upper sides of the third row-side heat transfer tubes 71*h*. The other of the branches of each of the in-third-row branching portions 71*h* is connected, on the other lengthwise direction end side of the indoor heat exchanger 42, to the third heat transfer tubes 73 placed on the same stage as the third row-side heat transfer tubes 71*b*. As shown in FIG. 34, each of the in-third-row branching portions 71*h* is a tube portion having a shape where the end portion of a U-shaped tube portion extending from the third row-side heat transfer tube 71*b* is joined together with the middle portion of a U-shaped tube portion joining together the two third heat transfer tubes 73. The two third heat transfer tubes 73 are connected to the third row-side gas refrigerant tubes 93 on the one lengthwise direction end side of the indoor heat exchanger 42.

Because of this, in the indoor heat exchanger 42 of the present embodiment, in a case where the indoor heat exchanger 42 functions as an evaporator of the refrigerant during cooling, the refrigerant that has traveled through the liquid-side connecting tube 51 and the flow divider 52 serving as the refrigerant inlet during cooling and has passed through the second row-side liquid refrigerant tubes 91*a* that are some of the plural liquid refrigerant tubes 91 is sent to the second row-side heat transfer tubes 71*a* that are one of the heat transfer tubes 71 in the first row. The refrigerant that has been sent to the second row-side heat transfer tubes 71*a* passes through the second row-side heat transfer tubes 71*a* and, in the outlets of the second row-side heat transfer tubes 71*a*, is thereafter caused by the in-second-row branching portions 71*g* to branch into the two second heat transfer tubes 72 in the second row. Then, the refrigerant that has been sent to the two second heat transfer tubes 72 passes through each of the second heat transfer tubes 72 and is thereafter sent from the outlets of each of the second heat transfer tubes 72 to the second row-side gas refrigerant tubes 92. Further, the refrigerant that has traveled through the liquid-side connecting tube 51 and the flow divider 52 serving as the refrigerant inlet during cooling and has passed through the third row-side liquid refrigerant tubes 91*b* that are the rest of the plural liquid refrigerant tubes 91 is sent to the third row-side heat transfer tubes 71*b* that are the heat transfer tubes 71 in the first row apart from the second row-side heat transfer tubes 71*a*. The refrigerant that has been sent to the third row-side heat transfer tubes 71*b* passes through the third row-side heat transfer tubes 71*b* and, in the outlets of the third row-side heat transfer tubes 71*b*, is thereafter caused by the in-third-row branching portions 71*h* to branch into the two third heat transfer tubes 73 in the third row. Then, the refrigerant that has been sent to the two third heat transfer tubes 73 passes through each of the third heat transfer tubes 73 and is thereafter sent from the outlets of each of the third heat transfer tubes 73 to the third row-side gas refrigerant tubes 93. The refrigerant that has passed through the second row-side gas refrigerant tubes 92 and the third row-side gas refrigerant tubes 93 is sent to the header 62 and the gas-side connecting tube 61 serving as the refrigerant outlet during cooling.

Further, in the indoor heat exchanger 42 of the present embodiment, in a case where the indoor heat exchanger 42 functions as a condenser of the refrigerant during heating, the refrigerant that has traveled through the gas-side connecting tube 61 and the header 62 serving as the refrigerant inlet during heating and has passed through the second row-side gas refrigerant tubes 92 is sent to the two second heat transfer tubes 72 in the second row. The refrigerant that has passed through the two second heat transfer tubes 72 is caused by the in-second-row branching portions 71*g* to merge together in the outlets of the two second heat transfer tubes 72 and is sent to the second row-side heat transfer tubes 71*a* that are one of the first heat transfer tubes 71 in the first row. Then, the refrigerant that has been sent to the second row-side heat transfer tubes 71*a* passes through the second row-side heat transfer tubes 71*a* and is thereafter sent to the second row-side liquid refrigerant tubes 91*a*. Further, the refrigerant that has traveled through the gas-side connecting tube 61 and the header 62 serving as the refrigerant inlet during heating and has passed through the third row-side gas refrigerant tubes 93 is sent to the two third heat transfer tubes 73 in the third row. The refrigerant that has passed through the two third heat transfer tubes 73 is caused by the in-third-row branching portions 71*h* to merge together in the outlets of the two third heat transfer tubes 73 and is sent to the third row-side heat transfer tubes 71*b* that are the heat transfer tubes 71 in the first row apart from the second row-side heat transfer tubes 71*a*. Then, the refrigerant that has been sent to the third row-side heat transfer tubes 71*b* passes through the third row-side heat transfer tubes 71*b* and is thereafter sent to the third row-side liquid refrigerant tubes 91. Then, the refrigerant that has passed through the second row-side liquid refrigerant tubes 91*a* and the refrigerant that has passed through the third row-side liquid refrigerant tubes 91*b* are sent to the flow divider 52 and the liquid-side connecting tube 51 serving as the refrigerant outlet during heating.

(2) Characteristics of Indoor Unit Having Indoor Heat Exchanger

The indoor unit 4 serving as the ceiling-mounted air conditioning unit having the indoor heat exchanger 42 of the present embodiment has the following characteristics.

(A)

The indoor heat exchanger 42 of the present embodiment has a structure where the plural liquid refrigerant tubes 91 connected to the refrigerant inlet of the indoor heat exchanger 42 in a case where the indoor heat exchanger 42 functions as an evaporator of the refrigerant during cooling are connected to the heat transfer tubes 71 in the first row that is the row on the most upwind side in the flow direction of the air. Further, this indoor heat exchanger 42 has a structure where the second row-side gas refrigerant tubes 92 that are some of the plural gas refrigerant tubes 92 and 93 connected to the refrigerant outlet of the indoor heat exchanger 42 during cooling are connected to the heat transfer tubes 72 in the second row in the flow direction of the air. Moreover, this indoor heat exchanger 42 has a structure where the third row-side gas refrigerant tubes 93 that are the rest of the plural gas refrigerant tubes 92 and 93 are connected to the heat transfer tubes 73 in the third row that is the row on the most downwind side in the flow direction of the air.

For this reason, in the indoor unit 4 of the present embodiment, during cooling, some of the refrigerant inflowing from the refrigerant inlet during cooling of the indoor heat exchanger 42 is sent to the second row-side gas refrigerant tubes 92 immediately after performing heat exchange with the air crossing the heat transfer tubes 72 in the second row whose temperature is higher than that of the air crossing the heat transfer tubes 73 in the third row. Further, in this indoor unit 4, during cooling, the rest of the refrigerant inflowing from the refrigerant inlet during cooling of the indoor heat exchanger 42 is sent to the third row-side gas refrigerant tubes 93 immediately after performing heat exchange with the air crossing the heat transfer tubes 73 in the third row. Additionally, the refrigerant that has passed through the second row-side gas refrigerant tubes 92 and the refrigerant that has passed through the third row-side gas refrigerant tubes 93 merge together and exit from the refrigerant outlet during cooling of the indoor heat exchanger 42. Here, the degree of superheat of the refrigerant immediately after performing heat exchange with the air crossing the heat transfer tubes 72 in the second row easily becomes larger than the degree of superheat of the refrigerant immediately after performing heat exchange with the air crossing the heat transfer tubes 73 in the third row because it is affected by the temperature of the air crossing the heat transfer tubes 72 in the second row.

Because of this, in this indoor unit 4, it becomes easier for the degree of superheat of the refrigerant exiting from the refrigerant outlet during cooling of the indoor heat exchanger 42 to become larger compared to the case of employing a structure where all of the gas refrigerant tubes 92 and 93 are connected to the heat transfer tubes 73 in the third row, and the heat exchange efficiency during cooling can be improved.

Further, in this indoor unit 4, during heating, all the refrigerant inflowing from the refrigerant inlet during heating of the indoor heat exchanger 42 is sent to the liquid refrigerant tubes 91 immediately after performing heat exchange with the air crossing the heat transfer tubes 71 in the first row whose temperature is the lowest.

Because of this, in this indoor unit 4, it becomes difficult for the degree of subcooling in the refrigerant outlet during heating of the indoor heat exchanger 42 to become smaller, and a drop in the heat exchange efficiency during heating can be suppressed.

As described above, in this indoor unit 4, it can be made more difficult for the degree of subcooling in the refrigerant outlet of the indoor heat exchanger 42 during heating to become smaller and it can also be made easier for the degree of superheat of the refrigerant exiting from the refrigerant outlet of the indoor heat exchanger 42 during cooling to become larger, and the heat exchange efficiency of the indoor heat exchanger 42 during cooling can be improved while suppressing a drop in the heat exchange efficiency of the indoor heat exchanger 42 during heating.

(B)

In the indoor heat exchanger 42 of the present embodiment, the liquid refrigerant tubes 91, the second row-side gas refrigerant tubes 92, and the third row-side gas refrigerant tubes 93 are connected to the lengthwise direction single ends of the corresponding heat transfer tubes 71, 72, and 73.

Because of this, in the indoor unit 4 of the present embodiment, the work of connecting the liquid refrigerant tubes 91, the second row-side gas refrigerant tubes 92, and the third row-side gas refrigerant tubes 93 to the heat transfer tubes 71, 72, and 73 can be consolidated and performed on the one lengthwise direction end side of the indoor heat exchanger 42, so the assemblability of the indoor heat exchanger 42 improves.

(C)

In the indoor heat exchanger 42 of the present embodiment, during cooling, some of the refrigerant is sent through the second row-side liquid refrigerant tubes 91*a* to the second row-side heat transfer tubes 71*a*, and the refrigerant that has become gas-rich because of heat exchange with the air in the second row-side heat transfer tubes 71*a* is caused to branch into and is sent through the two heat transfer tubes 72 in the second row, while the rest of the refrigerant is sent through the third row-side liquid refrigerant tubes 91*b* to the third row-side heat transfer tubes 71*b*, and the refrigerant that has become gas-rich because of heat exchange with the air in the third row-side heat transfer tubes 71*h* is caused to branch into and is sent through the two heat transfer tubes 73 in the third row, so an increase in the flow speed of the refrigerant that has become gas-rich can be suppressed.

Further, in the indoor heat exchanger 42 of the present embodiment, during heating, the refrigerant that has become liquid-rich because of heat exchange with the air in the two heat transfer tubes 72 in the second row and the refrigerant that has become liquid-rich because of heat exchange with the air in the two heat transfer tubes 73 in the third row are caused to merge together and become sent to the second row-side heat transfer tubes 71*a* and the third row-side heat transfer tubes 71*b*, so the flow speed of the refrigerant that has become liquid-rich can be increased to increase the heat transfer coefficient in the second row-side heat transfer tubes 71*a* and the third row-side heat transfer tubes 71*b*.

Moreover, in the indoor heat exchanger 42 of the present embodiment, during cooling, the refrigerant is caused to branch into the second row-side liquid refrigerant tubes 91*a* and the third row-side liquid refrigerant tubes 91*b* at the stage of the liquid refrigerant tubes 91 before being passed through the heat transfer tubes 71 in the first row.

Moreover, in this indoor heat exchanger 42, the refrigerant flows in such a way that, after heading from the one lengthwise direction end of the indoor heat exchanger 42 to the other end, it is caused to branch or merges together in the in-row branching portions 71*g* and 71*h* at the other lengthwise direction end of the indoor heat exchanger 42 and turns back from the other lengthwise direction end of the indoor heat exchanger 42 to the one end. For this reason, the paths on which the refrigerant flows become short paths where the refrigerant makes one round trip in the lengthwise direction through the indoor heat exchanger 42.

Because of this, in the indoor unit 4 of the present embodiment, an increase in pressure drop can be suppressed as a result of the in-second-row branching portions 71*g* and the in-third-row branching portions 71.*h* causing the flows of the refrigerant to branch, so the heat exchange efficiency of the indoor heat exchanger 42 during cooling can be further improved. In particular, in this indoor unit 4, an increase in the flow speed of the refrigerant in the heat transfer tubes 72 in the second row and the heat transfer tubes 73 in the third row through which flows the gas-rich refrigerant whose effect with respect to pressure drop is large is suppressed, so the heat exchange efficiency of the indoor heat exchanger 42 during cooling can be effectively improved. Further, in this indoor unit 4, the heat transfer coefficient is increased by increasing the flow speed of the refrigerant in the second row-side heat transfer tubes 71*a* and the third row-side heat transfer tubes 71*b* through which flows the liquid-rich refrigerant whose effect with respect to pressure drop is small, so it becomes easier for the degree of subcooling in the refrigerant outlet during heating of the indoor heat exchanger 42 to become larger, and a drop in the heat exchange efficiency during heating can be further suppressed.

(3) Modification 1

In the indoor heat exchanger 42 configuring the indoor unit 4 of the present modification, in the indoor heat exchanger 42 configuring the indoor unit 4 described above (see FIG. 33), the tube inner diameter of the third row-side liquid refrigerant tubes 91*b* is made smaller than the tube inner diameter of the second row-side liquid refrigerant tubes 91*a* adjacent thereto one stage on the upper sides or one stage on the lower sides of the third row-side liquid refrigerant tubes 91*b*, or the tube length of the third row-side liquid refrigerant tubes 91*b* is made longer than the tube length of the second row-side liquid refrigerant tubes 91*a* adjacent thereto one stage on the upper sides or one stage on the lower sides of the third row-side liquid refrigerant tubes 91*b*.

For this reason, in the indoor heat exchanger 42 of the present modification, during cooling, it becomes easier for more of the refrigerant to flow into the second row-side liquid refrigerant tubes 91*a* whose flow path resistance is small, so more of the refrigerant flows into the heat transfer tubes 72 in the second row than the heat transfer tubes 73 in the third row.

Because of this, in the indoor unit 4 of the present modification, it becomes easier for the degree of superheat of the refrigerant exiting from the refrigerant outlet during cooling of the indoor heat exchanger 42 to become larger, and the heat exchange efficiency of the indoor heat exchanger 42 during cooling can be further improved.

Other Embodiments

Embodiments of the present invention and modifications thereof have been described above on the basis of the drawings, but the specific configurations are not limited to these embodiments and their modifications and can be changed in a scope not departing from the gist of the invention.

(A)

For example, in the above-described embodiments and their modifications, examples have been described where the present invention was applied to a ceiling-embedded type of ceiling-mounted air conditioning unit, but the present invention is not limited to this and may also be applied to a form of ceiling-mounted air conditioning unit called a ceiling-suspended type where the entire unit is placed on the underside of a ceiling.

Figure 35:
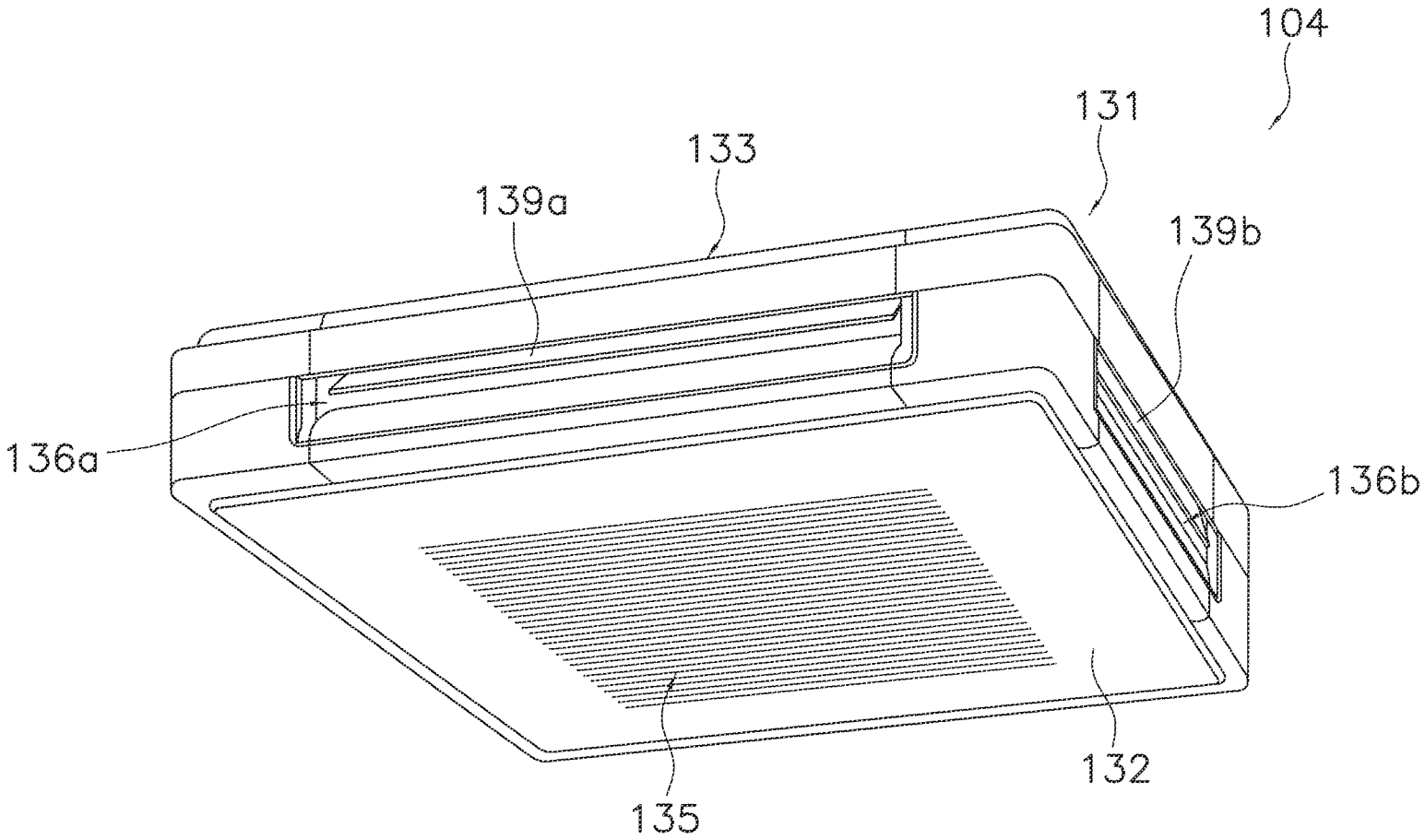
FIG. 35 is an external perspective view of an indoor unit serving as a ceiling-mounted air conditioning unit pertaining to another embodiment of the present invention.
Figure 36:
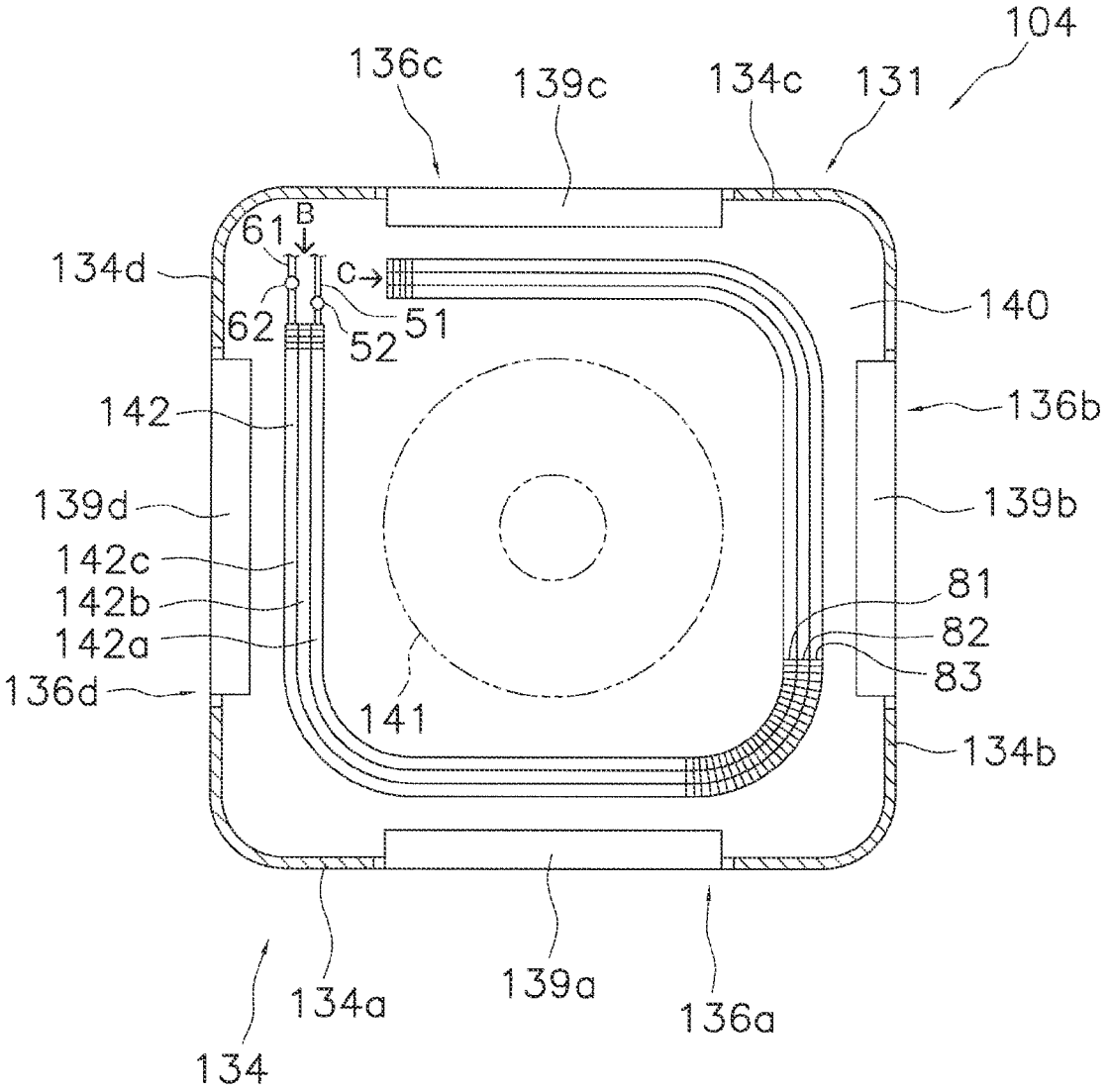
FIG. 36 is a schematic plan view showing a state where a top plate of the indoor unit serving as the ceiling-mounted air conditioning unit pertaining to the other embodiment of the present invention has been removed.

Specifically, the present invention can be applied to an indoor unit 104 shown in FIG. 35 and FIG. 36.

The indoor unit 104 has a casing 131 that stores various types of components inside. The casing 131 is placed in such a way as to be suspended inside an air-conditioned room in a state where its top surface is in contact with the ceiling surface of the air-conditioned room. Like in the above-described embodiments and their modifications, the indoor unit 104 configures a vapor compression refrigerant circuit (not illustrated in the drawings) as a result of being connected to an outdoor unit (not illustrated in the drawings) via a liquid refrigerant connection tube (not illustrated in the drawings) and a gas refrigerant connection tube (not illustrated in the drawings).

The casing 131 is a box-like body that has a substantially quadrilateral shape as seen in a plan view. The casing 131 has a top plate 133 that has a substantially quadrilateral shape, a side plate 134 that extends downward from the peripheral edge portion of the top plate 133, and a bottom plate 132 that has a substantially quadrilateral shape. The top plate 133 configures a portion penetrated by a liquid-side connecting tube 51 and a gas-side connecting tube 61 for interconnecting an indoor heat exchanger 142 (described later) and the refrigerant connection tubes (not illustrated in the drawings). The side plate 134 is configured from side plates 134*a*, 134*b*, 134*c*, and 134*d* corresponding to the sides of the top plate 133 and the bottom plate 134. Blow-out openings 136*a*, 136*b*, 136*c*, and 136*d* are disposed in the side plates 134*a*, 134*b*, 134*c*, and 134*d*. Horizontal flaps 139*a*, 139*b*, 139*c*, and 139*d* that adjust the direction of the air blown out into the air-conditioned room are disposed in the blow-out openings 136*a*, 136*b*, 136*c*, and 136*d*. A suction opening 135 that sucks in the air inside the air-conditioned room is formed in the substantial center of the bottom plate 132. The suction opening 135 is an opening that has a substantially quadrilateral shape.

Inside the casing 131, there are mainly placed: an indoor fan 41 serving as a centrifugal blower that sucks the air inside the air-conditioned room through the suction opening 135 into the inside of the casing 131 and blows out the air through the blow-out openings 136*a*, 136*b*, 136*c*, and 136*d* from the inside of the casing 131; and an indoor heat exchanger 142.

The indoor fan 141 has the same configuration as that of the indoor fan 41 in the above-described embodiments and their modifications and can suck in the air from below and blow out the air toward the outer peripheral side as seen in a plan view.

The indoor heat exchanger 142 is a fin-and-tube heat exchanger placed on the outer peripheral side of the indoor fan 141 as seen in a plan view. More specifically, the indoor heat exchanger 142 is bent and placed in such a way as to surround the periphery of the indoor fan 141 and is a fin-and-tube heat exchanger called a cross-fin type that has numerous heat transfer fins placed a predetermined interval apart from each other and plural heat transfer tubes disposed in a state where they penetrate these heat transfer fins in their plate thickness direction. The liquid side of the indoor heat exchanger 142 is connected to the liquid refrigerant connection tube (not illustrated in the drawings) via the liquid-side connecting tube 51, and the gas side of the indoor heat exchanger 142 is connected to the gas refrigerant connection tube (not illustrated in the drawings) via the gas-side connecting tube 61. Additionally, the indoor heat exchanger 142 functions as an evaporator of the refrigerant during cooling and as a condenser of the refrigerant during heating. Because of this, the indoor heat exchanger 142 can perform heat exchange with the air that has been blown out from the indoor fan 141, cool the air during cooling, and heat the air during heating. Additionally, the configuration of the indoor heat exchanger 142 is the same as that of the indoor heat exchanger 42 in the above-described embodiments and their modifications. Consequently, the indoor heat exchanger 42 and the heat exchange sections 42*a*, 42*b*, and 42*c* in the above-described embodiments and their modifications are changed into the indoor heat exchanger 142 and heat exchange sections 142*a*, 142*b*, and 142*e*, and description is omitted here. Further, a drain pan 140 for receiving drain water produced as a result of moisture in the air being condensed in the indoor heat exchanger 142 is placed on the underside of the indoor heat exchanger 142. The drain pan 140 is attached to the lower portion of the casing 131.

Additionally, in this ceiling-suspended indoor unit 104 also, the same action and effects as those of the above-described embodiments and their modifications can be obtained.

(B)

Further, in the above-described embodiments and their modifications, examples have been described where the present invention was applied to a ceiling-mounted air conditioning unit called a multi-flow type where a blow-out opening is disposed in such a way as to surround a suction opening as seen in a plan view, but the present invention is not limited to this and may also be applied to a form of ceiling-mounted air conditioning unit called a double-flow type where a blow-out opening is disposed on both sides of a suction opening as seen in a plan view.

Figure 37:
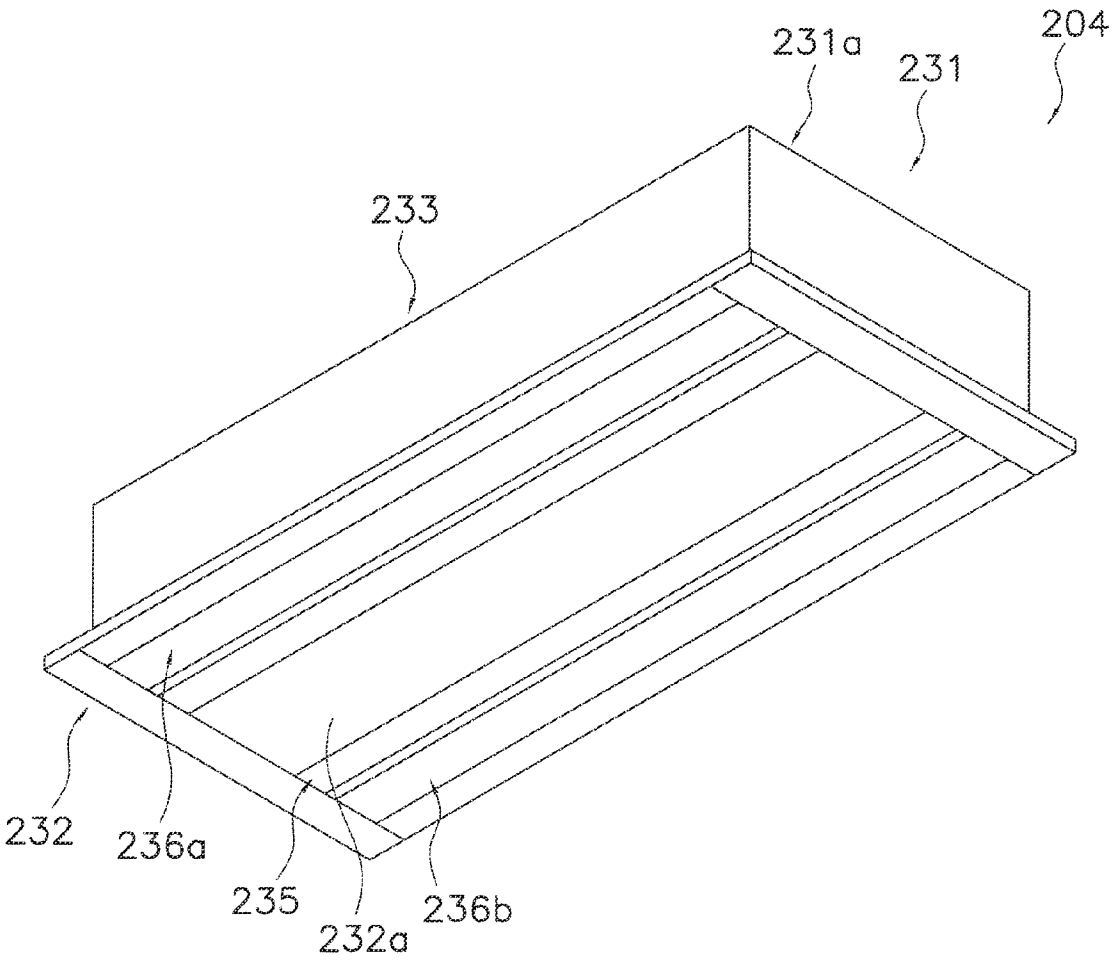
FIG. 37 is an external perspective view of an indoor unit serving as a ceiling-mounted air conditioning unit pertaining to another embodiment of the present invention.
Figure 38:
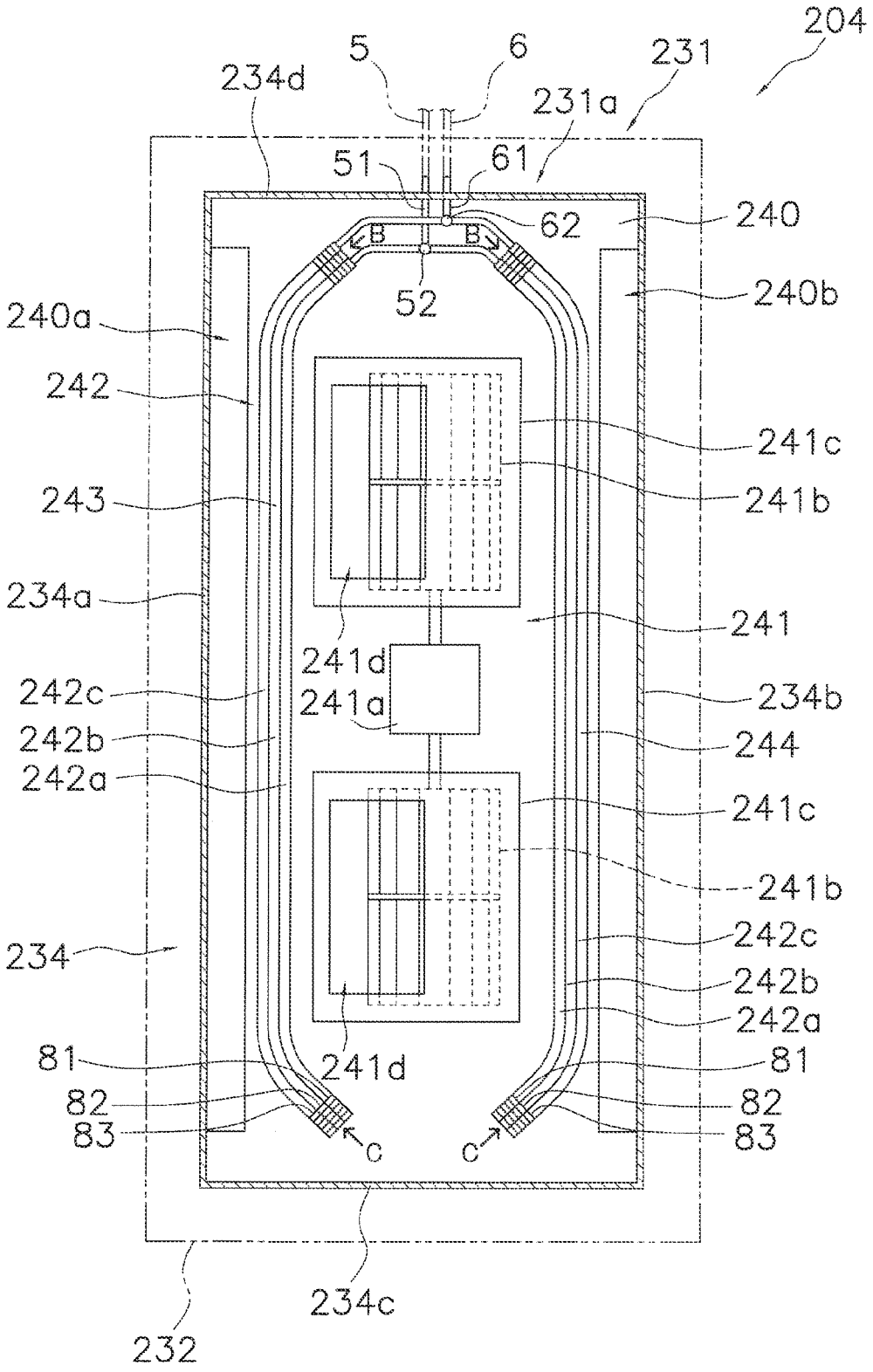
FIG. 38 is a schematic plan view showing a state where a top plate of the indoor unit serving as the ceiling-mounted air conditioning unit pertaining to the other embodiment of the present invention has been removed.

Specifically, the present invention can be applied to an indoor unit 204 shown in FIG. 37 and FIG. 38.

The indoor unit 204 has a casing 231 that stores various types of components inside. The casing 231 is configured from a casing body 231*a* and a decorative panel 232 that is placed on the underside of the casing body 231*a*. The casing body 231*a* is inserted and placed in an opening formed in a ceiling of an air-conditioned room like in the above-described embodiments and their modifications. Additionally, the decorative panel 232 is placed in such a way as to be fitted into the opening in the ceiling like in the above-described embodiments and their modifications. Like in the above-described embodiments and their modifications, the indoor unit 204 configures a vapor compression refrigerant circuit (not illustrated in the drawings) as a result of being connected to an outdoor unit (not illustrated in the drawings) via a liquid refrigerant connection tube 5 and a gas refrigerant connection tube 6.

The casing body 231*a* is a box-like body whose undersurface is open and which has a substantially quadrilateral shape as seen in a plan view. The casing body 231*a* has a top plate 233 that has a substantially quadrilateral shape and a side plate 234 that extends downward from the peripheral edge portion of the top plate 233. The side plate 234 is configured from side plates 234*a* and 234*b* that correspond to the long sides of the top plate 233 and side plates 234*c* and 234*d* that correspond to the short sides of the top plate 233. The side plate 234*d* configures a portion penetrated by a liquid-side connecting tube 51 and a gas-side connecting tube 61 for interconnecting an indoor heat exchanger 242 (described later) and the refrigerant connection tubes 5 and 6.

The decorative panel 232 is a plate-like body that has a substantially quadrilateral shape as seen in a plan view. The decorative panel 232 is mainly configured from a panel body 232*a* that is fixed to the lower end portion of the casing body 231*a*. The panel body 232*a* has a suction opening 235 that sucks in the air inside the air-conditioned room and blow-out openings 236*a* and 236*b* that are formed along the two long sides of the suction opening 235 and blow out the air into the air-conditioned room. The suction opening 235 is formed in such a way as to be sandwiched between the blow-out opening 236*a* and the blow-out opening 236*b*.

Inside the casing body 231*a*, there are mainly placed: an indoor fan 241 serving as a centrifugal blower that sucks the air inside the air-conditioned room through the suction opening 235 in the decorative panel 232 into the inside of the casing body 231*a* and blows out the air through the blow-out openings 236*a* and 236*b* in the decorative panel 232 from the inside of the casing 231*a*; and an indoor heat exchanger 242.

The indoor fan 241 has a fan motor 241*a* that is disposed in the substantial center inside the casing body 231 and plural (here, two) impellers 241*b* that are coupled to and driven to rotate by the fan motor 241*a*. Each of the impellers 241*b* is a double-suction type multiblade impeller and can suck air into the inside of a scroll casing 241*c* accommodating the impeller 241*b* and blow out the air from a blow-out opening 241*d* in the scroll casing 241*c*.

The indoor heat exchanger 242 is a fin-and-tube heat exchanger placed on the outer peripheral side of the indoor fan 241 as seen in a plan view. More specifically, the indoor heat exchanger 242 has indoor heat exchangers 243 and 244 that are placed generally along the two long sides of the top plate 233. The indoor heat exchangers 243 and 244 are fin-and-tube heat exchangers called a cross-fin type that has numerous heat transfer fins placed a predetermined interval apart from each other and plural heat transfer tubes disposed in a state where they penetrate these heat transfer fins in their plate thickness direction. Both end portions of the first indoor heat exchanger 243 are bent toward the second indoor heat exchanger 244 side, and both end portions of the second indoor heat exchanger 244 are bent toward the first indoor heat exchanger 243 side. That is, the indoor heat exchanger 242 overall is bent and placed in such a way as to surround the periphery of the indoor fan 241. The liquid side of the indoor heat exchanger 242 is connected to the liquid refrigerant connection tube 5 via the liquid-side connecting tube 51 after the liquid sides of the indoor heat exchangers 243 and 244 have merged together at the flow divider 52, and the gas side of the indoor heat exchanger 241 is connected to the gas refrigerant connection tube 6 via the gas-side connecting tube 61 after the gas sides of the indoor heat exchangers 243 and 244 have merged together at the header 62. Additionally, the indoor heat exchanger 242 functions as an evaporator of the refrigerant during cooling and as a condenser of the refrigerant during heating. Because of this, the indoor heat exchanger 242 can perform heat exchange with the air that has been blown out from the indoor fan 241, cool the air during cooling, and heat the air during heating. Additionally, the configuration of the indoor heat exchanger 242 is the same as that of the indoor heat exchanger 42 in the above-described embodiments and their modifications except that it comprises the two indoor heat exchangers 243 and 244 interconnected by the flow divider 52 and the header 62. Consequently, the indoor heat exchanger 42 and the heat exchange sections 42*a*, 42*h*, and 42*c* in the above-described embodiments and their modifications are changed into the indoor heat exchanger 242 (that is, the indoor heat exchangers 243 and 244) and heat exchange sections 242*a*, 242*b*, and 242*c*, and description is omitted here. Further, a drain pan 240 for receiving drain water produced as a result of moisture in the air being condensed in the indoor heat exchanger 242 is placed on the underside of the indoor heat exchanger 242. The drain pan 240 is attached to the lower portion of the casing body 231*a*. Further, blow-out holes 240*a* and 240*b* that are communicated with the blow-out openings 236*a* and 236*b* in the decorative panel 232 and a suction hole (not illustrated in the drawings) that is communicated with the suction opening 235 in the decorative panel 232 and accommodates the indoor fan 241 are formed in the drain pan 240.

Additionally, in this double-flow indoor unit 204 also, the same action and effects as those of the above-described embodiments and their modifications can be obtained.

INDUSTRIAL APPLICABILITY

The present invention is widely applicable to ceiling-mounted air conditioning units having a structure where an indoor heat exchanger comprising a fin-and-tube heat exchanger is placed on an outer peripheral side of a centrifugal blower as seen in a plan view.

What is claimed is:

1. A ceiling-mounted air conditioning unit comprising:

a centrifugal blower; and an indoor heat exchanger including a fin-and-tube heat exchanger disposed on an outer peripheral side of the centrifugal blower as seen in a plan view, the indoor heat exchanger including plural heat transfer tubes arranged in multiple stages in a vertical direction and in three rows in a flow direction of air blown out from the centrifugal blower, the plural heat transfer tubes being arranged and configured to have refrigerant flowing therein, plural liquid refrigerant tubes fluidly connected to a refrigerant inlet of the indoor heat exchanger in a case where the indoor heat exchanger functions as an evaporator of the refrigerant during cooling, the plural liquid refrigerant tubes being fluidly connected to the heat transfer tubes in a first row on a most upwind side relative to the flow direction of the air, second row-side gas refrigerant tubes that are some of plural gas refrigerant tubes fluidly connected to a refrigerant outlet of the indoor heat exchanger during cooling, the second row-side gas refrigerant tubes being fluidly connected to plural vertical pairs of the heat transfer tubes in a second row relative to the flow direction of the air, and third row-side gas refrigerant tubes that are a remainder of the plural gas refrigerant tubes, the third row-side gas refrigerant tubes being fluidly connected to the heat transfer tubes in a third row on a most downwind side relative to the flow direction of the air, refrigerant flowing in sequence through the refrigerant inlet, the plural liquid refrigerant tubes, the plural heat transfer tubes, the second and third row-side gas refrigerant tubes and the refrigerant outlet in the case where the indoor heat exchanger functions as an evaporator of the refrigerant during cooling, each vertical pair of heat transfer tubes in the second row being fluidly connected to a single one of the second row-side gas refrigerant tubes on a downstream side of the refrigerant inlet and on an upstream side of the refrigerant outlet in the case where the indoor heat exchanger functions as an evaporator of the refrigerant during cooling, and each of the second row-side gas refrigerant tubes being fluidly connected to only one of the vertical pairs of heat transfer tubes in the second row on the downstream side of the refrigerant inlet and on the upstream side of the refrigerant outlet such that refrigerant flows in sequence from only one vertical pair of heat transfer tubes in the second row, into each single one of the second row-side gas refrigerant tubes, and into the refrigerant outlet in the case where the indoor heat exchanger functions as an evaporator of the refrigerant during cooling.

2. The ceiling-mounted air conditioning unit according to claim 1, wherein the liquid refrigerant tubes, the second row-side gas refrigerant tubes, and the third row-side gas refrigerant tubes are connected to lengthwise direction single ends of corresponding heat transfer tubes of the plural heat transfer tubes.

3. The ceiling-mounted air conditioning unit according to claim 1, wherein the indoor heat exchanger has inter-row branching portions arranged to cause the refrigerant that has been sent to outlets of the heat transfer tubes in the first row during cooling to branch into the heat transfer tubes in the second row and the heat transfer tubes in the third row, outlets of the heat transfer tubes in the second row in a case where the indoor heat exchanger functions as an evaporator of the refrigerant during cooling are connected to the second row-side gas refrigerant tubes, and outlets of the heat transfer tubes in the third row in a case where the indoor heat exchanger functions as an evaporator of the refrigerant during cooling are connected to the third row-side gas refrigerant tubes.

4. The ceiling-mounted air conditioning unit according to claim 3, wherein the refrigerant that has passed through the liquid refrigerant tubes during cooling is sent to first upstream-side heat transfer tubes of the heat transfer tubes in the first row, passes through the first upstream-side heat transfer tubes, thereafter further passes through first downstream-side heat transfer tubes of the heat transfer tubes in the first row apart from the first upstream-side heat transfer tubes, and, at the outlets of the first downstream-side heat transfer tubes, is caused by the inter-row branching portions to branch into second upstream-side heat transfer tubes of the heat transfer tubes in the second row and third upstream-side heat transfer tubes of the heat transfer tubes in the third row, the refrigerant that has been sent to the second upstream-side heat transfer tubes passes through the second upstream-side heat transfer tubes, thereafter further passes through second downstream-side heat transfer tubes of the heat transfer tubes in the second row apart from the second upstream-side heat transfer tubes, and is sent from the outlets of the second downstream-side heat transfer tubes to the second row-side gas refrigerant tubes, and the refrigerant that has been sent to the third upstream-side heat transfer tubes passes through the third upstream-side heat transfer tubes, thereafter further passes through third downstream-side heat transfer tubes of the heat transfer tubes in the third row apart from the third upstream-side heat transfer tubes, and is sent from the outlets of the third downstream-side heat transfer tubes to the third row-side gas refrigerant tubes.

5. The ceiling-mounted air conditioning unit according to claim 4, wherein the second upstream-side heat transfer tubes are placed on lower sides of the third upstream-side heat transfer tubes.

6. The ceiling-mounted air conditioning unit according to claim 4, wherein the inter-row branching portions are formed such that a flow path length from the outlets of the first downstream-side heat transfer tubes to inlets of the third upstream-side heat transfer tubes becomes longer than a flow path length from the outlets of the first downstream-side heat transfer tubes to inlets of the second upstream-side heat transfer tubes in a case where the indoor heat exchanger functions as an evaporator of the refrigerant during cooling.

7. The ceiling-mounted air conditioning unit according to any of claim 4, wherein the third downstream-side heat transfer tubes are placed on upper sides of the third upstream-side heat transfer tubes.

8. The ceiling-mounted air conditioning unit according to any of claim 4, wherein the second downstream-side heat transfer tubes are placed on upper sides of the second upstream-side heat transfer tubes.

9. The ceiling-mounted air conditioning unit according to any of claim 4, wherein the first downstream-side heat transfer tubes are placed on upper sides of the first upstream-side heat transfer tubes.

10. The ceiling-mounted air conditioning unit according to claim 4, wherein the outlets of the second downstream-side heat transfer tubes and the outlets of the third downstream-side heat transfer tubes in a case where the indoor heat exchanger functions as an evaporator of the refrigerant during cooling are placed so as to be adjacent to the outlets of other of the second downstream-side heat transfer tubes and the outlets of other of the third downstream-side heat transfer tubes placed on upper sides or lower sides, and inlets of the first upstream-side heat transfer tubes in a case where the indoor heat exchanger functions as an evaporator of the refrigerant during cooling are placed so as to be adjacent to inlets of other of the first upstream-side heat transfer tubes placed on upper sides or lower sides.

11. The ceiling-mounted air conditioning unit according to claim 3, wherein the refrigerant that has passed through the liquid refrigerant tubes during cooling is sent to first heat transfer tubes of the heat transfer tubes in the first row, passes through the first heat transfer tubes, and, in the outlets of the first heat transfer tubes, is thereafter caused by the inter-row branching portions to branch into second heat transfer tubes of the heat transfer tubes in the second row and third heat transfer tubes of the heat transfer tubes in the third row, the refrigerant that has been sent to the second heat transfer tubes passes through the second heat transfer tubes and is thereafter sent from the outlets of the second heat transfer tubes to the second row-side gas refrigerant tubes, and the refrigerant that has been sent to the third heat transfer tubes passes through the third heat transfer tubes and is thereafter sent from the outlets of the third heat transfer tubes to the third row-side gas refrigerant tubes.

12. The ceiling-mounted air conditioning unit according to claim 11, wherein the second heat transfer tubes are placed on lower sides of the third heat transfer tubes.

13. The ceiling-mounted air conditioning unit according to claim 11, wherein the inter-row branching portions are formed such that a flow path length from the outlets of the first heat transfer tubes to inlets of the third heat transfer tubes becomes longer than a flow path length from the outlets of the first heat transfer tubes to inlets of the second heat transfer tubes in a case where the indoor heat exchanger functions as an evaporator of the refrigerant during cooling.

14. The ceiling-mounted air conditioning unit according to claim 1, wherein the refrigerant that has passed through second row-side liquid refrigerant tubes of the plural liquid refrigerant tubes during cooling is sent to second row-side heat transfer tubes of the heat transfer tubes in the first row, passes through the second row-side heat transfer tubes, and, in outlets of the second row-side heat transfer tubes, is thereafter caused by in-second-row branching portions to branch into two of the heat transfer tubes in the second row, the refrigerant that has been sent to the two of the heat transfer tubes in the second row passes through the two of the heat transfer tubes in the second row and is thereafter sent from outlets of the two of the heat transfer tubes in the second row to the second row-side gas refrigerant tubes, the refrigerant that has passed through third row-side liquid refrigerant tubes during cooling is sent to third row-side heat transfer tubes of the heat transfer tubes in the first row apart from the second row-side heat transfer tubes, passes through the third row-side heat transfer tubes, and, in outlets of the third row-side heat transfer tubes, is thereafter caused by in-third-row branching portions to branch into two of the heat transfer tubes in the third row, and the refrigerant that has been sent to the two of the heat transfer tubes in the third row passes through the two of the heat transfer tubes in the third row and is thereafter sent from outlets of the two of the heat transfer tubes in the third row to the third row-side gas refrigerant tubes.

15. The ceiling-mounted air conditioning unit according to claim 14, wherein the third row-side liquid refrigerant tubes have a tube inner diameter that is smaller than, or a tube length that is longer than, the second row-side liquid refrigerant tubes adjacent thereto on upper sides or lower sides.

* * * * *